US008589136B2

(12) United States Patent
Ertas et al.

(10) Patent No.: US 8,589,136 B2
(45) Date of Patent: Nov. 19, 2013

(54) METHODS AND SYSTEMS FOR MITIGATING DRILLING VIBRATIONS

(75) Inventors: Mehmet Deniz Ertas, Bethlehem, PA (US); Erika A. O. Biediger, Houston, TX (US); Shankar Sundararaman, Houston, TX (US); Jeffrey R. Bailey, Houston, TX (US); Vishwas Gupta, Sugar Land, TX (US); Narasimha-Rao V. Bangaru, Pittstown, NJ (US); Swarupa Soma Bangaru, legal representative, Pittstown, NJ (US)

(73) Assignee: ExxonMobil Upstream Research Company, Houston, TX (US)

( * ) Notice: Subject to any disclaimer, the term of this patent is extended or adjusted under 35 U.S.C. 154(b) by 287 days.

(21) Appl. No.: 12/989,183

(22) PCT Filed: May 28, 2009

(86) PCT No.: PCT/US2009/045497

§ 371 (c)(1),
(2), (4) Date: Oct. 22, 2010

(87) PCT Pub. No.: WO2009/155062

PCT Pub. Date: Dec. 23, 2009

(65) Prior Publication Data

US 2011/0077924 A1 Mar. 31, 2011

Related U.S. Application Data

(60) Provisional application No. 61/132,255, filed on Jun. 17, 2008, provisional application No. 61/174,531, filed on May 1, 2009.

(51) Int. Cl.

| | |
|---|---|
| ***G06F 17/50*** | (2006.01) |
| ***G06G 7/48*** | (2006.01) |
| ***E21B 43/00*** | (2006.01) |

(52) U.S. Cl.
USPC ..... 703/10; 703/1; 166/369

(58) Field of Classification Search
USPC ..... 703/1, 10; 166/369
See application file for complete search history.

(56) References Cited

U.S. PATENT DOCUMENTS

| | | | |
|---|---|---|---|
| 4,903,245 | A | 2/1990 | Close et al. |
| 5,159,577 | A | 10/1992 | Twist |
| 5,313,829 | A | 5/1994 | Paslay et al. |

(Continued)

FOREIGN PATENT DOCUMENTS

WO WO 2010/079379 A1 7/2010

OTHER PUBLICATIONS

Michael Lyle Payne, NPL, "Drilling Bottom-Hole Assembly Dynamics", May 1992.*

(Continued)

*Primary Examiner* — Omar Fernandez Rivas
*Assistant Examiner* — Angel Calle
(74) *Attorney, Agent, or Firm* — ExxonMobil Upstream Research Company—Law Department

(57) ABSTRACT

Methods and systems of reducing drilling vibrations include generation a vibration performance index using at least one frequency-domain model having a velocity-dependent friction relationship. The vibration performance index may be used to aid in the design or manufacture of a drill tool assembly. Additionally or alternatively, the vibration performance index may inform drilling operations to reduce vibrations.

43 Claims, 14 Drawing Sheets

(56) References Cited

U.S. PATENT DOCUMENTS

| | | | | |
|---|---|---|---|---|
| 5,321,981 | A | 6/1994 | Macpherson | |
| 5,358,059 | A | 10/1994 | Ho | |
| 5,402,677 | A | 4/1995 | Paslay et al. | |
| 5,448,911 | A | 9/1995 | Mason | |
| 5,560,439 | A | 10/1996 | Delwiche et al. | |
| 5,721,376 | A | 2/1998 | Pavone et al. | |
| 5,842,149 | A | 11/1998 | Harrell et al. | |
| 5,844,132 | A | 12/1998 | Fabret et al. | |
| 5,852,235 | A | 12/1998 | Pavone et al. | |
| 6,021,377 | A | 2/2000 | Dubinsky et al. | |
| 6,206,108 | B1 | 3/2001 | MacDonald et al. | |
| 6,227,044 | B1 | 5/2001 | Jarvis | |
| 6,233,524 | B1 | 5/2001 | Harrell et al. | |
| 6,363,780 | B1 | 4/2002 | Rey-Fabret et al. | |
| 6,382,331 | B1 | 5/2002 | Pinckard | |
| 6,424,919 | B1 | 7/2002 | Moran et al. | |
| 6,438,495 | B1 | 8/2002 | Chau et al. | |
| 6,443,242 | B1 | 9/2002 | Newman et al. | |
| 6,467,557 | B1 | 10/2002 | Krueger et al. | |
| 6,603,472 | B2 | 8/2003 | Allen et al. | |
| 6,662,110 | B1 | 12/2003 | Bargach et al. | |
| 6,691,802 | B2 | 2/2004 | Schultz et al. | |
| 6,722,450 | B2 | 4/2004 | Schultz et al. | |
| 6,732,052 | B2 | 5/2004 | Macdonald et al. | |
| 6,785,641 | B1 | 8/2004 | Huang | |
| 6,817,425 | B2 | 11/2004 | Schultz et al. | |
| 6,968,909 | B2 | 11/2005 | Aldred et al. | |
| 7,020,597 | B2 | 3/2006 | Oliver et al. | |
| 7,054,750 | B2 | 5/2006 | Rodney et al. | |
| 7,082,371 | B2 | 7/2006 | Griffin et al. | |
| 7,082,821 | B2 | 8/2006 | Chen et al. | |
| 7,114,578 | B2 | 10/2006 | Hutchinson | |
| 7,139,689 | B2 | 11/2006 | Huang | |
| 7,140,452 | B2 | 11/2006 | Hutchinson | |
| 7,172,037 | B2 | 2/2007 | Dashevskiy et al. | |
| 7,219,747 | B2 | 5/2007 | Gleitman et al. | |
| 7,251,590 | B2 | 7/2007 | Huang et al. | |
| 7,316,278 | B2 | 1/2008 | Hutchinson | |
| 7,357,196 | B2 | 4/2008 | Goldman et al. | |
| 7,413,032 | B2 | 8/2008 | Krueger | |
| 7,464,013 | B2 | 12/2008 | Huang et al. | |
| 7,645,124 | B2 | 1/2010 | Garlow | |
| 7,730,967 | B2 | 6/2010 | Ballantyne et al. | |
| 7,748,474 | B2 | 7/2010 | Watkins et al. | |
| 8,214,188 | B2 * | 7/2012 | Bailey et al. | 703/10 |
| 2004/0221985 | A1 | 11/2004 | Hill et al. | |
| 2005/0096847 | A1 | 5/2005 | Huang | |
| 2005/0133272 | A1 | 6/2005 | Huang et al. | |
| 2005/0197813 | A1 | 9/2005 | Grayson | |
| 2005/0273302 | A1 * | 12/2005 | Huang et al. | 703/10 |
| 2005/0273304 | A1 | 12/2005 | Oliver et al. | |
| 2006/0149518 | A1 | 7/2006 | Oliver et al. | |
| 2006/0195307 | A1 * | 8/2006 | Huang et al. | 703/7 |
| 2007/0005316 | A1 * | 1/2007 | Paez | 703/10 |
| 2007/0021857 | A1 | 1/2007 | Huang | |
| 2007/0025017 | A1 | 2/2007 | Sakano | |
| 2007/0067147 | A1 | 3/2007 | Huang | |
| 2007/0192071 | A1 * | 8/2007 | Huang et al. | 703/2 |
| 2008/0156531 | A1 | 7/2008 | Boone et al. | |
| 2008/0164062 | A1 | 7/2008 | Brackin et al. | |
| 2008/0230272 | A1 | 9/2008 | Chen et al. | |
| 2008/0255817 | A1 | 10/2008 | Pabon et al. | |
| 2009/0114445 | A1 | 5/2009 | Dashevskiy | |
| 2009/0229882 | A1 | 9/2009 | Quernheim et al. | |
| 2010/0032165 | A1 * | 2/2010 | Bailey et al. | 166/369 |

OTHER PUBLICATIONS

Sondipon, Adhikari, NPL, "Damping Models for structural Vibration", Sep. 2000.*

Aarrestad, T.V. et al., "Drillstring Vibrations: Comparison Between Theory and Experiments on a Full-Scale Research Drilling Rig", SPE 14760, Feb. 10-12, 1986, pp. 311-321, 1986 IADC/SPE Drilling Conf., Dallas, TX.

Aarrestad, T.V. et al., "An Experimental and Theoretical Study of a Coupling Mechanism Between Longitudinal and Torsional Drillstring Vibrations at the Bit", Oct. 5-8, 1986, SPE 15563, pp. 12-18, 1986 SPE Annual Tech. Conf. & Exh., New Orleans, LA.

Allen, M.B., "BHA Lateral Vibrations: Case Studies and Evaluation of Important Parameters", SPE 16110, Mar. 15-18, 1987, pp. 531-535, 1987 SPE/IADC Drilling Conf., New Orleans, LA.

Armagost, W.K. et al., "The Successful Use of Anti-Whirl Technology in Conventional Coring", SPE 27473, Feb. 15-18, 1994, pp. 397-407, 1994 IADC/SPE Drilling Conf., Dallas, TX.

Ashton, J.P. et al., "In-Situ Heat System Stimulates Paraffinic-Crude Producers in Gulf of Mexico", SPE 15660, Oct. 5-8, 1986, pp. 157-160, 1986 SPE Annual Tech. Conf. & Exh., New Orleans, LA.

Apostal, M.C. et al., "A Study to Determine the Effect of Damping on Finite-Element-Based, Forced-Frequency-Response Models for Bottomhole Assembly Vibration Analysis", SPE 20458, Sep. 23-26, 1990, pp. 537-550, 68$^{th}$ Annual Technical Conf. and Exh. of the Society of Petroleum Engineers, New Orleans, LA.

Bailey, J.R., et al., "Drilling Vibrations Modeling and Field Validation", SPE 112650, Mar. 4-6, 2008, 15 pages, 2008 IADC/SPE Drilling Conf., Orlando, FL.

Baird, J.A. et al., "GEODYN2: A Bottomhole Assembly/Geological Formation Dynamic Interaction Computer Program", SPE 14328, Sep. 22-25, 1985, pp. 1-11, 60$^{th}$ Annual Technical Conf. and Exh. of the Society of Petroleum Engineers, Las Vegas, NV.

Baumgart, A., "Stick-Clip and Bit-Bounce of Deep-Hole Drillstrings", Jun. 2000, pp. 78-82, vol. 122, Transactions of the ASME.

Behr, S.M. et al., "3D PDC Bit Model Predicts Higher Cutter Loads", SPE 21928, Mar. 11-14, 1991, pp. 253-258, 1991 SPE/IADC Drilling Conf., Amsterdam, The Netherlands.

Besaisow, A.A. et al., "Development of a Surface Drillstring Vibration Measurement System", SPE 14327, Sep. 22-25, 1985, pp. 1-14, 60$^{th}$ Annual Technical Conf. and Exh. of the Society of Petroleum Engineers, Las Vegas, NV.

Besaisow, A.A., et al., "A Study of Excitation Mechanisms and Resonances Inducing Bottomhole-Assembly Vibrations", SPE 15365, Oct. 5-8, 1986, pp. 93-101, 1986 SPE Annual Tech. Conf. & Exh., New Orleans, LA.

Besaisow, A.A. et al., "Application of ADAMS (Advanced Drillstring Analysis and Measurement System) and Improved Drilling Performance", SPE 19998, Feb. 27-Mar. 2, 1990, pp. 717-722, 1990 IADC/SPE Drilling Conf., Houston, TX.

Besson, A. et al., "Optimization of the Drilling Performance in the 17½-in. Section of an Exploration Well in the Overthrust of Southern Italy", SPE 23910, Feb. 18-21 1992, pp. 621-630, 1992 IADC/SPE Drilling Conf., New Orleans, LA.

Booer, A.K. et al., "Drillstring Imaging—An Interpretation of SSPE Drilling & Completion", SPE 23889, Fe. 18-21, 1992, pp. 93-98, 1992 IADC/SPE Drilling Conf., New Orleans, LA.

Brakel, J.D., "Prediction of Wellbore Trajectory Considering Bottom Hole Assembly and Drillbit Dynamics", Thesis, 1987, pp. 28-61, UMI Dissertation Services.

Brett, J.F. et al., "Bit Whirl: A New Theory of PDC Bit Failure", SPE 19571, Oct. 8-11, 1989, pp. 521-536, 64$^{th}$ Annual Technical Conf. and Exh. of the Society of Petroleum Engineers, San Antonio, TX.

Brett, J.F., "The Genesis of Torsional Drillstring Vibrations", SPE 21943, 1991, pp. 168-174, 1991 SPE/IADC Drilling Conf., Amsterdam, The Netherlands.

Burgess, T.M., "Improving BHA Tool Reliability with Drillstring Vibration Models: Field Experience and Limitations", SPE 16109, Mar. 15-18, 1987, pp. 517-530, 1987 SPE/IADC Drilling Conf., New Orleans, LA.

Burgess, T.M. et al., "Wellsite Action on Drilling Mechanics Information Improves Economics", SPE 29431, Feb. 28-Mar. 2, 1995, pp. 855-871, 1994 SPE/IADC Drilling Conf., Amsterdam, The Netherlands.

Chen, David C.K. et al., "Maximizing Drilling Performance with State-of-the-Art BHA Program", SPE 104502, Feb. 20-22, 2007, pp. 1-13, 2007 SPE/IADC Drilling Conf., Amsterdam, The Netherlands.

(56) References Cited

OTHER PUBLICATIONS

Chen, S.L., et al., "Field Investigation of the Effects of Stick-Slip, Lateral, and Whirl Vibrations on Roller Cone Bit Performance", SPE 56439, Oct. 3-6, 1999, pp. 1-10, 1999 SPE Annual Technical Conf. and Exh., Houston, TX.
Chen, S.L., et al., "An Improved Transfer Matrix Technique as Applied to BHA Lateral Vibration Analysis", 1995, pp. 93-105, vol. 185(1), Journal of Sound and Vibration.
Chin, W.C., "Predicting and Avoiding Catastrophic Drillstring Failure", SPE 19445, Aug. 17, 1989, pp. 1-12, SPE Publications.
Chin, W.C., *Wave Propagation in Petroleum Engineering*, 1994, pp. 159-162, 170-176, 226-230, 240-242, 254-263, Gulf Publishing Company.
Clayer, F. et al., "The Effect of Surface and Downhole Boundary Conditions on the Vibration of Drillstrings", Sep. 23-26, 1990, SPE 20447, pp. 431-442, 65$^{th}$ Annual Technical Conf. and Exh. of the Society of Petroleum Engineers, New Orleans, LA.
Clayton, R.I. et al., "Development of Whirl Resistant PDC Bits", SPE 26954, Apr. 27-29, 1994, pp. 625-637, III Latin American/Caribbean Petroleum Engineering Conf., Buenos Aires, Argentina.
Close, D.A. et al., "Measurement of BHA Vibration Using MWD", SPE 17273, Feb. 26-Mar. 2, 1988, pp. 659-668, 1988 IADC/SPE Drilling Conf., Dallas, TX.
Cobern, M.E. et al., "Downhole Vibration Monitoring & Control System Quarterly Technical Report #2", Apr. 1, 2003, pp. 3-19, DOE Award No. DE-FC26-02NT41664, OSTI ID: 821466; APS Technology Inc.
Cook, R.L. et al., "First Real Time Measurements of Downhole Vibrations, Forces, and Pressures Used to Monitor Directional Drilling Operations", SPE 18651, Feb. 28-Mar. 3, 1989, 1989 SPE/IADC Drilling Conf., New Orleans, LA.
Cutt, R.N. et al., "Beryl Field: Extracting Maximum Value from a Mature Asset Through the Evolution of Technology", SPE 92763, Feb. 23-25, 2005, pp. 1-9, SPE/IADC Drilling Conf., Amsterdam, The Netherlands.
Dareing, D.W., "Longitudinal and Angular Drill-String Vibrations with Damping", Sep. 22-25, 1968, pp. 1-9, Ref. B-C, Paper No. 68-Pet-30, Petroleum Mechanical Engineering and First Pressure Vessel and Piping Conf., Dallas, TX.
Dareing, D.W., "Drill Collar Length is a Major Factor in Vibration Control", SPE 11228, Sep. 26-29, 1983, pp. 637-644, 1982 SPE Annual Tech. Conf. & Exh., New Orleans, LA.
Dashevskiy, D. et al., "Application of Neural Networks for Predictive Control in Drilling Dynamics", SPE 56442, Oct. 3-6, 1999 pp. 1-8, 1999 SPE Annual Technical Conf. and Exh., Houston, TX.
Dawson, R. et al., "Drillstring Stick-Slip Oscillations", Jun. 14-18, 1987, pp. 1-6, 1987 SEM Spring Conf., Houston TX.
Desmette, S. et al., "Isubs: A New Generation of Autonomous Instrumented Downhole Tool", SPE 92424, Feb. 23-25, 2005, pp. 1-7, SPEC/IADC Drilling Conf., Amsterdam, The Netherlands.
Dufeyte, M.P. et al., "Detection and Monitoring of the Slip-Stick Motion: Field Experiments", SPE 21945, Mar. 11-14, 1991, pp. 429-438, 1991 SPE/IADC Drilling Conf., Amsterdam, The Netherlands.
Dunayevsky, V.A. et al., "Dynamic Stability of Drillstrings Under Fluctuating Weight on Bit", SPE 14329, Sep. 22-23, 1985, pp. 84-92, 1985 SPE Annual Tech. Conf. & Exh., Las Vegas, NV.
Dupriest, F.E. et al., "Maximizing Drill Rates with Real-Time Surveillance of Mechanical Specific Energy", SPE 92194, Feb. 23-25, 2005, pp. 1-11, SPE/IADC Drilling Conf., Amsterdam, The Netherlands.
Dykstra, M.W., et al., "Experimental Evaluations of Drill Bit and Drill String Dynamics", SPE 28323, Sep. 25-28, 1994, pp. 319-334, 69$^{th}$ Annual Technical Conf. and Exh. of the Society of Petroleum Engineers, New Orleans, LA.
Dykstra, M.W. et al., "Drillstring Component Mass Imbalance: A Major Source of Downhole Vibrations", SPE 29350, Feb. 28-Mar. 2, 1995, pp. 234-241, 1995 SPE/IADC Drilling Conf., Amsterdam, The Netherlands.
Dykstra, M.W. et al., "Improving Drilling Performance by Applying Advanced Dynamics Models", SPE 67697, Feb. 27-Mar. 1, 2001, pp. 1-18, SPE/IADC Drilling Conf., Amsterdam, The Netherlands.
Dykstra, M.W., "Nonlinear Drill String Dynamics", Dissertation, 1996, pp. 74-92, 148-149, 172-178, 185-186, The University of Tulsa.
Field, D.J. et al., "Techniques for Successful Application of Dynamic Analysis in the Prevention of Field-Induced Vibration Damage in MWD Tools", SPE 25773, Feb. 23-25, 1993, pp. 901-913, SPE/IADC Drilling Conf., Amsterdam, The Netherlands.
Fear, M.J. et al., "Experience in the Detection and Suppression of Torsional Vibration From Mud Logging Data", SPE 28908, Oct. 25-27, 1994, pp. 433-448, 1997 European Petroleum Conf., London, U.K.
Fear, M.J. et al., "The Destruction of PDC Bits by Severe Slip-Stick Vibration", SPE 37639, Mar. 4-6, 1997, pp. 1-11, SPE/IADC Drilling Conf., Amsterdam, The Netherlands.
Firpo, S.E., "Mechanical Behavior of Two-Dimensional Drill Strings in Inclined Holes", Thesis, 1986, pp. 3-12, Rice University.
Fontenot, E.P., "Drilling a 26-in. Diameter Hole to 12,550 ft: A Case History", SPE 15365, Oct. 5-8, 1986, pp. 1-12, 61$^{st}$ Annual Technical Conf. and Exh. of the Society of Petroleum Engineers, New Orleans, LA.
Gallagher, J. et al., "Performance Drilling: A Practical Solution to Drillstring Vibration", SPE 27538, Feb. 15-18, 1994, pp. 961-970, IADC/SPE Drilling Conf., Dallas, TX.
Grindhaug, G. et al., "Planning and Detailed BHA Vibration Modeling Leads to Performance Step Change Drilling Deviated 24-in. Hole Section, Offshore Norway", SPE 99126, Feb. 21-23, 2006, pp. 1-12, IADC/SPE Drilling Conf., Miami, FL.
Halsey, G.W. et al., "Drillstring Torsional Vibrations: Comparison Between Theory and Experiment on a Full-Scale Research Drilling Rig", SPE 15564, Oct. 5-8, 1986, pp. 1-10, 61$^{st}$ Annual Technical Conf. and Exh. of the Society of Petroleum Engineers, New Orleans, LA.
Hanson, J.M. et al., "Dynamics Modeling of PDC Bits", SPE 29401, Feb. 28-Mar. 2, 1995, pp. 589-604, SPE/IADC Drilling Conf., Amsterdam, The Netherlands.
Heisig, G. et al., "Lateral Drillstring Vibrations in Extended-Reach Wells", SPE 59235, Feb. 23-25, 2000, pp. 1-11, 2000 IADC/SPE Drilling Conf., New Orleans, LA.
Henneuse, H., "Surface Detection of Vibrations and Drilling Optimization: Field Experience", SPE 23888, Feb. 18-21, 1992, pp. 409-423, 1992 IADC/SPE Drilling Conf., New Orleans, LA.
Howard, J.A. et al., "Systematic Tracking of Fatigue and Crack Growth to Optimize Drillstring Reliability", SPE 25775, Feb. 23-25, 1993, pp. 927-939, 1993 SPE/IADC Drilling Conf., Amsterdam, The Netherlands.
Jansen, J.D., "Whirl and Chaotic Motion of Stabilized Drill Collars", SPE 20930, Oct. 22-24, 1990, pp. 107-114, 1990 European Petroleum Conf., The Hague.
Jansen, J.D. et al., "Active Damping of Torsional Drillstring Vibrations with a Hydraulic Top Drive", SPE 28911, Oct. 25-27, 1994, pp. 250-254, 1994 European Petroleum Conf., London, England.
Jansen, J.D., "Nonlinear Dynamics of Oilwell Drillstrings", Jun. 16, 1993, pp. 38-39, 44, 49-55, 67-69, 96-108, 136-140, 173, 177, Delft University Press.
Javanmardi, K. et al., "Application of Soft-Torque Rotary Table in Mobile Bay", SPE 23913, Feb. 18-21, 1992, pp. 645-650, 1992 IADC/SPE Drilling Conf., New Orleans, LA.
Jogi, P. et al., Visualization of BHA Dynamics Improves Understanding of Downhole Drilling Conditions, SPE 99181, Feb. 21-23, 2006, pp. 1-10, IADC/SPE Drilling Conf., Miami, FL.
Kenner, J.V. et al., "Dynamic Analysis Reveals Stability of Roller Cone Rock Bits", SPE 28314, Sep. 25-28, 1994, pp. 227-236, SPE 69th Annual Technical Conf. and Exh.
Kreisle, L.F. et al., "Mathematical Analysis of the Effect of a Shock Sub on the Longitudinal Vibrations of an Oilwell Drill String", SPE 2778, Dec. 1970, pp. 349-356, SPE Journal, v 10.
Kriesels, P.C. et al., "Cost Savings through an Integrated Approach to Drillstring Vibration Control", SPE 57555, Nov. 8-10, 1999, pp. 1-12, 1999 SPE/IADC Middle East Drilling Technology Conf.

(56) References Cited

OTHER PUBLICATIONS

Kyllingstad, A. et al., "A Study of Slip/Stick Motion of the Bit", SPE 16659, Sep. 27-30, 1987, pp. 369-373, 1987 SPE Annual Tech. Conf. & Exh., Dallas, TX.
Kyllingstad, A., et al., "A New Stick-Slip Prevention System", SPE 119660, Mar. 17-19, 2009, 14 pages, SPE/IADC Drilling Conf., Amsterdam, The Netherlands.
Lee, H.Y., "Drillstring Axial Vibration and Wave Propagation in Boreholes", 1991, pp. 55-71, 116-122, Massachusetts Institute of Technology.
Leine, R.I. et al., "Stick-Slip Whirl Interaction in Drillstring Dynamics", Apr. 2002, pp. 209-220, Journal of Vibration and Acoustics, v 124.
Li, C., "An Analytical Study of Drill String Vibrations", SPE 15975, 1987, pp. 1-20, Society of Petroleum Engineers.
Li, Z., et al., "Fundamental Equations for Dynamic Analysis of Rod and Pipe String in Oil-Gas Wells and Application in Static Buckling Analysis", 2002, 10 pages, JCPT.
Lin, Y.-Q., et a., "Stick-Slip Vibration of Drill Strings", Feb. 1991, pp. 38-43, vol. 113, Transactions of the ASME.
McCain, J.R, W.D. et al., "The Coefficient of Isothermal Compressibility of Black Oils at Pressures Below the Bubblepoint", SPE 15664, Sep. 1988, pp. 659-662, SPE Formation Evaluation.
MacPherson, J.D. et al., "Surface Measurement and Analysis of Drillstring Vibrations While Drilling", SPE 25777, Feb. 23-25, 1993, pp. 953-963, 1993 SPE/IADC Drilling Conf., Amsterdam, The Netherlands.
Millheim, K.K. et al., "The Effect of Bottomhole Assembly Dynamics on the Trajectory of a Bit", SPE 9222, Sep. 21-24, 1980, pp. 2323-2338, SPE 55th Annual Tech. Conf. & Exhibition, Dallas, TX.
Mitchell, R.F. et al., "Case Studies of BHA Vibration Failure", SPE 16675, Sep. 27-30, 1987, pp. 237-250, 62nd Annual Technical Conf. and Exh. of the Society of Petroleum Engineers, Dallas, TX.
Murray, P.J. et al., "Slimhole Vibration Case Study", SPE 28325, Sep. 25-28, 1994, pp. 347-356, SPE 69th Annual Technical Conf. and Exh., New Orleans, LA.
Neubert, M. et al., "Verification of an Advanced Analysis Model with Downhole Bending Moment Measurements", SPE 93864, Apr. 5-7, 2005, 2005 Asia Pacific Oil & Gas Conf. & Exh., Jakarta, Indonesia.
Nicholson, J.W., "An Integrated Approach to Drilling Dynamics Planning, Identification, and Control", SPE 27537, Feb. 15-18, 1994, pp. 947-960, IADC/SPE Drilling Conf., Dallas, TX.
Parfitt, S.H.L. et al., "A Model for Shock Sub Performance Qualification", SPE 29354, Feb. 28-Mar. 2, 1995, pp. 215-225, 1995 SPE/IADC Drilling Conf., Amsterdam, The Netherlands.
Paslay, P.R., "Drill String Vibrations due to Intermittent Contact of Bit Teeth," 1962, pp. 1-8, Transactions of the ASME, Paper No. 62-Pet-13.
Pavone, D.R. et al., "Application of High Sampling Rate Downhole Measurements for Analysis and Cure of Stick-Slip in Drilling", SPE 28324, Sep. 25-28, 1994, pp. 335-345, SPE 69th Annual Technical Conf. and Exh., New Orleans, LA.
Perreau, P.J. et al., "New Results in Real Time Vibrations Prediction", SPE 49479, Oct. 11-14, 1998, pp. 190-200, 8th Abu Dhabi International Petroleum Exh. and Conf., Abu Dhabi, U.A.E.
Poletto, F. et al., "Seismic While Drilling—Fundamentals of Drill-Bit Seismic for Exploration, Chpt. 4—General Theory: Drill-String Waves and Noise Fields", 2004, pp. 163-212, vol. 35, Seismic Exploration.
Rajnauth, J. et al., "Reduce Torsional Vibration and Improve Drilling Operations", SPE 81174, Apr. 27-30, 2003, pp. 1-13, SPE Latin American and Caribbean Petroleum Engineering Conf., Port-of-Spain, Trinidad, West Indies.
Reid, D. et al., "Analysis of Drillstring Failure", SPE 29351, Feb. 28-Mar. 2, 1995, pp. 187-196, 1995 SPE/IADC Drilling Conf., Amsterdam, The Netherlands.
Rewcastle, S.C. et al., "Real-Time Downhole Shock Measurements Increase Drilling Efficiency and Improve MWD Reliability", SPE 23890, Feb. 18-21, 1992, pp. 433-442, 1992 IADC/SPE Drilling Conf., New Orleans, LA.
Richard, T., et al., "A Simplified Model to Explore the Root Cause of Stick-Slip Vibrations in Drilling Systems with Drag Bits", 2007, pp. 432-456, vol. 305, Journal of Sound and Vibration.
Robnett, E.W., et al., "Analysis of the Stick-Slip Phenomenon Using Downhole Drillstring Rotation Data", SPE 52821, Mar. 9-11, 1999, pp. 1-12, 1999 SPE/IADC Drilling Conf., Amsterdam, The Netherlands.
Roukema, J.C., et al., "Generalized Modeling of Drilling Vibrations. Part II: Chatter Stability in Frequency Domain", 2007, pp. 1474-1485, vol. 47, Int'l. Journal of Machine Tools & Mfg.
Salman, M. et al., "Rotary Drilling US-Khuff Formation with PDC Bits", SPE 53341, Feb. 20-23, 1999, pp. 1-7, 1999 SPE Middle East Oil Show, Bahrain.
Samuel, G.R. et al., "Vibration Analysis, Model Prediction, and Avoidance: A Case History", SPE 102134, Oct. 16-18, 2006, pp. 1-7, 2006 SPE/IADC Indian Drilling Technology Conf. and Exh., Mumbai, India.
Sananikone, P. et al., "A Field Method for Controlling Drillstring Torsiohal Vibrations", SPE 23891, Feb. 18-21, 1992, pp. 443-452, 1992 IADC/SPE Drilling Conf., New Orleans, LA.
Sathuvalli, U.B. et al., "Advanced Assessment of Drillpipe Fatigue and Application to Critical Well Engineering", SPE 92591, Feb. 23-25, 2005, pp. 1-11, SPE/IADC Drilling Conf., Amsterdam, The Netherlands.
Serrarens, A.F.A., "H-∞ Control as Applied to Torsional Drillstring Dynamics", Mar. 19, 1977, Master Thesis, pp. 23-54, Eindhoven University of Technology, The Netherlands.
Schmalhorst, B. et al., "Drilling Dynamics in the Presence of Mud Flow", SPE 59236, Feb. 23-25, 2000, pp. 1-12, 2000 IADC/SPE Drilling Conf., New Orleans, LA.
Sinor, L.A. et al., "Field Testing of Low-Friction-Gauge PDC Bits", SPE 20416, Sep. 23-26, 1990, pp. 21-27, 1990 SPE Annual Tech. Conf. & Exh., New Orleans, LA.
Skaugen, E., "The Effects of Quasi-Random Drill Bit Vibrations Upon Drillstring Dynamic Behavior", SPE 16660, Sep. 27-30, 1987, pp. 105-116, 62$^{nd}$ Annual Technical Conf. & Exh. of the Society of Petroleum Engineers, Dallas, TX.
Skaugen E. et al., "Performance Testing of Shock Absorbers", SPE 15561, Oct. 5-8, 1986, pp. 1-12, 61$^{st}$ Annual Technical Conf. & Exh. of the Society of Petroleum Engineers, New Orleans, LA.
Sotomayor, G. P.G. et al., "Drill String Vibration: How to Identify and Supress", SPE 39002, Aug. 30-Sep. 3, 1997, pp. 1-11, Fifth Latin American and Caribbean Petroleum Engineering Conf. & Exh., Rio de Janeiro, Brazil.
Sowers, S.F., et al., "Roller Roamers Improve Drilling Performance in Wells Limited by Bit and Bottomhole Assembly Vibrations", SPE 119375, Mar. 17-19, 2009, 8 pages, SPE/IADC Drilling Conf., Amsterdam, The Netherlands.
Spanos, P.D. et al., "Advances in Dynamic Bottomhole Assembly Modeling and Dynamic Response Determination", SPE 23905, Feb. 18-21, 1992, pp. 581-590, 1992 IADC/SPE Drilling Conf., New Orleans, LA.
Spanos, P.D., et al., "Bottom-Hole Assembly Modeling and Dynamic Response Determination", Sep. 1997, pp. 153-158, vol. 119, Journal of Energy Resources Technology.
Thomas, S. et al., "Expanding Application of PDC into Harder, More Abrasive Formations: Performance Step Change in Saudi Arabia", SPE 92435, Feb. 23-25, 2005, pp. 1-12, SPE/IADC Drilling Conf., Amsterdam, The Netherlands.
Tucker, R.W. et al., On the Effective Control of Torsional Vibrations in Drilling Systems, 1999, pp. 101-122, v. 224(1), Journal of Sound and Vibration.
Van Oort, E. et al., "Drilling More Stable Wells Faster and Cheaper with PDC Bits and Water Based Muds", SPE 59192, Feb. 23-25, 2000, pp. 1-16, 2000 IADC/SPE Drilling Conf., New Orleans, LA.
Vandiver, J.K. et al., "Case Studies of the Bending Vibration and Whirling Motion of Drill Collars", SPE 18652, Feb. 28-Mar. 3, 1989, pp. 282-290, 1989 SPE/IADC Drilling Conf., New Orleans, LA.
Viguie, R. et al., "Using Targeted Energy Transfer to Stabilize Drill-String Systems", 2007, 12 pages, www.dct.tue.nl\New\Wouw\IMAC2007_Viguie.

(56) References Cited

OTHER PUBLICATIONS

Warren, T.M. et al., "Torsional Resonance of Drill Collars with PDC Bits in Hard Rock", SPE 49204, Sep. 27-30, 1998, pp. 625-637, 1998 SPE Annual Technical Conf. & Exh., New Orleans, LA.
Warren, T.M. et al., "Simultaneous Drilling and Reaming with Fixed Blade Reamers", SPE 30474, Oct. 22-25, 1995, pp. 251-261, SPE Annual Technical Conf. & Exh., Dallas, TX.
Warren, T.M. et al., "Development of a Whirl-Resistant Bit", SPE 19572, Oct. 8-11, 1989, pp. 267-274, 1989 SPE Annual Tech. Conf. & Exh., San Antonio, TX.
Williams, J.B. et al., "An Analysis of Predicted Wellbore Trajectory Using a Three-Dimensional Model of a Bottomhole Assembly with Bent Sub, Bent Housing, and Eccentric Contact Capabilities", SPE 19545, Oct. 8-11, 1990, pp. 273-285, 64$^{th}$ Annual Technical Conf. and Exh. of the Society of Petroleum Engineers, San Antonio, TX.
Wolf, S.F. et al.,"Field Measurements of Downhole Drillstring Vibrations", SPE 14330, Sep. 22-25, 1985, pp. 1-12, 60$^{th}$ Annual Technical Conf. and Exh. of the Society of Petroleum Engineers, Las Vegas, NV.
Worford, S.W. et al., "Shock Absorbers—Are They Necessary?", SPE 11406, Feb. 20-23, 1983, pp. 383-387 & Appendix, IADC/SPE 1983 Drilling Conf., New Orleans, LA.
Yigit, A.S. et al., "Mode Localization May Explain Some of BHA Failures", SPE 39267, Nov. 23-25, 1997, pp. 187-196, 1997 SPE/IADC Middle East Drilling Technology Conf., Bahrain.
Yigit, A.S., et al., "Stick-Slip and Bit-Bounce Interaction of Oil-Well Drillstrings", Dec. 2006, pp. 268-27, vol. 128, Transactions of the ASME.
Zambudio, C.A. et al., "Effect of Shock Absorber on Drag Bit Chatter", SPE 17194, Feb. 28-Mar. 2, 1988, pp. 153-160, 1988 IADC/SPE Drilling Conf., Dallas, TX.
Zamudio, C.A. et al., "Self-Excited Vibrations in Drillstrings", SPE 16661, Sep. 27-30, 1987, pp. 117-124, 62$^{nd}$ Annual Technical Conf. and Exh. of the Society of Petroleum Engineers, Dallas, TX.

* cited by examiner

METHODS AND SYSTEMS FOR MITIGATING DRILLING VIBRATIONS

CROSS REFERENCE TO RELATED APPLICATIONS

This application is the National Stage of International Application No. PCT/US2009/045497, filed 28 May 2009, which claims the benefit of U.S. Provisional Application No. 61/132,255, filed 17 Jun. 2008, and 61/174,531, filed 1 May 2009, which are incorporated herein by reference in their entirety for all purposes.

FIELD

The present disclosure relates generally to the field of mitigating drilling vibrations to improve rate of penetration during a drilling operation and/or to extend the usable life of the drill tool assembly components. More particularly, the present disclosure relates to methods and systems to increase overall drilling performance by mitigating vibrational dysfunction associated with torsional and/or axial drill tool assembly vibrations.

BACKGROUND

This section is intended to introduce the reader to various aspects of art, which may be associated with embodiments of the present invention. This discussion is believed to be helpful in providing the reader with information to facilitate a better understanding of particular techniques of the present invention. Accordingly, it should be understood that these statements are to be read in this light, and not necessarily as admissions of prior art.

Drill tool assembly vibration is one of the primary Rate of Penetration (ROP) limiters encountered during drilling operations. Drill tool assemblies vibrate during drilling for a variety of reasons, each of which may be said to be related to a drilling parameter. For example, the rotary speed, weight on bit, mud viscosity, etc. each may affect the vibrational tendency of a given drill tool assembly during a drilling operation. Additionally or alternatively, the configuration of the drill tool assembly may influence the vibrational tendency of a drilling operation. Other factors beyond the control of the operators, such as the condition of the formation, may also influence the vibrational tendency of a drill tool assembly. As used herein, drilling parameters includes characteristics and/or features of both the drilling hardware (e.g., drill tool assembly) and the drilling operations.

The particular design of the drill tool assembly, in terms of the choice of drill tool assembly components and their relative placement with respect to each other, is known to have significant impact on the vibrations encountered during drilling. As used herein, drill tool assembly refers to assemblies of components used in drilling operations. Exemplary components that may collectively or individually be considered a drill tool assembly include rock cutting devices, bits, bottom hole assemblies, drill collars, drill pipes, drill strings, couplings, stabilizers, etc. Conventional efforts to determine the vibration-related performance of a particular drill tool assembly configuration under the specific, realistic conditions of a drilling operation required deploying the design or resorting to sophisticated and computationally intensive models that require a large amount of time, computing power, and detailed input information that is usually not available. Deployment of vibrationally poor designs can result in loss of ROP, shortened drill tool assembly life, increased number of required trips, increased failure rate of downhole tools, and increased non-productive time. The cost of failures can vary from a few hundred thousand dollars to several millions of dollars depending on whether a round-trip of drill tool assembly is required or if there is a need to fish components stuck in the hole. Thus, it is desirable to provide the drilling engineer with a tool utilizing readily available data that can quickly analyze the vibrational tendencies of one or more considered drill tool assembly designs.

As described above, drilling parameters that may affect drilling vibrations include drilling operating conditions. Ranges and constraints on drilling operating conditions vary from one bit run to the next, so there is a need to study the effects of these changes on vibrational performance in an easy to use model. Several vibrational modes can affect the drilling performance; efforts to study each of these modes has to be posed and analyzed in a tractable manner. One approach to mitigate lateral drilling vibrations was presented in pending International Patent Publication No. WO2008/097303, which is incorporated herein by reference in its entirety for all purposes. That application presented methods for analyzing or evaluating alternative bottom hole assembly designs to determine the response of the alternative BHA systems under identical loading conditions. More specifically, WO2008/097303 discloses tools to evaluate the lateral vibration (whirl) tendency of BHA designs through the use of at least one vibration index. The models utilized by the tools are based on the forced harmonic response of the BHA to excitations at the bit, driven by the rotation rate (RPM) of the BHA and its harmonics. While these tools and associated models are effective at modeling and studying whirl vibrations, they only analyze lateral vibrations in the BHA. Other modes of vibration, such as axial and torsional vibrations, are influenced by the drill string in addition to the BHA. Due to the greater complexity of the entire drill tool assembly (e.g., the drill string and the BHA) and the nature of the interactions between the drill tool assembly and the wellbore, there is a need to develop tools, suitable models, and vibration indices for axial and torsional vibrations encountered by a drill tool assembly during operation.

Typically, severe axial vibration dysfunction can be manifested as "bit bounce," which results in a lessening or even a complete loss of contact between the rock formation and the drill bit cutting surface through part of the vibration cycle. Dysfunctional axial vibration can occur at other locations in the drill tool assembly. Other cutting elements in the drill tool assembly could also experience a similar effect. Small oscillations in weight on bit (WOB) can result in drilling inefficiencies, leading to decreased ROP. Thus, there is a need to minimize the response of the drill tool assembly to axial excitations.

The primary torsional dysfunction is called "stick-slip", which is primarily associated with instability in the rotation rate of the drill bit around its nominal value. Other types of torsional dysfunctions exist, including large forced oscillations that could cause fluctuations in the RPM.

Multiple efforts have been made to study and/or model these more complex torsional and axial vibrations, some of which are discussed here to help illustrate the advances made by the technologies of the present disclosure. For example, "Drill String Vibrations due to Intermittent Contact of Bit Teeth," P. R. Paslay, 1962, Transactions of the ASME Paper No. 62-Pet-13 presents early work in the area of axial and torsional vibrations. This paper presents an analytical solution to the axial vibration problem. The model considers the entire drill tool assembly (from the bit to the kelly). The boundary condition at the kelly is treated as a fixed condition.

The drill tool assembly is broken up into two sections: drill collars and drill pipe. An axial displacement excitation is specified at the bit. Forced frequency response is utilized to determine the steady state harmonic axial force that is generated at the bit due to the specified displacement excitation. The natural frequencies of the system are calculated analytically.

Other early work included "Longitudinal and Angular Drill-String Vibrations with Damping," D. W. Dareing, Petroleum Mechanical Engineering and First Pressure Vessel and Piping Conference, Dallas, Tex., Sep. 22-25, 1968. The authors presented a mathematical model for studying axial and torsional vibration of drill tool assemblies. The entire drill tool assembly is modeled using wave equations based upon bar theory. A spring and mass are used to model the surface equipment. The equations are solved analytically, and the model allows for changes in pipe diameters.

DEA Project 29 was a multi-partner program initiated to develop modeling tools for analyzing drill tool assembly vibrations. In the research work, a transfer matrix was used to solve for the surface conditions, for a given initial displacement or initial force at the bit. The model of the drill tool assembly was composed of tubular elements. The program focused on the development of an impedance-based, frequency-dependent, mass-spring-dashpot model using a transfer function methodology for modeling axial and torsional vibrations. These transfer functions describe the ratio of the surface state to the input condition at the bit. The boundary conditions for axial vibrations consisted of a spring, a damper at the top of the drill tool assembly (to represent the rig) and a "simple" axial excitation at the bit (either a force or displacement). For torsional vibrations, the bit was modeled as a free end (no stiffness between the bit and the rock) with damping. The authors also commented on the effect of damping and included it in the model in the form of a constant selected to approximate the damping effect. The DEA Project 29 reports disclosed that the coupling between mud pressure fluctuation and drill pipe vibration should not be ignored. This work also indicated that downhole phenomena such as bit bounce and stick-slip are observable from the surface. While the DEA Project 29 recognized that various factors affect vibrational performance, the results of the research (i.e., models developed through the research) represented these factors simply by including one or more constants into the model. For example, the mud damping effect was represented in the models by a constant approximating the effect on vibration. Results of this effort were published as "Coupled Axial, Bending and Torsional Vibration of Rotating Drill Strings", DEA Project 29, Phase III Report, J. K. Vandiver, Massachusetts Institute of Technology and "The Effect of Surface and Downhole Boundary Conditions on the Vibration of Drill strings," F. Clayer et al, SPE 20447, 1990.

While the frequency-domain approaches that have been developed tend to be computationally tractable, the tractability derives from the almost singular focus on the primary factors affecting vibration, such as the weight on bit and the length of the drill string, and the use of approximating constants to represent the multitude of other factors that affect the severity and mode of vibration. While such approximations may be suitable in simple wells or in perfect wells, the application of such approximations and models to real-world wells is limited. For example, while the total impact of borehole damping effects and mud damping effects on vibrations may be small relative to the weight on bit, poor approximations of their affects can lead to significant changes in drilling efficiencies.

Moreover, the impact of these damping effects is difficult to approximate in transitioning from a model to an actual well, rendering the use of an approximation constant suitable in only the most limited of actual drilling operations. Consider, for example, a drilling operation that includes deviations in the well trajectory, such as to provide doglegs or directional drilling. In simple vertical wells, the drill tool assembly has contact points at the bit and at the rig (i.e., effectively no borehole damping effects). In more complex trajectories, or in more realistic representations of an actual wellbore, the drill tool assembly may contact the borehole at numerous locations along its length; the contact locations and characteristics may vary over time. These additional and varied contacts result in a distribution of additional forces exerted on the drill tool assembly along the well and over time. A model that fails to incorporate the effects of borehole damping will result in inaccurate vibration predictions leading to poor drill tool assembly design and/or inefficient drilling operations.

With the advent of more powerful computer systems, various attempts have been made to develop large scale, time-domain models of entire drill tool assemblies in complex wellbore trajectories, using finite element methods to resolve complex interactions between the various drill tool assembly elements, the drill bit, and the rock formation that is being drilled. Such methods have been disclosed in SPE 52821 and other publications, including U.S. Pat. Nos. 6,785,641 and 7,139,689. While powerful, such methods require a level of detail about the condition and trajectory of the borehole, rock properties, and bottom hole pattern, that are still very difficult and costly to obtain, if at all possible. They are also too computationally intensive to allow a rapid screening of various drilling scenarios for multiple drill tool assembly designs. Furthermore, the outputs of these models are complex and difficult to interpret.

Additionally, "The Genesis of Bit-Induced Torsional Drill-string Vibrations," J. F. Brett, SPE 21943, 1992 describes a time-domain torsional vibration model that is described using two coupled differential equations. One equation described the stiff BHA attached to the drill pipe and the second equation described the upper end of the drill tool assembly, or surface drive system. The model was then solved using a Runge-Kutta simulation algorithm. Experimental friction curves relating the torque on bit as a function of the bit RPM were obtained for a sharp and a dull PDC bit. The experimental observations suggested that the torque on bit (i.e., stick-slip tendency) was proportional to the weight on bit for all observed bit speeds. These models and methods were implemented in the time-domain, requiring the computational intensity associated therewith.

While technologies related to torsional and axial vibration modeling have evolved, these technologies are still significantly limited by virtue of the assumptions and conditions used. As seen in the above discussion, the frequency-domain models previously developed have failed to account for complex relationships between the multiple segments of the drill tool assembly and the wellbore wall. Moreover, the finite-element based time-domain methods suffer from high computational complexity and cost, making them unsuitable for use as a routine analysis tool to evaluate large numbers of drilling scenarios in an efficient manner. Furthermore, the damping models used in these time- and frequency-domain methods are inadequate, omitting or oversimplifying the mud-drill tool assembly interactions. Accordingly, the need exists for systems and methods for mitigating drill tool assembly vibrations that utilizes the tractability and computational efficiency of frequency-domain models, but also allows consideration of more realistic drilling conditions such as complex wellbore trajectories (with or without dog-legs), mud damping effects, velocity dependence of frictional forces, and complex boundary conditions at the surface and bit end. Additionally or alternatively, the need exists for systems and methods of evaluating two or more drill tool assembly configuration designs, for a given set of operating conditions, to determine which configuration design will experience the least torsional and/or axial vibrational dysfunction. Additionally or alternatively, the need exists for systems and methods to evaluate a given drill tool assembly configuration design to determine or predict operating conditions likely to result in lateral, axial, and/or torsional vibration, or alternatively, to result in minimizing lateral, axial, and/or torsional vibration.

Other related material may be found in at least U.S. Pat. No. 5,313,829; and in U.S. Patent Publication No. US 2007/0289778. Further, additional information may also be found in "Drillstring Torsional Vibrations: Comparison between Theory and Experiment on a Full-Scale Research Drilling Rig," G. W. Halsey et al, SPE 15564, 1986; "A Study of Slip/Stick Motion at the Bit," A. Kyllingstad and G. W. Halsey, SPEDE, December 1988, pp. 369-373; "Drillstring Stick-Slip Oscillations," R. Dawson et al, 1987 SEM Spring Conference, Houston, Jun. 14-19, 1987; "Detection and Monitoring of the Slip-Stick Motion: Field Experiments," M-P. Dufeyte and H. Henneuse, SPE/IADC 21945, 1991; "A Study of Excitation Mechanisms and Resonances Inducing Bottomhole-Assembly Vibrations", A. Besaisow and M. Payne, SPE 15560, 1988; "Cost Savings through an Integrated Approach to Drillstring Vibration Control", P. C. Kriesels, and W. J. G. Keultjes, SPE/IADC 57555, 1999; "Suppressing Stick-slip-induced Drillstring Oscillations: A Hyperstability Approach," Van den Steen, L., 1997, PhD Thesis, University of Twente, The Netherlands; "H-∞ Control as Applied to Torsional Drillstring Dynamics," Serrarens, A. F. A., 1997, MSc Thesis, Eindhoven University of Technology, The Netherlands; "On the Effective Control of Torsional Vibrations in Drilling Systems," Tucker, R. W., and Wang, C., 1999, Journal of Sound and Vibration; Application of Neural Networks for Predictive Control in Drilling Dynamics", D. Dashevshiy et al., SPE 56442, 1999; "Development of a Surface Drillstring Vibration Measurement System", A. A. Besaisow, et al., SPE 14327, 1985; "Torsional Resonance of Drill Collars with PDC Bits in Hard Rock," Warren, SPE 49204, 1998; "Stick-slip Whirl Interaction in Drillstring Dynamics," R. I. Leine, et al, Journal of Vibration and Acoustics, April 2002, Vol. 124, pp. 209-220; "Analysis of the Stick-slip Phenomenon Using Downhole Drillstring Rotation Data," Robnett, E. W., Hood, J. A., Heisig, G., and Macpherson, J. D., SPE/IADC 52821; "The Effects of Quasi-Random Drill Bit Vibrations Upon Drillstring Dynamic Behavior," Skaugen, E., 1987, SPE 16660; "An Analytical Study of Drill String Vibrations," Li, C., 1987, SPE 15975; "Mathematical Analysis of the Effect of a Shock Sub on the Longitudinal Vibrations of an Oilwell Drill String," Kreisle, L. F., and Vance, J. M., 1970, SPE 2778; "Downhole Vibration Monitoring & Control System Quarterly Technical Report #2," M. E. Cobern, et al, 2003, DOE Award Number: DE-FC26-02NT41664, APS Technology Inc.; and "Application of High Sampling Rate Downhole Measurements for Analysis and Cure of Stick-Slip in Drilling," D. R. Pavone and J. P. Desplans, 1994, SPE 28324.

SUMMARY

The present disclosure provides systems and methods for mitigating drill tool assembly vibrations that may occur during drilling operations. The methods may be conducted as part of design and planning operations and/or as part of ongoing drilling operations. Exemplary, non-limiting systems and methods are summarized here by way of introduction. Exemplary methods of mitigating drill tool assembly vibrations include: 1) obtaining data regarding a plurality of drilling parameters related to one or more drilling operations; 2) utilizing one or more frequency-domain models to transform the obtained drilling parameter data into one or more vibrational indices characterizing an excitation response of at least one drill tool assembly; 3) utilizing one or more vibrational indices to identify at least one drilling parameter change to mitigate drill tool assembly vibrations; and 4) adjusting one or more drilling parameters based at least in part on at least one of the one or more vibrational indices and the identified at least one drilling parameter change. In these methods, one or more of the frequency-domain models are adapted to include at least one velocity-dependent damping relationship. The data obtained may include data regarding drill tool assembly configurations and design options. Additionally or alternatively, the obtained data may include drilling operations parameters, such as ranges of suitable drilling operating conditions.

As indicated, the presently described methods may be adapted for use in designing a drill tool assembly for use in a drilling operation. Exemplary methods of designing a drill tool assembly may include: 1) obtaining drilling operations parameters regarding a drilling operation; 2) obtaining drill tool assembly data regarding one or more potential drill tool assembly designs; 3) utilizing one or more frequency-domain models to transform the obtained drilling operations parameters and the obtained drill tool assembly data into one or more vibrational indices characterizing an excitation response of at least one potential drill tool assembly design; 4) utilizing the one or more vibrational indices to evaluate the suitability of the one or more potential drill tool assembly designs for the drilling operation; and 5) selecting a preferred drill tool assembly design based at least in part on the one or more vibrational indices of the one or more potential drill tool assembly designs. Here again, one or more of the frequency-domain models are adapted to include at least one velocity-dependent damping relationship.

Continuing with the description of the methods disclosed herein, the methods may be adapted for use in planning and/or conducting drilling operations. Exemplary methods of drilling a wellbore may include: 1) obtaining drilling operations parameters regarding a drilling operation; 2) obtaining drill tool assembly data regarding a drill tool assembly design to be used in the drilling operation; 3) utilizing one or more frequency-domain models to transform the obtained drilling operations parameters and the obtained drill tool assembly data into one or more vibrational indices characterizing an excitation response of the drill tool assembly design under a range of available drilling operating conditions; 4) determining preferred drilling operating conditions to mitigate vibrations based at least in part on one or more of the vibrational indices; 5) drilling a wellbore using the drill tool assembly while monitoring drilling operating conditions; and 6) adjusting drilling operations to maintain drilling operating conditions at least substantially within a range of the preferred drilling operating conditions. As discussed above one or more of the frequency-domain models are adapted to include at least one velocity-dependent damping relationship.

The present disclosure further provides a drill tool assembly for use in a drilling operation. The drill tool assembly includes at least one downhole component. The at least one downhole component is selected to provide the drill tool assembly with a preferred vibrational index. The vibrational index characterizes an excitation response of the at least one tubular member based at least in part on drilling operations parameters and drill tool assembly data. The drill tool assembly's vibrational index is determined using one or more frequency-domain models. One or more of the frequency-domain models includes a velocity-dependent damping relationship.

BRIEF DESCRIPTION OF THE DRAWINGS

The foregoing and other advantages of the present technique may become apparent upon reading the following detailed description and upon reference to the drawings in which.

DETAILED DESCRIPTION

Figure 1:
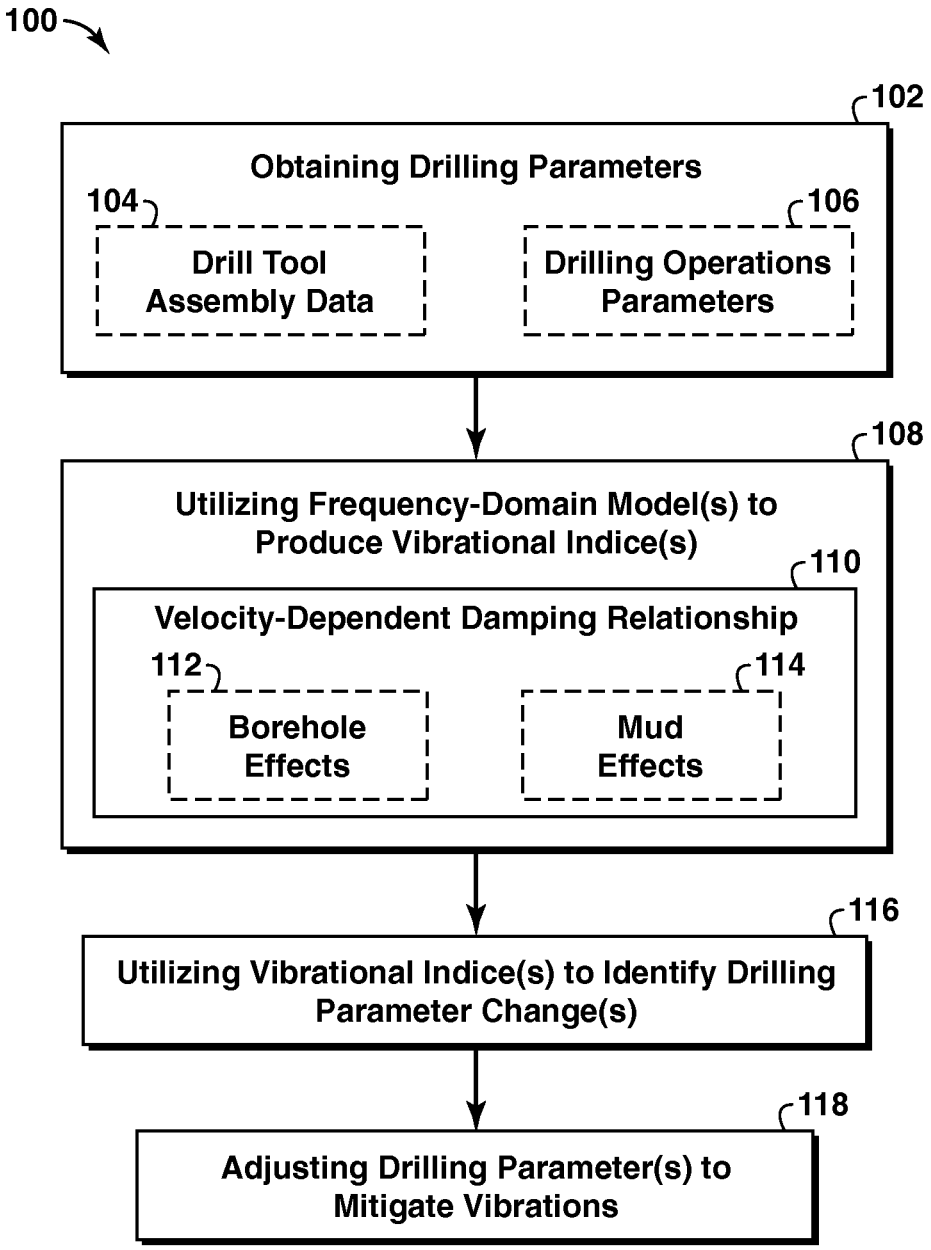
FIG. 1 is a flow chart of methods within the scope of the present disclosure.

In the following detailed description, specific aspects and features of the present invention are described in connection with several embodiments. However, to the extent that the following description is specific to a particular embodiment or a particular use of the present techniques, it is intended to be illustrative only and merely provides a concise description of exemplary embodiments. Moreover, in the event that a particular aspect or feature is described in connection with a particular embodiment, such aspects and features may be found and/or implemented with other embodiments of the present invention where appropriate. Accordingly, the invention is not limited to the specific embodiments described below, but rather, the invention includes all alternatives, modifications, and equivalents falling within the scope of the appended numbered paragraphs.

Useful information about the vibrational characteristics of a drill tool assembly design under particular operating conditions can be obtained through frequency-domain modeling of the drill tool assembly response to excitations. The present frequency-domain modeling approaches are adapted to be more robust than conventional methods by incorporating one or more additional factors that affect vibrations of the drill tool assembly into the frequency-domain model, where these additional factors are incorporated as functions of other parameters or conditions rather than as mere constants within the frequency domain. For example, the borehole damping effects and the mud damping effects are incorporated as linear response functions dependent on one or more drilling parameters. The tractability and computational simplicity of the present methods are preserved through the use of a robust base model used to determine a baseline solution, or a baseline condition of the drill tool assembly in which no vibration is present. Linear response functions are also developed based on the base model. The linearization of the motion around the baseline solution allows independent linear harmonic analysis of the eigenstates at each vibration frequency and the use of superposition to analyze the overall dynamic motion.

While baseline solutions and linear response functions are not unknown to persons skilled in the art, the selection of specific inputs and outputs into the base model, as well as the selection of boundary conditions, can dramatically affect the reliability and accuracy of the baseline solution as well as the linear response functions, calculations, and indices based thereon. For example, base models for axial and torsional vibration modes can be developed by considering any number of physical interactions and relationships during the drilling operations. However, a model that oversimplifies the interactions and relationships will not yield accurate and/or reliable results. The base models presented herein utilize models of the drill tool assembly that provide a more robust and reliable model, which requires and/or enables systems, methods, and results different than those previously known or available to those of skill in the art.

The technology of the present disclosure develops and utilizes vibration indices as proxies for the overall vibrational performance of a drill tool assembly. The vibration indices are derived from the baseline solution, the frequency eigenstates, and the linear response functions generated from the base model. The vibration indices characterize the excitation response of a drill tool assembly and are determined using one or more frequency-domain models. Various drilling parameters may be inputs into the frequency-domain models, depending on the index being determined and the models being used. Drilling parameters that may be used as inputs include data regarding the drill tool assembly itself, such as assembly configuration options, and data regarding drilling operations, such as drilling operations parameters or drilling operating conditions. As described above, a drill tool assembly may include a variety of component parts arranged in a variety of manners, which present numerous configuration options. The drill tool assembly data that may be used as inputs may be data regarding an existing drill tool assembly, whether before or after use in a drilling operation, and/or data regarding one or more proposed drill tool assembly designs that may be selected for use in drilling operations. The data regarding drilling operations may include specific data regarding operating conditions ("drilling operating conditions") and/or may include drilling operations parameters, which are ranges of available conditions for one or more drilling operational variable, such as weight on bit, RPM, etc. An operational variable is an operational element over which an operator has some control. The methods and systems of the present disclosure may obtain input data, such as for use in the frequency-domain models, from a drilling plan. As used herein, drilling plan refers to the collection of data regarding the equipment and methods to be used in a drilling operation or in a particular stage of a drilling operation. Similarly, use of the present systems and methods may assist in developing a drilling plan for a drilling operation or a stage of a drilling operation.

In general, a vibration index is associated with a particular set of drilling parameters, and can be any quantity that is computed from one or more of the associated baseline state, the frequency eigenstates, and the linear response functions. The functional relationship for a given index is chosen such that the computed index corresponds to at least one aspect of the vibrational tendency of the drill tool assembly for those operating conditions. Examples of representative vibration indices are described in greater detail below.

As described above, the technologies of the present disclosure enable robust modeling of drill tool assembly vibrational responses to excitations. The modeling is considered more robust because it is adapted to more thoroughly or explicitly incorporate factors previously ignored or represented by mere constants while maintaining tractability and computational efficiency. Exemplary factors that may be incorporated into the present frequency-domain models include velocity-dependent damping relationships, complex borehole trajectory effects, and tool joint effects. In some implementations, the vibration-related factors may be incorporated into the frequency-domain models by way of one or more linear response functions, which in some implementations may be incorporated as a piece-wise wave propagator.

FIG. 1 provides an exemplary flow chart of methods within the scope of the present technologies. More specifically, FIG. 1 provides an example of methods, referenced generally as methods 100, for mitigating vibrations of a drill tool assembly using one or more vibration indices. The methods may be conducted before a drilling operation to predict vibration performance and to inform the drill tool assembly design and/or the planning of drilling operations. Additionally or alternatively, the methods may be conducted during drilling operations to determine an index of vibration performance and to aid in mitigating the vibrations during the drilling operations.

The methods of mitigating vibrations 100 begin, as illustrated, by obtaining drilling parameters, at box 102. As described above, the drilling parameters obtained may include drill tool assembly data 104 and/or drilling operations parameters 106. The data collected or obtained while obtaining drilling parameters may depend on the context in which the present systems and methods are being used. For example, in a design environment, the obtained drilling parameters may include details about one or more drill tool assembly designs or drill tool assemblies that are proposed for use in a drilling operation. Similarly, the obtained drilling parameters may include drilling operations parameters related to a plurality of proposed drilling plans, which may include a plurality of drilling plans for each of a plurality of proposed drill tool assemblies. Alternatively, in the context of ongoing field operations, the obtained drilling parameters may be limited to drill tool assembly data 104 regarding a narrow selection of drill tool assemblies and/or a narrow set of drilling operations parameters, such as may be constrained by equipment on-site. Moreover, in the context of ongoing field operations, the obtained drilling parameters 102 may include measured or monitored data regarding the ongoing drilling operations. As will be seen herein, the various types of drilling parameters may be used as inputs in differing manners in the systems and methods described herein.

FIG. 1 further illustrates that the present methods include utilizing one or more frequency-domain models to produce one or more vibrational indices, at box 108. More specifically, the frequency-domain models of the present systems and methods are adapted to transform the obtained drilling parameter data into one or more vibrational indices, which indices characterize an excitation response of at least one drill tool assembly. Accordingly, the frequency-domain models utilize drilling parameter data regarding a plurality of physical objects and activities and transform the drilling parameter data into vibrational indices representative of and characterizing other physical events, particularly, the response of a drill tool assembly to excitations. Examples of suitable frequency-domain models are described in greater detail below, together with exemplary equations, matrices, etc. Moreover, exemplary vibration indices are described in greater detail below.

A drill tool assembly may respond to excitations in a variety of manners, depending on the type of excitation applied to the drill tool assembly. The systems and methods of the present disclosure are directed primarily to torsional and/or axial vibrations in response to excitations, but may be extended to other forms of vibrations, such as lateral vibrations. The present disclosure provides examples of vibrational indices that are best suited for vibrations that are primarily axial vibrations and of vibrational indices that are best suited for vibrations that are primarily torsional vibrations. Additionally, the present disclosure provides examples of methods for combining two or more indices together, such as may be used to characterize excitation responses that cannot be characterized as primarily torsional or axial. It is understood that drill tool assembly vibrations will rarely be limited to a single mode of vibration. Accordingly, a user may elect to use a vibrational index adapted for an excitation response that is primarily axial vibration (or torsional vibration) when the drilling parameters suggest that one or the other will be controlling or of greater significance. Additionally or alternatively, the user may elect to utilize multiple vibrational indices simultaneously or to combine the indices into a composite index. For example, multiple vibrational indices may be displayed graphically, such as by overlaying the indices. Additionally or alternatively, a composite index may be developed mathematically, as described in greater detail below.

As illustrated in FIG. 1, implementations of the present systems and methods include frequency-domain models 106 that incorporate, or that are adapted to include, one or more velocity-dependent damping relationships, at box 110, to functionally incorporate into the frequency-domain models the effect of one or more factors that affect the excitation response of a drill tool assembly during drilling operations. Regardless of the effect or factor being incorporated into the frequency-domain models by way of the velocity-dependent damping relationship, the common theme is that the incorporation of functional dependence on rotary speed of the drill tool assembly allows the present methods and systems to be more robust and more accurate. Moreover, the inclusion of velocity-dependent damping relationships reveals in greater detail the margins of vibrational performance. As will be understood by the more technical description below, factors such as weight on bit, bit configuration, and rotary speed are generally considered dominant in determining vibrational performance, with damping factors recognized but only poorly considered by conventional methods due to the complexity of modeling the relationships and physics involved in the damping factors. The present disclosure provides systems and methods adapted to allow the damping factors to be functionally incorporated into the frequency-domain models. Accordingly, the vibrational performance can be more accurately characterized and the drilling parameters can be adjusted more aggressively to increase both rate of penetration and drill tool assembly life.

FIG. 1 illustrates exemplary effects that may be incorporated into the velocity-dependent damping relationship(s), such as borehole effects 112 and mud effects 114. The borehole, and more particularly the borehole wall, can affect the excitation response of a drill tool assembly in a variety of ways. As one example, the borehole friction effect may dampen the excitation response due to contact between the drill tool assembly and the borehole wall. Similarly, the mud can affect the excitation response by damping the excitation response. Exemplary mud effects may include mud viscosity effects and mud inertia effects. The mud viscosity effect may be understood as the impact of the mud-tool assembly interaction. For example, the drill tool assembly will respond to excitation more dramatically in a less viscous mud. The mud inertia effects may be understood as the resistance of the mud to change direction (if in motion) or position (if at rest). For example, the excitation response and the interaction between the mud and the tool assembly may require at least some of the mud to respond in manner similar to the drill tool assembly. The mud inertia effects may limit the response of the mud thereby damping the excitation response of the drill tool assembly. The impacts of the borehole and the mud on vibrations and on models describing vibrations is described in greater detail below, together with the equations and examples of how such effects are incorporated into the frequency-domain models via the velocity-dependent damping relationship(s). Of note, it has been found that at least two of these damping effects have opposing relationships with velocity. Due to the distinct velocity dependence of each of these effects, some implementations may be benefited by the distinct, functional incorporation of each effect rather than an attempt to lump them together.

As mentioned above, the frequency-domain models incorporating at least one velocity-dependent damping relationship are used to produce at least one vibrational index and may be used in selecting and/or adjusting drilling parameters. Additionally, the one or more frequency-domain models of the present methods may be adapted to incorporate other relationships or effects into the model of the vibrational performance. For example, the frequency-domain model(s) may be adapted to incorporate effects associated with a complex wellbore trajectory, which may be understood to include any trajectory that is not a simple vertical trajectory, such as boreholes having build sections, horizontal sections, slant sections, deviated sections, or other trajectories. Depending on the factors or effects that are incorporated into the frequency-domain model(s), the nature of the obtained drilling parameters may change. For example, the obtained drilling parameters may include data related to planned or existing borehole trajectories. While the borehole trajectory may be relevant in modeling or characterizing a variety of excitation responses, a complex borehole trajectory may have a greater effect on axial vibrations. Accordingly, some implementations of the present methods may be adapted to obtain drilling parameter data related to borehole trajectory, to utilize a frequency-domain model functionally dependent on borehole trajectory, and to produce or generate at least one vibrational index characterizing a dynamic axial response of the drill tool assembly.

As another example of effects that may be incorporated into the frequency-domain model(s) of the present methods, one or more frequency-domain models may be adapted to incorporate tool joint effects, which in summary is the effect of the drill tool assembly having a non-uniform cross-section. The tool joint effect is described in greater detail below together with methods of incorporating the tool joint effect into the frequency-domain model.

As described above, the frequency-domain model(s) are utilized to generate one or more vibrational indices. In some implementations, as will be better understood from the examples provided below, the vibrational indices may be based at least in part on the frequency-domain models, such as being calculated using the solutions to the frequency-domain models alone or together with additional data. As one example, the vibrational index may be functionally dependent on one or more drilling parameters. Exemplary drilling parameters on which one or more vibrational indices may be depend include bit depth, rotary speed (of the drill bit and/or the drill tool assembly), mud pump speed, mud viscosity, weight on bit, mud flow rate, rate of penetration, mechanical specific energy, etc. The manner in which the vibrational index depends on one or more of these drilling parameters will depend on the nature of the vibrational index and the type of excitation response being characterized. As will be understood from the more technical description of specific examples below, various relationships may be used to calculate a vibrational index depending on the physics believed to contribute to the vibration. With reference to the exemplary vibrational indices described herein, additional and/or alternative vibrational indices may be developed and used having functional dependence on the same or different drilling parameters.

The systems and methods described herein are directed to mitigating vibrations in drill tool assemblies by utilizing one or more vibrational indices. As described herein, the indices may be developed on an absolute basis or for use in comparing distinct sets of drilling parameters. As one example of an absolute basis, some implementations may specifically consider the vibrational indices of drill tool assembly(ies) under conditions operating at its resonance frequency.

As illustrated in FIG. 1, the methods of the present disclosure include utilizing the vibrational indice(s) to identify at least one drilling parameter change that could be implemented to mitigate drill tool assembly vibrations, at box 116. As will be described in greater detail below, the present systems and methods encompass the development and utilization of multiple vibrational indices. The manner in which the one or more vibrational indices are utilized may vary depending on the nature of the vibrational indices. For example, some of the vibrational indices described herein are best presented graphically whereas others may be amenable to numerical representation. In some implementations, the vibrational indices may be calculated across a range of values for one or more drilling parameters and the utilization of the parameters may comprise identifying the combination of parameter values that results in the lowest vibrations, in the highest rate of penetration, or in optimizing some other objective. For most implementations, the objective in utilizing the vibrational indices will be to minimize vibrations by identifying preferred drilling parameters within a range of suitable drilling parameters. While multiple indices and drilling parameters may be considered, some implementations may comprise utilization of a single vibrational index and the identification of a drilling parameter change may comprise merely identifying the drilling parameter condition corresponding to the lowest (or highest) vibrational index value.

Finally, FIG. 1 further illustrates that the methods of mitigating vibrations 100 include adjusting one or more drilling parameters based at least in part on at least one of the one or more vibrational indices and the identified at least one drilling parameter change, at box 118. The methods described herein include performing or accomplishing some change in one or more drilling parameters, such as an operating condition or a drill tool assembly configuration option, to mitigate drill tool assembly vibration. Accordingly, it can be seen that the present method includes obtaining data regarding physical conditions, transforming that data to represent physical activities, specifically vibrations, and utilizing the transformed data to change physical conditions, specifically one or more drilling parameters, to alter and improve the physical activities.

Depending on the environment in which the present systems and methods are utilized, the adjustment of the at least one drilling parameter may be based on the vibrational indice(s) and/or on the determined or identified drilling parameter change. For example, in a field operation, the identified change may be displayed for an operator with or without the underlying vibrational index used to determine the change. Regardless of whether the vibrational index is displayed to the operator in the field, the determined change may also be presented and the operator may act to adjust drilling conditions based solely on the displayed change. Additionally or alternatively, an operator or other person in the field may consider both the vibrational indices and the identified drilling parameter change. Still additionally, in some implementations, the methods described herein may be applied iteratively by computer systems to evaluate multiple combinations of drill tool assembly configurations and drilling operations parameters. The iterative process may utilize the frequency-domain models to generate a plurality of vibrational indices for combinations of drill tool assemblies and drilling operations parameters. The computer system may be adapted to identify the combination of drill tool assembly configurations and drilling operations parameters and drilling operating conditions that results in the lowest vibrational index or indices. In some implementations, this identification may be displayed or printed for an operator to use in adjusting a drilling parameter. Additionally or alternatively, such as when the identified drilling parameter change is merely a change in operating conditions, the computer system may be adapted to change the drilling parameter without user intervention, such as by adjusting rotary speed, pump motor speed, etc.

Again, depending on the manner or environment in which the present systems and methods are used, the manner of adjusting the drilling parameter may change. When used to design drill tool assemblies and/or to develop drilling plans, the adjustment may be implemented by selecting an appropriate drill tool assembly and/or by designing a drilling plan to provide the identified drilling operating conditions. When the present systems and methods are used in the field, such as during ongoing drilling operations, the adjustment may be limited to adjustment of drilling operating conditions in substantially real time, such as by changing one or more of: the rotary speed, the mud pump speed, the mud viscosity, the mud flow rate, the weight on bit, etc. Additionally or alternatively, the adjustment may comprise developing plans for an upcoming stage of an ongoing drilling operation, which may be more like the design phase described previously. Drilling a wellbore often includes utilizing multiple drilling stages and each stage can be conducted somewhat differently, such as by changing bits, weight on bit, drilling mud properties, etc. The present methods and systems may be implemented in a manner to adjust one or more drilling parameters during a drilling operation, but not necessarily in substantially real-time.

While not expressly illustrated in FIG. 1, it is understood that the methods described there may be extended by drilling a wellbore and collecting data regarding drilling operating conditions while drilling. Moreover, it will be understood that the methods described in connection with FIG. 1 may be extended by drilling a wellbore for use in hydrocarbon production operations, such as operations related to the production of hydrocarbons through the wellbore (e.g., production and/or injection), or in other applications, such as geothermal applications, water injection applications, waste injection applications, and/or carbon sequestration operations.

Figure 2:
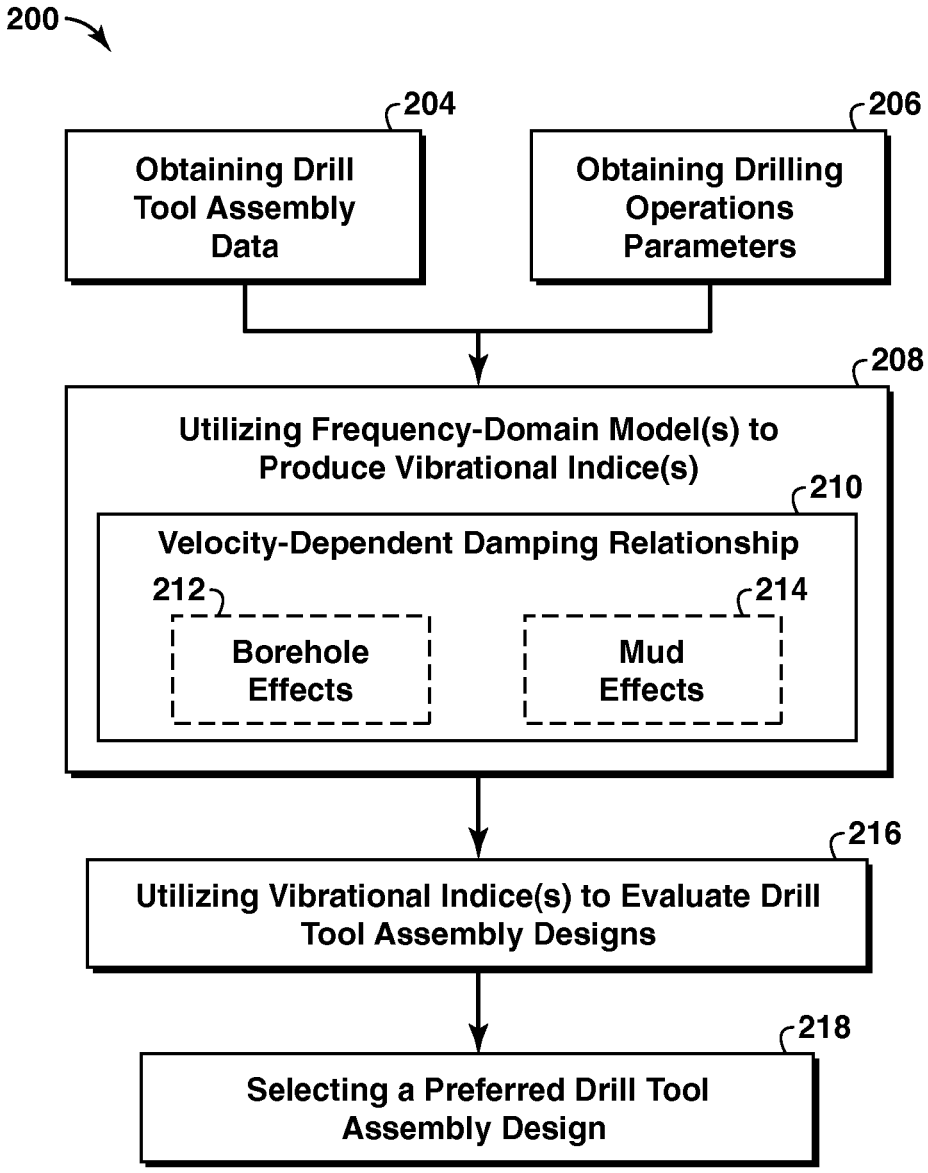
FIG. 2 is a flow chart of methods within the scope of the present disclosure.

FIG. 2 presents another flow chart of methods within the scope of the present disclosure. FIG. 2 provides a flow chart to illustrate methods 200 of selecting a preferred drill tool assembly design. By inspection, the similarities between FIG. 1 and FIG. 2 can be observed. Accordingly, the description above regarding the various elements and components of the methods 100 of FIG. 1 are expressly applied to the methods 200 of FIG. 2. In effect, the flow chart of methods 100 is representative of methods of mitigating vibrations that may be applied at various stages of the exploration and development process, including design and planning stages and the operations stages. The methods 200 of FIG. 2 is a specific application of the methods to the design and planning aspects of the exploration and development process, such as stages where users are able to consider a plurality of drill tool assembly designs and to select components for the drill tool assembly to mitigate the vibrations thereof under expected operating conditions. In the interest of brevity, the complete description above will not be repeated with respect to each step. However, like reference numerals will be used to facilitate the extrapolation of the description above to the flow chart in FIG. 2.

Accordingly, with reference to FIG. 2 and with continuing reference to FIG. 1, methods of designing a drill tool assembly for use in a drill operation are illustrated as methods 200. Initially, the methods 200 of FIG. 2 include obtaining drilling operations parameters at 206 and obtaining drill tool assembly data regarding one or more potential drill tool assemblies, at 204. More specifically, the drilling operations parameters obtained are related to a drilling operation and may be constrained by the specifics of the well, the formation, the reservoir, and/or data about past drilling operations. For example, the range of operating conditions included in the drilling operations parameters may be subject to less variation than in the methods 100 of FIG. 1.

The design methods 200 of FIG. 2 continue in a manner similar to that described above in connection with FIG. 1. Specifically, the methods utilize one or more frequency-domain models to transform the obtained drilling operations parameters and the obtained drill tool assembly data into one or more vibrational indices adapted to characterize an excitation response of at least one drill tool assembly design, at box 208. As described above, the frequency-domain model(s) may include a velocity-dependent damping relationship (box 210), which may incorporate one or more factors that affect the damping relationships, such as mud effects 214 and borehole effects 212, which may be incorporated together with their distinct velocity-dependent relationships. Additionally, the frequency-domain models, the velocity-dependent damping relationships, and the vibrational indices may be as described above in connection with FIG. 1.

FIG. 2 illustrates that the vibrational indices may be utilized to evaluate the suitability of one or more potential drill tool assembly designs for the drilling operation, at box 216. As indicated, the design methods 200 are directed toward designing a drill tool assembly for a given drilling operation, or stage of a drilling operation to the extent that the drill tool assembly configuration can be altered between stages. As suggested by the similar reference numeral, the utilization of the vibrational indices to evaluate drill tool assembly designs is analogous to the step from FIG. 1 of identifying drilling parameter changes to mitigate drilling vibrations. Similarly, the utilization of the vibrational indices to evaluate drill tool assembly designs is adapted to identify a drill tool assembly design expected to mitigate vibrations or to result in a preferred vibrational performance during drilling operations. While the vibrational indices may be calculated on an absolute basis, the comparison between the multiple drill tool assembly designs is conducive to comparative vibrational indices, examples of which are provided below.

FIG. 2 further illustrates that the design methods conclude with selecting a preferred drill tool assembly design at box 218. Selecting a preferred drill tool assembly design is an example of adjusting drilling parameters to mitigate vibrations, as described above. The selection may be based at least in part on the one or more vibrational indices. Other factors that may be considered include the rate of penetration attainable while minimizing vibrations, the costs associated with the efforts to minimize vibrations, etc. As indicated, the methods of designing a drill tool assembly 200 may incorporate any of the additional features and aspects described above in connection with FIG. 1 and may incorporate the technical features, models, equations, indices, etc. described through examples in greater detail below.

As can be understood, the design methods 200 may be implemented before a wellbore is drilled or at any point during a drilling operation, such as prior to an opportunity to change the drill tool assembly design (e.g., prior to replacing a drill bit). Additionally, as can be understood, the methods of designing a drill tool assembly 200 may be extended to include developing a drilling plan utilizing the vibrational indices. For example, the obtained drilling operations parameters may include data regarding ranges of suitable drilling operating conditions. The drilling operations parameters may be used to determine a preferred drill tool assembly design, which may then be used together with the frequency-domain models and/or the vibrational indices to determine drilling operating conditions adapted to mitigate vibrations. The drilling plan may then be developed based at least in part on the identified or determined drilling operating conditions. Other factors that may be considered include cost, risk, etc. In some implementations, the steps of selecting a preferred drill tool assembly design and developing a drilling plan may be implemented iteratively or recursively to optimize the drilling plan and/or the drill tool assembly design.

While the methods of FIG. 2 are directed to designing a drill tool assembly for mitigating vibrations during drilling operations, the present disclosure does not propose any new or unique downhole tools or components. Rather, the present disclosure provides drill tool assemblies, or combinations of downhole tools and components, adapted to mitigate vibrations by virtue of the selection and configuration of the various downhole components that comprise the drill tool assembly. As described above, the drill tool assembly may comprise a plurality of downhole components, including components commonly grouped as the bottom hole assembly, the drill string or segments thereof, the drill collar, the stabilizers, the bit, etc. Due to the number of components that may comprise the drill tool assembly, the number of configurations and configuration options is practically limitless, particularly when considering the various models of each component that are provided by the various suppliers. However, some implementations of the present disclosure includes a drill tool assembly having at least one downhole component selected to provide the drill tool assembly with a preferred vibrational index. The vibrational index may be determined as described above. Additionally, the methods of designing a drill tool assembly described above may be used in identifying the at least one downhole component that is selected to provide the drill tool assembly with a preferred vibrational index. For example, the selected downhole component may be selected from the group consisting of a rock cutting device, a bit, a bottom hole assembly, a drill collar, a drill string segment, a shock sub, a mud motor, and any combination thereof.

Figure 3:
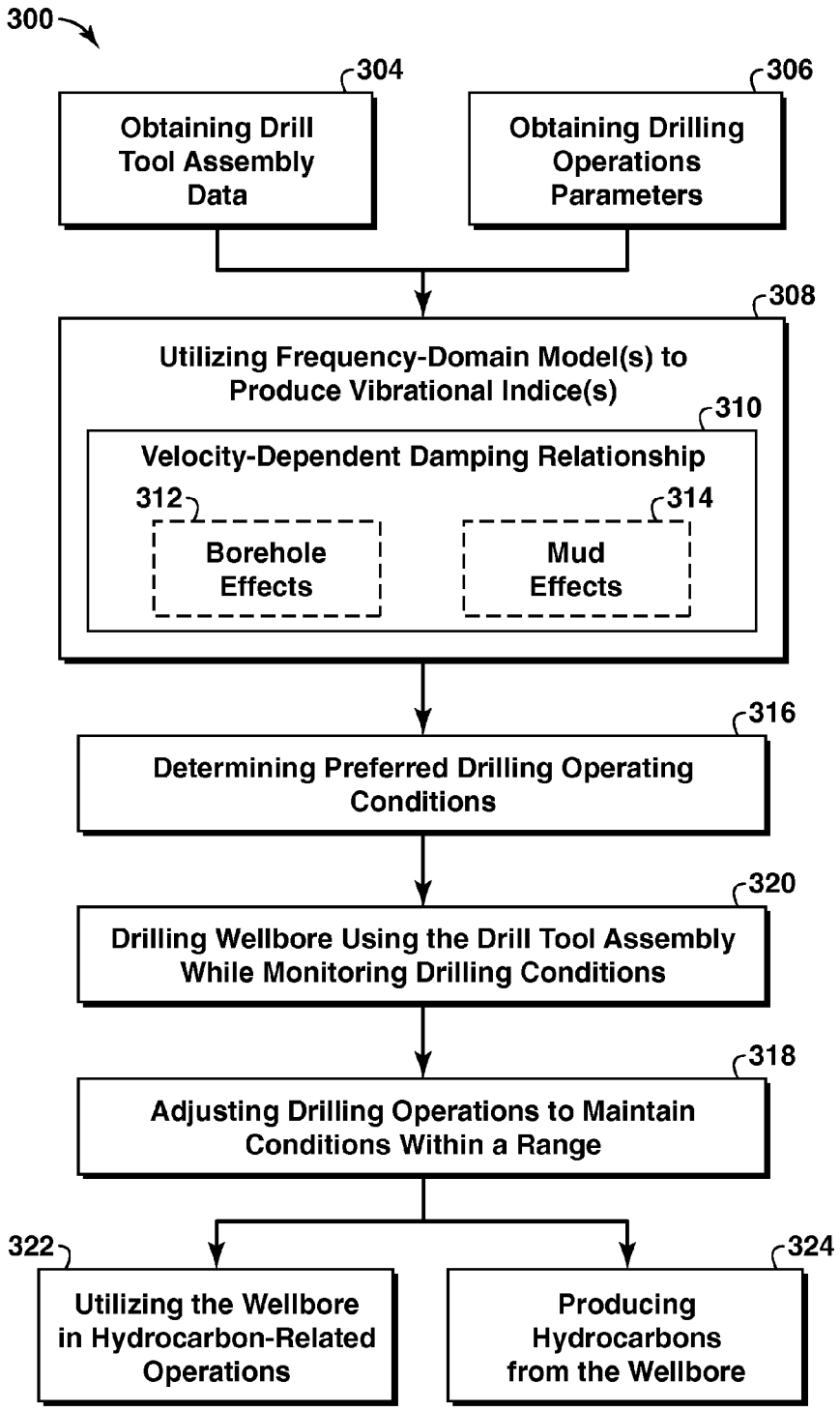
FIG. 3 is a flow chart of methods within the scope of the present disclosure.

As described above in connection with FIG. 1 and FIG. 2, the present systems and methods may be used to mitigate vibrations through adjusting one or more drilling parameters. FIG. 3 provides an exemplary flow chart of such methods adapted for use in designing and/or conducting drilling operations with a given drill tool assembly design, such as may be the case when attempting to mitigate vibrations during an ongoing drilling operation or when other conditions dramatically limit the configuration options for the drill tool assembly. It will be observed that the method of drilling a wellbore 300 of FIG. 3 is similar in many respects to FIGS. 1 and 2 and like reference numerals have been used to refer to similar features or steps. Initially, the drilling methods 300 include obtaining drilling operations parameters regarding a drilling operation at 306 and obtaining drill tool assembly data at 304. As illustrated in FIG. 3, the drilling operations parameters may be related to a drilling operation at a single site. The drill tool assembly data may be related to a particular drill tool assembly to be used in the drilling operation. In implementations using the present systems and methods during ongoing drilling operations, the drill tool assembly data may be related to the drill tool assembly currently in use.

As described above, one or more frequency-domain models may be used, at 308, to transform the obtained drilling operations parameters and the obtained drill tool assembly data into one or more vibrational indices that characterize an excitation response of the drill tool assembly design. The vibrational indices may be generated or calculated for a range of available drilling operating conditions within the drilling operations parameters. Incorporating the description from above related to FIG. 1, the utilization of the frequency-domain model(s) to produce one or more vibrational indices may include a velocity-dependent damping relationship 310 as part of the frequency-domain model(s). The remainder of the above description regarding the incorporation of various effects into the velocity-dependent damping relationship and/or into the frequency-domain models is also applicable to these methods. In effect, any one or more of the methods and/or features described in connection with FIG. 1 may be applied to the methods of FIG. 3 while varying the drilling operating conditions within the range provided by the drilling operations parameters to determine one or more vibrational indices under a plurality of operating conditions.

The drilling methods 300 of FIG. 3 utilize the frequency-domain models and vibrational indices to determine preferred drilling operating conditions to mitigate vibrations, at box 316. Similar to the description above regarding identifying drilling parameter changes, the step of determining preferred drilling operating conditions may be accomplished in a variety of manners. For example, vibrational indices may be calculated for a given drill tool assembly under a variety of operating conditions within the range defined by the obtained drilling operations parameters. The vibrational indices may then be evaluated, such as at box 316, to determine a combination of drilling operating conditions resulting in the lowest vibration or with a preferred vibrational index. While the preferred drilling operating conditions may be based on efforts to mitigate vibrations, such as being based on one or more vibrational indices, other factors may influence the determination of preferred drilling operating conditions, such as costs, risks, etc.

FIG. 3 further includes drilling a wellbore using the drill tool assembly while monitoring the drilling operating conditions, at box 320. The drilling may proceed according to conventional drilling practices. The monitoring of the drilling operating conditions allows the operator to know when conditions are deviating from the preferred drilling operating conditions. Despite the operator's best efforts to set controllable variables in a manner to maintain the preferred drilling operating conditions, the formation will often result in drilling operating conditions changing during the drilling operation. For example, data such as the mechanical specific energy or the rate of penetration may be monitored during drilling operations and may change when the drill tool assembly transitions from drilling through loosely consolidated formation to hard rock formation. When the monitored drilling operating conditions suggest that a change is needed, the methods 300 of FIG. 3 also include adjusting drilling operations to maintain the drilling operating conditions within, or at least substantially within a range of the preferred drilling operating conditions. For example, to avoid constant adjustment of the drilling operations, a range or margin of error may be identified within which the drilling operating conditions may vary, such as a range between about 0% and about 10%, depending on the parameter being considered and/or the sensitivity of the drilling operation. Acceptable ranges for given operational variables will be readily identifiable to those familiar with drilling operations.

FIG. 3 further illustrates that the drilling methods 300 may be extended by utilizing the wellbore in hydrocarbon-related operations, at 322, such as in producing hydrocarbons from the wellbore, at 324. Other hydrocarbon-related operations may include such activities as injection operations or other treatment related operations.

Figure 4:
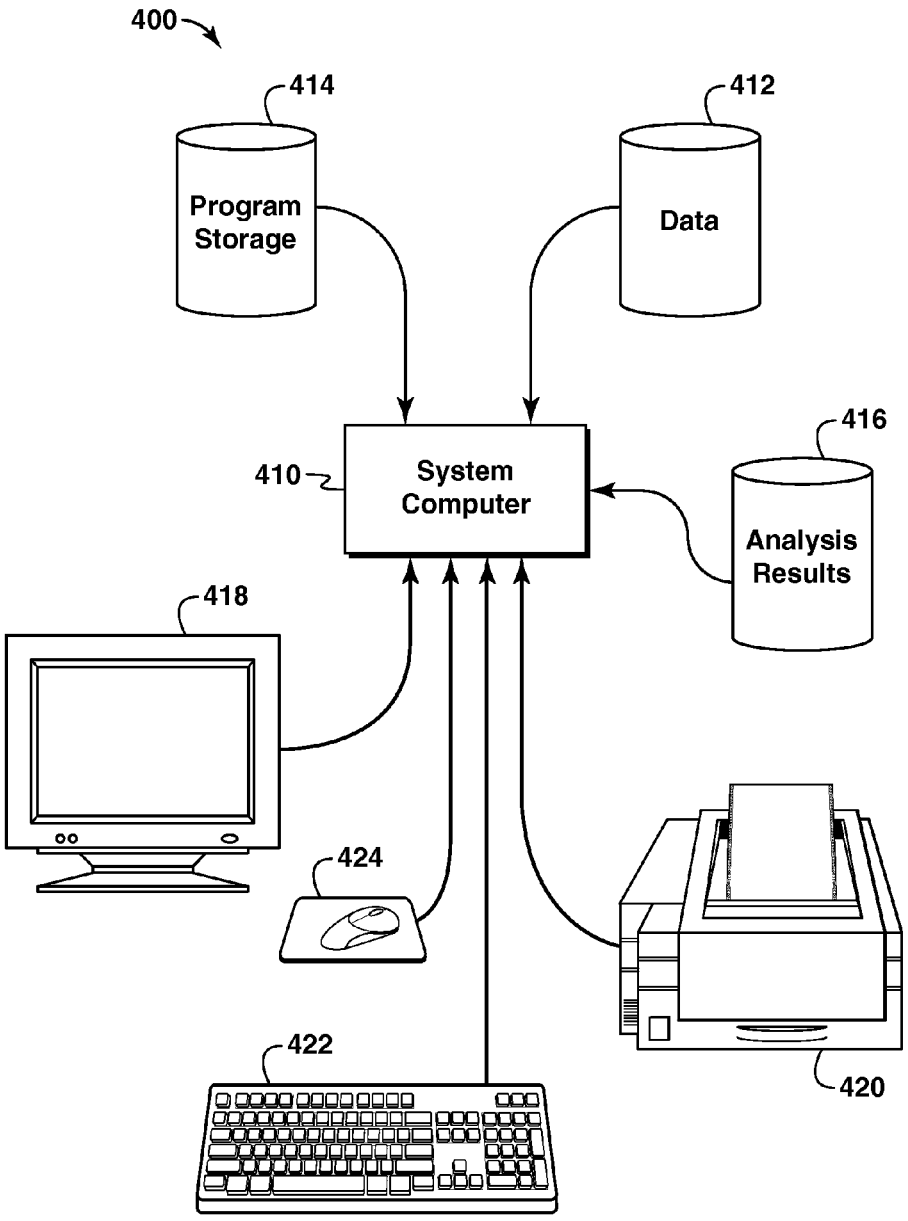
FIG. 4 is a schematic illustration of systems for use in the present methods.

FIG. 4 illustrates a simplified computer system 400, in which methods of the present disclosure may be implemented. The computer system 400 includes a system computer 410, which may be implemented as any conventional personal computer or other computer-system configuration described above. The system computer 410 is in communication with representative data storage devices 412, 414, and 416, which may be external hard disk storage devices or any other suitable form of data storage. In some implementations, data storage devices 412, 414, and 416 are conventional hard disk drives and are implemented by way of a local area network or by remote access. Of course, while data storage devices 412, 414, and 416 are illustrated as separate devices, a single data storage device may be used to store any and all of the program instructions, measurement data, and results as desired.

In the representative illustration, the data to be input into the systems and methods are stored in data storage device 412. The system computer 410 may retrieve the appropriate data from the data storage device 412 to perform the operations and analyses described herein according to program instructions that correspond to the methods described herein. The program instructions may be written in any suitable computer programming language or combination of languages, such as C++, Java, MATLAB® and the like, and may be adapted to be run in combination with other software applications, such as commercial formation modeling or drilling modeling software. The program instructions may be stored in a computer-readable memory, such as program data storage device 414. The memory medium storing the program instructions may be of any conventional type used for the storage of computer programs, including hard disk drives, floppy disks, CD-ROMs and other optical media, magnetic tape, and the like.

While the program instructions and the input data can be stored on and processed by the system computer 410, the results of the analyses and methods described herein are exported for use in mitigating vibrations. For example, the obtained drill tool assembly data and drilling operations parameters may exist in data form on the system computer. The system computer, utilizing the program instructions may utilize frequency-domain models to generate one or more vibrational indices. The vibrational indices may be stored on any one or more data storage devices and/or may be exported or otherwise used to mitigate vibrations. As described above, the vibrational indices may be used by an operator in determining design options, drill plan options, and/or drilling operations changes. Additionally or alternatively, the vibrational indices may be utilized by the computer system, such as to identify combinations of drilling parameters that best mitigate vibrations under given circumstances.

According to the representative implementation of FIG. 4, the system computer 410 presents output onto graphics display 418, or alternatively via printer 420. Additionally or alternatively, the system computer 410 may store the results of the methods described above on data storage device 416, for later use and further analysis. The keyboard 422 and the pointing device (e.g., a mouse, trackball, or the like) 424 may be provided with the system computer 410 to enable interactive operation. As described below in the context of exemplary vibrational indices, a graphical display of vibrational indices may require two, three, or more dimensions depending on the number of parameters that are varied for a given graphical representation. Accordingly, the graphics display 418 of FIG. 4 is representative of the variety of displays and display systems capable of presenting three and four dimensional results for visualization. Similarly, the pointing device 424 and keyboard 422 are representative of the variety of user input devices that may be associated with the system computer. The multitude of configurations available for computer systems capable of implementing the present methods precludes complete description of all practical configurations. For example, the multitude of data storage and data communication technologies available changes on a frequent basis precluding complete description thereof. It is sufficient to note here that numerous suitable arrangements of data storage, data processing, and data communication technologies may be selected for implementation of the present methods, all of which are within the scope of the present disclosure.

The present technology may include a software program that graphically characterizes the vibrational performance of one or more drill tool assemblies. In some implementations, the software program will graphically characterize the vibrational performance or tendency of a single configuration design for a single vibrational mode. In other implementations, the software program may be configured to graphically characterize the vibration performance of multiple designs simultaneously and/or multiple vibration modes simultaneously, as will be better described below. The methodologies implemented to graphically characterize the torsional and axial vibration performance incorporate a common framework with some differences. For instance, the baseline solution of the torsional vibration model requires inputs from the baseline solution of the axial vibration model.

As will be described in greater detail below, the software program input consists of entering ranges for various drilling operations parameters, such as WOB, RPM, drilling fluid density and viscosity, and bit depth, as well as various drill tool assembly design parameters, such as pipe and component dimensions, mechanical properties, and the locations of drill tool assembly components, such as drill collars, stabilizers and drill pipe. In some implementations, the program may allow for developing and maintaining multiple drill tool assembly design configurations for comparison purposes. Unlike other frequency-domain models that consider a simple vertical borehole, the present models also take into consideration complex borehole trajectories via a well plan or wellbore survey, and allow specification of boundary conditions at the bit and at the surface; default values are assumed if these parameters are not available. The models have a flexible framework that can accommodate friction factors, mud damping and special elements in the drill tool assembly such as shock subs and mud motors that can influence the vibrational response of the drill tool assembly. Velocity-dependent friction factors, both along the borehole and at the bit, also can be specified as needed, since these can significantly impact the vibrational response.

The output of the software program may consist of a variety of displays of one or more of the calculated baseline solution and the frequency eigenstates (e.g., axial displacement, axial tension, twist angle and torque) as a function of one or more of the drilling operations parameters (RPM, WOB, bit depth etc.), the distance to the bit, and the drill tool assembly design configuration. The overall performance may be evaluated using one or more of a variety of indices, including torsional and axial vibration indices. The displays, including detailed 3-dimensional state vector plots, are intended to illustrate the vibrational tendencies of alternative designs in a relative sense to enable the drilling engineer to select the preferred design for the desired operating conditions, in addition to identifying the preferred operating range for an individual design. By providing models and indices related to the axial and torsional behavior of the drill tool assembly, the systems and methods of the present disclosure complement the existing BHA design methodology based on lateral bending and existing drilling operating procedures, including workflows known as the "Fast Drill Process" (FDP), some of which are disclosed in U.S. Patent Publication No. US200810105424, which is incorporated herein by reference in its entirety.

More sophisticated versions of the base model, with additional inputs, can also be used to construct absolute vibration indices that predict bit bounce and stick-slip behavior. Additionally or alternatively, the technologies can be used in hindcast mode by using additional input from drilling logs. In hindcast mode, the various vibration indices can be displayed as tracks in a log to facilitate correlation between the observed behavior and the computed indices. This allows for calibration of previously unknown or poorly known parameters and can shed light into the root causes of poor vibrational performance, each of which can lead to better designs.

Some benefits of the present technologies compared to full-scale finite-element modeling are that significantly less computational effort is needed and that most input parameters are readily available. The technologies allow the designer to identify why the vibrational dysfunction occurs and to identify alternative designs or operating procedures that can mitigate this vibrational dysfunction. For example, a tapered drill tool assembly design may be necessary to meet a hydraulics constraint. If vibrational dysfunction is predicted for strings with long lengths of smaller diameter drill tool assemblies, one solution is to develop a tripping schedule and tapered string design that reduces the likelihood of initiating a vibrational dysfunction for each of the bit runs. Other such configuration or operational changes or adjustments may be identified by operators, engineers, and designers, having the benefit of the present systems and methods and associated indices.

Without limiting its broader scope, the present disclosure also provides examples of various vibration indices, of how the indices may be displayed, and of exemplary ways to compute the linear response functions from which the indices are derived. While several indices related to torsional and axial vibration are disclosed hereinbelow, other indices based on one or more functional relationships regarding torsional and/or axial vibrations may be utilized within the scope of the present invention.

Base Model

As suggested by the introduction, the present systems and methods utilize a "base model" to develop and/or calculate the baseline solution, the frequency eigenmodes, and the dynamic linear response functions for a given set of input parameters. The base model solves the equations of motion for the drill tool assembly under given input drilling operations parameters and conditions. The equations of motion that govern the dynamics of the drill tool assembly in a borehole are well known to those skilled in the art. As is known, the equations of motion can be made as complicated or as simple as desired depending on the number of physical relationships and interactions that are considered by the equations. The present methods and systems can be adapted to apply to different equations of motion and/or different base models than those presented herein. Accordingly, for the purposes of facilitating explanation of the present systems and methods, one suitable formulation of a base model is described herein and others are within the scope of the present disclosure.

Figure 5:
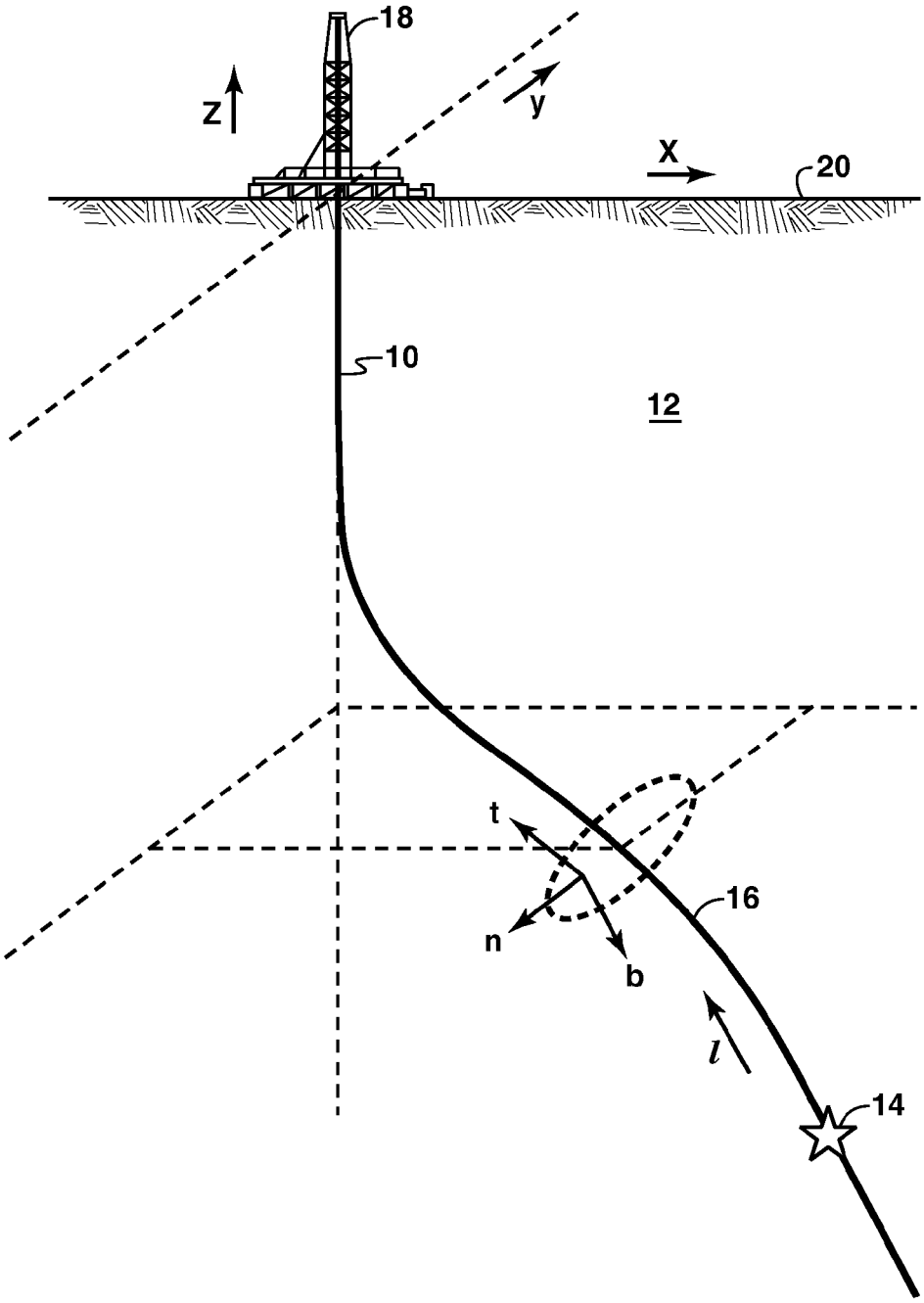
FIG. 5 is a schematic illustration of a drilling operation.

A schematic configuration of a drilling operation is shown in FIG. 5. A borehole 10 in the Earth 12 with a particular trajectory is created by the action of a drill bit 14 at the bottom of a drill tool assembly 16, consisting of drill pipe, drill collars and other elements. Drilling is achieved by applying a WOB, which results in a torque, $\tau_{bit}$, at the bit when the drill tool assembly is rotated at an angular velocity, $$\Omega_{RPM} \equiv \frac{2\pi}{60}(RPM).$$

The mechanical rotary power, $\Omega_{RPM}\tau_{bit}$, is supplied to the bit and is consumed during the rock cutting action. The torque is provided by a drilling rig 18 at the surface 20, and delivered by the drill tool assembly 16 to the drill bit 14 at the other end. The WOB is provided by gravitational loading of the drill tool assembly elements. The application of WOB forces a portion of the drill tool assembly 16 near the drill bit 14 into compression.

A number of complex factors influence the aggressiveness (rate of torque generation) and efficiency (energy consumed for penetrating rock in relation to rock strength) of the drill bit. These bit parameters depend heavily on details of the bit geometry, bit condition (new vs. dull), bottom-hole hydraulics, rock properties, etc. The systems and methods of the present disclosure do not attempt to predict these parameters, which are measurable or known to a large degree during drilling operations, but uses them as inputs to analyze the response of the drill tool assembly to excitations caused by the bit action.

The borehole centerline seen in FIG. 5 traverses a curve in 3-D, starting from the surface and extending out to the bottom of the hole being drilled. The borehole trajectory at arc length l from the drill bit in terms of the inclination and azimuth as a function of measured depth (MD), global (x, y, z) and local (t, n, b) coordinates and the local borehole curvature b can be written as:

$$t(l) = -\sin(\theta)\sin(\phi)x - \sin(\theta)\cos(\phi)y + \cos(\theta)z. \quad (1)$$

$$\kappa_b \equiv \frac{dt}{dl} \equiv \kappa_b\ n \quad (2)$$

$$b \equiv t \times n \quad (3)$$

Here, the unit normal vector n is in the plane of local bending and perpendicular to the tangent vector, whereas the unit binormal vector b is perpendicular to both t and n. The vectors x, y and z point to the East, North, and Up, respectively.

Figure 6:
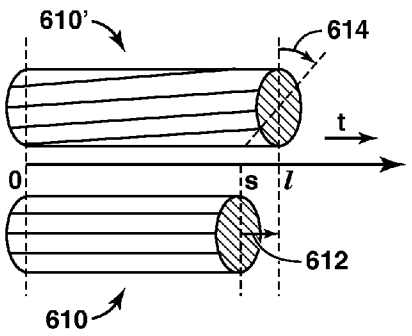
FIG. 6 is a schematic illustration of a tubular element (e.g., drill tool assembly) in an unstressed state and in a stretched and twisted state.

Drill tool assemblies can be considered as slender, one-dimensional objects and their properties can be effectively described as a function of arc length, s, along their centerline in the unstressed state, as schematically presented in FIG. 6. FIG. 6 illustrates schematically a section or segment of a drill tool assembly 610 in both an unstressed condition 610 and in a stressed condition 610'. In the stressed condition 610' the drill tool assembly is stretched and twisted relative to the unstressed condition 610. The differences between the stressed and unstressed conditions are discussed further below. For the purposes of the present systems and methods, the drill tool assembly is assumed to consist of elements attached rigidly end-to-end along a common axis of rotational symmetry, each element having a uniform cross-section along its length, free of bend and twist in its unstressed state. The description of each drill tool assembly element includes information about the material (elastic modulus, E, shear modulus, G, density, ρ) and geometrical properties (area, A, moment of inertia, I, polar moment of inertia, J). This information can typically be obtained from drill tool assembly descriptions and technical specifications of the drill tool assembly components.

Figure 7:
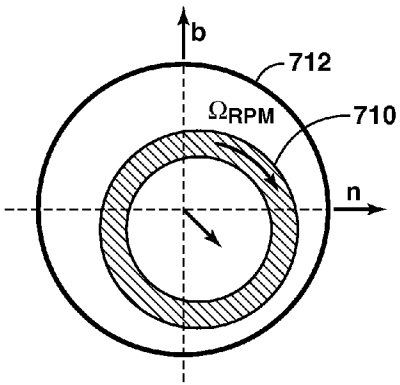
FIG. 7 is a schematic illustration of lateral displacement of a drill tool assembly in a borehole.

When the drill tool assembly is in the borehole, it is constrained by the forces imparted to it by the borehole walls, such that its shape closely follows the trajectory of the borehole, which can be tortuous in complex borehole trajectories. FIG. 7 illustrates schematically an exemplary disposition of a drill tool assembly 710 in a wellbore 712. FIG. 7 illustrates the drill tool assembly displaced from the borehole centerline. Without restricting the scope of the present disclosure, some implementations, such as the presently described implementation, utilize the soft-string approximation by ignoring the bending moments and assuming that the trajectory of the drill tool assembly exactly follows the borehole centerline, which forces the lateral displacement u=0. For this case, the configuration of the drill tool assembly can be uniquely defined in terms of a total axial elongation, or stretch, h(l)=l−s(l), and total torsion angle, or twist, (l). It is assumed that the borehole exerts the necessary forces to keep the drill tool assembly in lateral equilibrium along its entire length. Without being bound by theory, the soft-string assumption is currently believed to be a reasonable assumption for the drill pipe portion of the drill tool assembly, but may not be as reasonable for the BHA portion of the drill tool assembly. Moreover, it is presently understood to be possible to improve the accuracy of the model by using a stiff-string model and resolving bending moments at the BHA, or possibly along the entire drill tool assembly if necessary. Examples of such models have been disclosed at least in "Drillstring Solutions Improve the Torque-Drag Model," Robert F. Mitchell, SPE 112623. Use of such improvements in the base model are within the scope of the present disclosure. For example, while some of the discussion herein will reference assumptions regarding equations that can be simplified or solved by using this soft-string approximation, any one or more of these assumptions could be replaced utilizing appropriate stiff-string models.

In some implementations, the preferred base model considers the motion of the drill tool assembly while it is rotating at a particular bit depth (BD), WOB, and nominal rotation speed. The lateral displacement constraint leaves only two kinematic degrees of freedom for the drill tool assembly; stretch h and twist. As introduced above, FIG. 6 illustrates a schematic segment of a drill tool assembly 610 in both an unstressed state 610 and a stressed state 610'. FIG. 6 illustrates the stretch h at 612 representative of the elongation from the unstressed to the stressed state. Similarly, FIG. 6 illustrates the twist at 614 representative of the degree of rotation or twist of the free end under the stressed condition 610'. The overall motion of the drill tool assembly can be described by:

$$h(l, t) = h_0(l) + h_{dyn}(l, t),\ h_{dyn}(l, t) = \int_{-\infty}^{\infty} h_\omega(l)e^{-j\omega t}\,d\omega, \quad (4)$$

$$\alpha(l, t) = \Omega_{RPM}t + \alpha_0(l) + \alpha_{dyn}(l, t),\ \alpha_{dyn}(l, t) = \int_{-\infty}^{\infty} \alpha_\omega(l)e^{-j\omega t}\,d\omega, \quad (5)$$

where, $h_0$ and $\alpha_0$ represent the "baseline solution" —the amount of stretch and twist present in the drill tool assembly when it is rotating smoothly and $h_{dyn}$ and $\alpha_{dyn}$ represent the solutions to the dynamic motion of the drill tool assembly relative to the baseline solution. The model considers only small deviations around the baseline solution, allowing dynamic motions at different frequencies to be decoupled from each other.

The motions of the drill tool assembly are accompanied by internal tension, T, and torque, τ, transmitted along the drill tool assembly, which can be likewise described as:

$$T(l, t) = T_0(l) + T_{dyn}(l, t),\ T_{dyn}(l, t) = \int_{-\infty}^{\infty} T_\omega(l)e^{-j\omega t}\,d\omega, \quad (6)$$

$$\tau(l, t) \equiv -\tau t = -(\tau_0(l) + \tau_{dyn}(l, t))t,\ \tau_{dyn}(l, t) = \int_{-\infty}^{\infty} \tau_\omega(l)e^{-j\omega t}\,d\omega, \quad (7)$$

where $T_{dyn}$ and $\tau_{dyn}$ represent the solutions to the dynamic motion of the drill tool assembly relative to the baseline solution. In the linear elastic regime and within the soft-string approximation, these are given in terms of the drill tool assembly configuration as:

$$T = EA\frac{dh}{dl}, \quad (8)$$

-continued $$\tau = GJ\frac{d\alpha}{dl}. \tag{9}$$

The drill tool assembly elements are also subject to a variety of external forces, $f_{body}$, and torques, $\theta_{body}$, per unit length that affect their motion. The axial equation of motion is obtained by equating the net axial force to the force associated with the axial acceleration of the element mass:

$$\rho A\ddot{h}=T'+f_{body}\cdot t, \tag{10}$$

where t is the unit vector along the tangent direction. The torsional equation of motion is obtained by equating the net torque along the tangent vector to the torsional moment times angular acceleration of the element:

$$-\rho J\ddot{\alpha}=-\tau'+\theta_{body}\cdot t. \tag{11}$$

At the junction of two drill tool assembly elements, the stretch, h, and twist, $\alpha$, are continuous. Since no concentrated forces or torques are present, the tension, T, and torque, $\tau$, are also continuous across these boundaries. The partial differential equations (PDEs) Eqs. (10-11), along with constitutive relations Eqs. (8-9) and external forces and torques, fully describe the dynamics along the drill tool assembly once appropriate boundary conditions are specified at the ends of the drill tool assembly.

External Forces and Torques

Continuing with the discussion of a presently preferred implementation, three types of external forces, f, and torques, $\theta$, are considered: gravitational ($f_g$, $\theta_g$), mud ($f_{mud}$, $\theta_{mud}$) and borehole ($f_{bh}$, $\theta_{bh}$). The body force and torque in Eq. (10-11) is a composite sum of these three forces and torques and is described in Eqs. (12-13), $$f_{body}=f_{mud}+f_{bh}+f_g, \tag{12}$$

$$\theta_{body}=\theta_{mud}+\theta_{bh}+\theta_g. \tag{13}$$

Conventional modeling efforts recognized the relevance of gravitational forces on the drill tool assembly and attempted to incorporate gravity into the model. However, the ability to accurately consider the impact of gravitational forces acting on the drill tool assembly in a complex wellbore trajectory was limited by the prior models' inability to recognize or consider the additional external forces and torques.

Gravitational forces set up the characteristic tension profile along the drill tool assembly, which further affects torque, drag and drill tool assembly dynamics. The gravitational force per unit length acting on an element is $$f_g=-(\rho-\rho_{mud})Agz, \tag{14}$$

where z is a unit vector that points upward and which takes into account the buoyancy associated with the mud density $\rho_{mud}$. Since the elements have an axis of symmetry, no torque is generated by gravity: $\theta_g=0$.

During drilling operations, the drilling mud shears against both the inside and the outside of the drill tool assembly, and creates forces, $f_{mud}$, and torques, $\theta_{mud}$, per unit length that resist motion. In the absence of lateral motion according to the constraints described above, no lateral forces are generated by the mud. Also, any torque that is not along the local tangent will be cancelled out by borehole torques, so we need only consider the component of torque along the tangent vector. The mud forces and torques are then obtained as $$f_{mud}=f_{mud}t, \tag{15}$$

$$\theta_{mud}\cdot t=\theta_{mud}. \tag{16}$$

These forces and torques can be separated into a steady-state portion associated with the steady-state rotation of the drill tool assembly and circulation of the mud at average pump pressure, and a dynamic portion associated with dynamic variations in the mud pressure and the relative motion of the drill tool assembly with respect to steady-state.

For the purposes of the presently described implementation, it is assumed that the borehole forces dominate the steady-state force balance. The hook load differences between pumps-off and pumps-on and the effects of mud pump strokes and active components such as MWD systems that generate axial forces are assumed to be negligible in this exemplary embodiment. These assumptions simplify the solution, but are not required for implementation of the present systems and methods. The only mud effects that the model takes into account are those associated with the dynamic motion of the drill tool assembly with respect to its steady-state rotation. Since axial and torsional movements of the elements do not displace any mud, their main effect is to create a shearing motion of the mud adjacent to the drill tool assembly surface and to dampen dynamic vibrations around the steady-state.

There may be several possible dynamic models of the mud system that may be considered to be within the scope of this model. For example, one or more of the assumptions described above may be made differently, thereby altering the formulation of the model. One example of a suitable dynamic model of the mud system comprises the superposition of the dynamic effects of the mud system on the baseline solution using a model for shear stress on an infinite plane. The amplitude of the shear stress acting on an infinite plane immersed in a viscous fluid and undergoing an oscillatory motion parallel to its own surface at an angular frequency $\omega$ is given by:

$$\sigma_{mud,\omega} = (1 + j)\frac{\delta_\omega}{2}\rho_{mud}\omega^2 a_\omega, \tag{17}$$

where $a_\omega$ is the displacement amplitude of the plane motion, $\rho_{mud}$ is the mud density, j is an imaginary number, and $\delta_\omega$, the frequency-dependent depth of penetration, is given by $$\delta_\omega=\sqrt{2\eta_{pl}/\omega\rho_{mud}}, \tag{18}$$

where $\eta_{pl}$ is the plastic viscosity of the drilling mud under pumps-on conditions.

For the typical mud plastic viscosities $\eta_{pl}$, densities $\rho_{mud}$, and frequencies $\omega$ of interest, the penetration depth is small compared to the inner and outer radii of the element; $\delta \ll ID$, OD. The mud plastic viscosity term is not restricted to the Bingham model and can be easily generalized to include other rheological models, in which the viscosity term varies with RPM. In the high-frequency limit, Eq. 17 can be used to approximate the shear stress on an annular object. For axial motion at frequency $\omega$, this term results in a mud-related axial force per unit length:

$$f_{mud,\omega}\approx\sigma_{mud,\omega}(\pi ID+\tau OD), \tag{19}$$

where the axial displacement amplitude is given by $\alpha_\omega=h_\omega$. Similarly, the torque per unit length associated with torsional oscillations is given by:

$$\theta_{mud,\omega} \approx -\sigma_{mud,\omega}\left(\pi\left(\frac{ID^2}{2}\right)+\pi\left(\frac{OD^2}{2}\right)\right) \tag{20}$$

where the torsional displacement amplitudes at the ID and OD are given by $\alpha_\omega(ID)=\alpha_\omega \cdot ID/2$ and $\alpha_\omega(OD)=\alpha_\omega \cdot OD/2$, respectively. The total mud force for a general motion can be obtained by summing over all frequencies.

Figure 8:
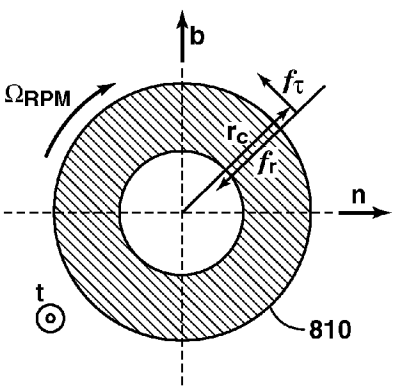
FIG. 8 is a schematic illustration of a drill tool assembly in a borehole indicating the borehole contact point and borehole forces in the local normal plane.

Turning now to the borehole forces, the borehole walls exert forces and torques that keep the drill tool assembly along the borehole trajectory. The currently described model assumes that each element has continuous contact with the borehole, consistent with the soft-string approximation, and that no concentrated forces are present. Other models that may be implemented within the scope of the present systems and methods may make different assumptions. For example, as discussed above, other models may use stiff-string approximations for some or all of the drill tool assembly. Continuing with the currently-described model using the soft-string approximation, the situation at a given borehole position l is depicted in FIG. 8. FIG. 8 illustrates schematically a cross-sectional view of a drill tool assembly 810 rotating in a clockwise manner under conditions of the soft-string approximation and with axes according to the description and illustration of FIG. 5. The contact is localized somewhere along the circumference of the element, and $r_c$ denotes the vector that connects the centerline to the contact point within the local normal plane, whose magnitude, $r_c$, is equal to half the "torque OD" of the element. The borehole force per unit length, $f_{bh}$, can then be decomposed into axial, radial and tangential components as follows:

$$f_{bh}=f_a t+f_n=f_a t-f_r r_c/r_c+f_\pi(t\times r_c)/r_c. \tag{21}$$

Here, a sign convention is used such that $f_r$ and $f_\pi$ are always positive, provided that the drill tool assembly rotates in a clockwise manner when viewed from above. $f_n$ is the total borehole force in the local normal plane, with magnitude $f_n$.

Four equations are needed to determine the three force components and direction of $r_c$ in the local normal plane. Since no lateral motion is allowed in the presently described implementation, imposing a force balance in the local normal plane yields two equations. Collecting borehole forces on one side of the equation and noting that there are no lateral mud forces present, gives, $$f_n=\kappa_b T+f_g-(f_g \cdot t)t. \tag{22}$$

Next, enforcing Coulomb friction against the borehole wall with a friction angle $\Psi_c$ provides two additional equations, $$\frac{f_a}{f_\tau}=-\frac{\dot{h}}{v_{rel}}=-\frac{\dot{h}}{\sqrt{\dot{h}^2+\dot{\alpha}^2 r_c^2}}, \tag{23}$$

$$f_\tau^2+f_a^2=\tan^2\psi_C f_r^2. \tag{24}$$

In general, $\Psi_c$ can be a function of the relative velocity, $v_{rel}=\sqrt{\dot{h}^2+\dot{\alpha}^2 r_c^2}$, of the element with respect to the borehole. The dependence of the friction angle, $\Psi_c$, on the relative velocity of the element, $v_{rel}$, with respect to the borehole can be expressed in terms of a logarithmic derivative, $$C_\mu \equiv \frac{\partial \ln \sin\psi_C}{\partial \ln v_{rel}}=\frac{v_{rel}}{\sin\psi_C}\frac{\partial \sin\psi_C}{\partial v_{rel}}. \tag{25}$$

A negative value for $C_\mu$ represents a reduction of friction with increasing velocity, which may be referred to as velocity-weakening friction. Such a situation can have a significant impact on the stability of torsional vibrations and stick-slip behavior of the drill tool assembly. Eq. (25) represents one manner in which a velocity-dependent damping relationship may be incorporated into the models utilized in the present systems and methods. Other equations and/or relationships may be incorporated as appropriate.

The constraint on lateral motion also implies that there is no net torque in the local normal plane, so any applied torque that is not along the tangent vector will be cancelled out by the borehole. Thus, the equations of motion are obtained by considering the component of torque that is along the local tangent direction, which is responsible for rotating the drill tool assembly. This component of torque per unit length exerted by the borehole is given by:

$$\theta_{bh} \cdot t=r_c f_c, \tag{26}$$

Baseline Solution

The baseline solution is a particular solution of the equations of motion that corresponds to smooth drilling with no vibration, at a particular bit depth, weight on bit, and specified drill tool assembly rotary speed that results in a rate of penetration. The equations of motion are then linearized around this baseline solution to study harmonic deviations from this baseline solution. The goal is to simplify the vibrations problem from a non-linear PDE describing the entire motion of the drill tool assembly to a set of linear ordinary differential equations (ODEs) that are decoupled for each frequency, for which very efficient solution methods exist. An exemplary baseline solution is described below, which is based on the equations of motion explained above. As described above, a variety of equations could be used to describe the motion of the drill tool assembly considering the multitude of relationships and interactions in the borehole. Baseline solutions within the scope of the present system and methods may be developed utilizing equations of motion different than those described above, whose solutions may be more or less complex than those presented hereinbelow, depending on the underlying equations of motion selected.

In the baseline solution, every point along the drill tool assembly has a steady downward velocity equal to the ROP. Deviations in this motion are very small over the typical vibration profiles of interest (smooth drilling with no vibration); hence these will be ignored during this steady downward motion. The drill tool assembly also rotates at a steady angular velocity dictated by the imposed RPM. It is also assumed that positive RPM corresponds to clockwise rotation of the drill tool assembly when viewed from the top. The baseline solution can be written as, $$h(l,t)=h(l), \tag{27}$$

$$\alpha(l,t)=\Omega_{RPM}t+\alpha_0(l), \tag{28}$$

such that the baseline displacement $h_0$ and twist $\alpha_0$ do not change with time. From the constitutive relations Eq. (8-9), it follows that baseline tension $T_0$ and torque $\tau_0$ also do not change with time and are function of position l only. The subscript "0" is used to denote the baseline values of all variables and parameters.

First, the axial forces and displacements are obtained. Substituting Eq. (27) into the Coulomb criterion Eq. (23), it is seen that $f_{a0}=0$. That is, the borehole does not exert any axial forces on the drill tool assembly. Then, the axial baseline solution for the composite drill tool assembly based on Eqs. (8) and (10) and boundary conditions at the bit ($T_0(0)=-WOB$, $h_0(0)=0$) can be computed from:

$$\frac{dT_0}{dl} = (\rho - \rho_{mud})gA \cos\theta, \tag{29}$$

$$\frac{dh_0}{dl} = \frac{1}{EA}T_0, \tag{30}$$

Next, the tangential borehole force is obtained using Eqs. (21) and (24) assuming no axial borehole forces:

$$f_{\tau 0}=f_{n0}\sin\Psi_{C0}. \tag{31}$$

This enables computation of the baseline twist and torque along the drill tool assembly using Eqs. (9) and (11), ignoring the contribution of the mud torque, $\theta_{mud}$, to the baseline torque. The result is another set of first-order ODEs:

$$\frac{d\tau_0}{dl} = r_c f_{n0}\sin\psi_{C0}, \tag{32}$$

$$\frac{d\alpha_0}{dl} = \frac{1}{GJ}\tau_0, \tag{33}$$

Based on the boundary conditions at the bit ($\tau_0(0)=\tau_{bit}$, $\alpha_0(0)=0$), the baseline solution for the twist and torque can be obtained by integration, just as in the axial case. In general, the torque generated at the bit cannot be controlled independently of the WOB; the two quantities are related through bit aggressiveness. The present model relates the bit torque to WOB through an empirical bit friction coefficient, $\mu_b$, $$\tau_{bit} = \mu_b \frac{OD_{bit}}{3} WOB. \tag{34}$$

The model uses the input parameter $\mu_b$ to compute the baseline solution. The torque at the bit enters the baseline torque solution only additively, and does not influence the dynamic linear response of the drill tool assembly; it is there mainly to enable calibration of the model with surface measurements.

For the numerical implementation of this solution scheme, the model interpolates the inclination, cos θ, and curvature, $\kappa_b$, from survey points to the midpoint of each element. The expressions, A, E and ρ are piece-wise constant over each drill tool assembly element. Also, the stretch of the drill tool assembly elements is ignored during the integration where dl=ds is assumed. Since all other drill tool assembly properties are constants within each element, the solution at each element boundary is obtained by applying the following recursive sums:

$$T_{0,i} \equiv T_0(s_i) = T_{0,i-1} + L_i(\rho_i - \rho_{mud})gA_i \cos\theta_i,\ T_{0,0} = -WOB, \tag{35}$$

$$h_{0,i} \equiv h_0(s_i) = h_{0,i-1} + \frac{L_i}{E_i A_i}T_{0,i-1/2},\ h_{0,0} = 0, \tag{36}$$

$$\tau_{0,i} \equiv \tau_0(s_i) = \tau_{0,i-1} + L_i r_{c,i} f_{n0,i} \sin\psi_{C0,i},\ \tau_{0,0} = \tau_{bit}, \tag{37}$$

$$\alpha_{0,i} \equiv \alpha_0(s_i) = \alpha_{0,i-1} + \frac{L_i}{G_i J_i}\tau_{0,i-1/2},\ \alpha_{0,0} = 0, \tag{38}$$

where $f_{n0,i}$ is the borehole force of the $i^{th}$ element of the drill tool assembly, $T_{0,i-1/2}$ is the arithmetic average tension of the $(i-1)^{th}$ and $i^{th}$ elements of the drill tool assembly, and $r_{0,i-1/2}$ is the arithmetic average torque of the $(i-1)^{th}$ and $i^{th}$ elements of the drill tool assembly. Note that the tension along the drill tool assembly is needed for all of the computations in the above implementation and is the first quantity to be computed.

Harmonic Wave Equations

Having computed the baseline solution for a particular bit depth, WOB, and RPM, small motions $h_{dyn}$ and $\alpha_{dyn}$ of an individual element may be calculated around this solution along with the associated forces ($T_{dyn}$) and torques ($\tau_{dyn}$) to model the vibrations of the drill tool assembly.

Beginning with the axial equations, the change in axial borehole force is obtained by rearranging Eq. (23) to linear order in dynamic variables as, $$f_a = -\frac{h_{dyn} f_\tau}{\Omega_{RPM} r_c} \Rightarrow f_{a,dyn} = -\frac{h_{dyn}}{\Omega_{RPM} r_c} f_{\tau 0} = -\frac{f_{n0}\sin\psi_{C0}}{\Omega_{RPM} r_c}\int_{-\infty}^{\infty}(-j\Omega)h_\Omega e^{-j\Omega t}\,d\Omega. \tag{39}$$

Substituting Eq. (4) into Eq. (10), multiplying both sides by exp(jωt)/2π, integrating over time, and using Eqs. (19) and (39) yields:

$$-\rho A\omega^2[1 + (1+j)\Delta_{mud,a} + j\Delta_{bh,a}]h_\omega = \frac{dT_\omega}{dl} = EA\frac{d^2 h_\omega}{dl^2}, \tag{40}$$

for each frequency component ω where $$\Delta_{mud,a} \equiv \frac{\rho_{mud}}{\rho}\frac{\pi(ID+OD)\delta_\omega}{2A},$$

and $$\Delta_{bh,a} \equiv \frac{f_{n0}\sin\psi_{C0}}{\rho A\omega\Omega_{RPM} r_c}.$$

This second-order linear ODE has the following solution:

$$h_\omega(l)=h_{\omega u}e^{jk_a l}+h_{\omega d}e^{-jk_a l}, \tag{41}$$

where $h_{\omega u}$ and $h_{\omega d}$ are arbitrary constants that represent the complex amplitude of upwards and downwards traveling axial waves along the elements of the drill tool assembly, respectively. The associated wave vector, $k_a$, at frequency ω is given by:

$$k_a \equiv \frac{\omega}{\sqrt{E/\rho}}\sqrt{1 + (1+j)\Delta_{mud,a} + j\Delta_{bh,a}}. \tag{42}$$

In the absence of mud and borehole effects, this dispersion relation reduces to the well-known non-dispersive longitudinal wave along a uniform rod. Even when mud and borehole effects are present, they tend to be relatively small. In some implementations, the mud and borehole effects have been observed to be sufficiently small to result in a weakly damped, nearly non-dispersive wave along the drill tool assembly. While the mud and borehole effects may be relatively small, the present systems and methods are able to incorporate these effects into the frequency-domain models, such as through the velocity-dependent damping relationship. Accordingly, the present systems and methods are better able to account for each of the forces applied to the system and to enable operators to design and plan closer to the margins where efficiency gains may be most dramatically achieved. Due to the large wavelengths associated with the frequency range of interest, these waves typically travel along the entire drill tool assembly. The corresponding tension amplitude is given by:

$$T_\omega(l) = EA\frac{dh_\omega}{dl} = jk_aEA(h_{\omega u}e^{jk_al} - h_{wd}e^{-jk_al}). \tag{43}$$

The state of the axial wave at each frequency is uniquely described by $h_{\omega u}$ and $h_{\omega d}$. However, it is more convenient to represent the state of the axial wave by the axial displacement $h_\omega$ and tension $T_\omega$ instead, since these have to be continuous across element boundaries. The modified expression is obtained by combining Eqs. (41) and (43) in matrix form at two ends (locations I and I-L) of an element of length L, $$\begin{bmatrix} h_\omega(l) \\ T_\omega(l) \end{bmatrix} = \begin{bmatrix} e^{jk_al} & e^{-jk_al} \\ jk_aEAe^{jk_al} & -jk_aEAe^{-jk_al} \end{bmatrix} \begin{bmatrix} e^{jk_a(l-L)} & e^{-jk_a(l-L)} \\ jk_aEAe^{jk_a(l-L)} & -jk_aEAe^{-jk_a(l-L)} \end{bmatrix}^{-1} \begin{bmatrix} h_\omega(l-L) \\ T_\omega(l-L) \end{bmatrix} \tag{44}$$

Thus, as a first step in obtaining the dynamic response of the drill tool assembly at a given frequency ω, the present model computes the transfer matrix for each element:

$$T_{a,i} \equiv \begin{bmatrix} \cos(k_{a,i}L_i) & -\frac{\sin(k_{a,i}L_i)}{k_{a,i}E_iA_i} \\ k_{a,i}E_iA_i\sin(k_{a,i}L_i) & \cos(k_{a,i}L_i) \end{bmatrix}, \tag{45}$$

where $k_{a,i}$ is obtained using Eqs. (42) and (18). For an axial vibration at that frequency, the state vector between any two points along the drill tool assembly can be related to each other through products of these transfer matrices:

$$S_{a,n}(\omega) \equiv \begin{bmatrix} h_\omega(s_n) \\ T_\omega(s_n) \end{bmatrix} = T_{a,nm}S_{a,m}(\omega); \tag{46}$$

$$T_{a,nm} \equiv \left(\prod_{i=m+1}^{1} T_{a,i}\right);$$

$$m < n.$$

The transfer matrix Eq. (46) can be used to relate the axial vibration state anywhere along the drill tool assembly to, for example, the state at the surface end of the drill tool assembly. However, in order to solve for the response of the drill tool assembly to a particular excitation, it is necessary to specify the relationship between the displacement and tension amplitudes at the surface. Furthermore, not much work has been carried out in identifying the response of a drilling rig to axial and torsional vibrations. This relationship is necessary to correctly impose dynamic boundary conditions at the surface. The simplest boundary condition is to assume that the rig is axially rigid and has perfect RPM control, such that $$h_{rig} \equiv h_{dyn}(MD)=0,\ \alpha_{rig} \equiv \alpha_{dyn}(MD)=0, \tag{47}$$

where MD denotes the position of the rig along the drill tool assembly. In general, a rig should have finite compliance against the axial and torsional modes. The response of a drilling rig is dependent on the rig type and configuration and can change rapidly as the frequency of the vibration mode sweeps through a resonant mode of the rig. The response of the drilling rig can be modeled and incorporated into the present systems and methods in a variety of manners, including the approach described below.

Figures 9A, 9B, 9C:
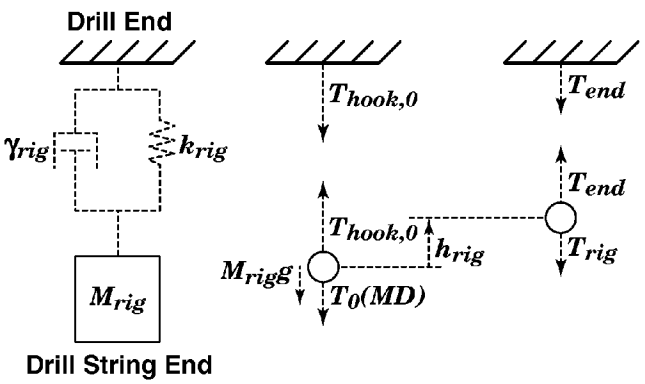
FIG. 9 is a schematic illustration of (a) a representation of the drilling rig as a damped mass-spring system; (b) a free-body diagram of the block mass and the dead end for the quasi-static baseline solution; and (c) a free-body diagram for the dynamic response of the system to perturbations around the baseline.

FIG. 9, via FIGS. 9A, 9B, and 9C, presents three schematic free-body diagrams to help illustrate the mechanics of the axial motion. For the case of axial motion, the drill tool assembly can be assumed to be rigidly attached to the top drive block, which can be approximated as a large point mass $M_{rig}$. This block is free to move up and down along the elevators, and is held in place by a number of cables that carry the hook load. There are also some damping forces present, which are assumed to be proportional to the velocity of the block. Thus, for small amplitude vibrations, a simple representation of the dynamics of this system is a mass-spring-dashpot attached to a rigid end, with a spring associated with the hoisting cables and a dashpot representing the damping, as shown in FIG. 9A. Here, $T_{hook}$ reflects the upwards force exerted on the block by the rig, including the spring and the damping force. The free-body diagram for the baseline solution is shown in FIG. 9B. Imposing force balance for the baseline solution yields:

$$T_{hook,0}=T_0(MD)+M_{rig}g. \tag{48}$$

The hoisting cable length is adjusted to achieve the desired hook load; therefore the position of the baseline axial displacement is immaterial and is not needed to compute the baseline solution. However, this length sets the equilibrium position of the spring. When the block mass moves away from the baseline position, a net force is exerted on it by the drill tool assembly and the rig. The free-body diagram for dynamic movement from the baseline solution is shown in FIG. 9C. The dynamic hook load is given by:

$$T_{end}=-k_{rig}H_{rig}-\gamma_{rig}\dot{h}_{rig}. \tag{49}$$

Newton's equation of motion for the block mass yields the following relation between vibration amplitudes at each frequency:

$$-M_{rig}\omega^2h_{rig,\omega}=-T_{rig,\omega}+T_{end,\omega}=-T_{rig,\omega}-(k_{rig}-j\omega\gamma_{rig})h_{rig,\omega}. \tag{50}$$

Thus, the axial rig compliance, based on a reference frame fixed at the rig, is given by:

$$C_{rig,a}(\omega) \equiv \frac{h_{rig,\omega}}{T_{rig,\omega}} = \frac{1}{M_{rig}\omega^2 + j\omega\gamma_{rig} - k_{rig}}. \tag{51}$$

This quantity measures the amount of axial movement the block mass will exhibit for a unit axial force at a particular frequency ω. It is a complex-valued function whose magnitude gives the ratio of the displacement magnitude to force magnitude, and whose phase gives the phase lag between the forcing function and the resulting displacement.

The dynamic response of the mass-spring-dashpot system is well known and will only be described briefly. Three parameters are needed to fully describe this simple dynamic rig model. The block mass is typically estimated from the hook load reading with no drill tool assembly attached. The spring constant can be estimated from the length, number and cross-sectional area of the hoisting cables. These two parameters define a characteristic rig frequency, $\omega_{rig,\alpha} \equiv \sqrt{k_{rig}/M_{rig}}$, for which the displacement of the block is 90° out of phase with the dynamic force. The severity of the rig response at this frequency is controlled by the rig damping coefficient; critical damping occurs for $\gamma_{rig}=\gamma_{crit}\equiv 2M_{rig}\omega_{rig}$. Since the rig frequency and the amount of damping relative to the critical damping is more intuitive and easier to observe, the current model uses $M_{rig}$, $\omega_{rig}$ and $\gamma_{rig}/\gamma_{crit}$ as inputs in order to compute the dynamic response. The "stiff-rig" limit in Eq. (47) can be recovered by considering the limit $\omega_{rig}\rightarrow\infty$, where the compliance vanishes. At this limit, the rig end does not move regardless of the tension in the drill tool assembly.

In general, the dynamic response of the rig is much more complicated. However, all the information that is necessary to analyze vibration response is embedded in the compliance function, and the model framework provides an easy way to incorporate such effects. If desired, it is possible to provide the model with any compliance function, possibly obtained from acceleration and strain data from a measurement sub.

As a practical matter, the effective compliance of the rig will vary with the traveling block height and the length and number of the cables between the crown block and traveling block. In the drilling of a well, the traveling block height varies continuously as a joint or stand is drilled down and the next section is attached to continue the drilling process. Also, the number of such cable passes may vary as the drilling load changes. The derrick and rig floor is a complex structure that is likely to have multiple resonances which may have interactions with the variable natural frequency of the traveling equipment. For these reasons, in addition to a well-defined resonance with specified mass, stiffness, and damping, and in addition to the "stiff rig" limit or alternatively a fully compliant rig, it is within the scope of this invention to consider that the surface system may be near resonance for any rotary speed under consideration. Then preferred configurations and operating conditions may be identified as having preferred index values despite possible resonance conditions in the rig surface equipment.

Eqs. (46) and (51) can be combined to obtain the vibration response everywhere along the drill tool assembly, associated with unit force amplitude at the surface:

$$\tilde{S}_{a,n}(\omega)\equiv\begin{bmatrix}\tilde{h}_\omega(s_n)\\ \tilde{T}_\omega(s_n)\end{bmatrix}=T^{-1}_{a,rig-n}\begin{bmatrix}C_{rig,a}(\omega)\\ 1\end{bmatrix}. \tag{52}$$

Due to the linearity of the equations, the actual dynamic motion of the drill tool assembly at a given point is given by a linear superposition of these state vectors with different amplitudes at different frequencies. The main interest will be the dynamic linear response of the system to excitations at a given point along the drill tool assembly. The response of the system to multiple excitations can likewise be analyzed using the superposition principle.

In defining the vibration performance of the drill tool assembly, the primary quantity of interest is described by the way it responds to excitations at different frequencies caused by the drill bit. The effective drill tool assembly compliance at the bit can be defined as:

$$C_{bit}(\omega)\equiv\frac{\tilde{h}_\omega(0)}{\tilde{T}_\omega(0)}, \tag{53}$$

which is given by the ratio of the elements of $\tilde{S}_\alpha$ (Eq. (52)) at the bit. General linear response functions that relate amplitudes at different positions along the drill tool assembly can also be defined.

Turning now to the torsional equations, the methodology used for obtaining the expressions for torsional waves is similar to that described above for axial waves. As suggested above and throughout, while particular equations are provided as exemplary equations and expressions, the methodology used for obtaining these equations and expressions is included within the scope of the present disclosure regardless of the selected starting equations, boundary conditions, or other factors that may vary from the implementations described herein. Similar to the methodology used for axial waves, the dynamic torque associated with the borehole forces is computed using the lateral motion constraint and the Coulomb criterion. Expanding the lateral force balance to linear order in dynamic variables and eliminating the baseline terms to obtain:

$$f_{n0}f_{n,dyn}=[\kappa_b^2T_0+(\rho-\rho_{mud})g(\kappa_b\cdot z)]T_{dyn}. \tag{54}$$

To linear order, the change in the instantaneous friction coefficient can be obtained using Eq. (25):

$$\sin^2\psi_C=\sin^2\psi_{C0}\left(1+2C_{\mu0}\frac{\dot{\alpha}_{dyn}}{\Omega_{RPM}}\right). \tag{55}$$

Thus, expanding Eq. (24) to linear order and eliminating baseline terms yields:

$$f_{\tau0}f_{\tau,dyn}=f_{n0}f_{n,dyn}\sin^2\psi_{C0}+f_{n0}^2\sin^2\psi_{C0}C_{\mu0}\frac{\dot{\alpha}_{dyn}}{\Omega_{RPM}}. \tag{56}$$

The borehole torque associated with each torsional frequency component is:

$$\theta_{bh,\omega}=r_cf_{\tau,\omega}=r_cf_{n,\omega}\sin\psi_{C0}-j\omega r_cf_{n0}\sin\psi_{C0}C_{\mu0}\frac{\alpha_\omega}{\Omega_{RPM}}. \tag{57}$$

The dynamic variation in the tension, associated with axial waves, couples linearly to the dynamic torque in the curved section of the borehole. The present model currently decouples these effects and explores axial and torsional modes independently. The decoupling is accomplished by setting the tension, $T_{dyn}$, to zero while analyzing torsional modes.

For each frequency component, substituting these into the torsional equation of motion Eq. (11) and eliminating baseline terms yields:

$$\rho J\omega^2\alpha_\omega=-\frac{d\tau_\omega}{dl}+\begin{bmatrix}-(1+j)\pi\frac{ID^3+OD^3}{8}\delta_\omega\rho_{mud}\omega^2-\\ j\omega r_cf_{n0}\sin\psi_{C0}\frac{C_{\mu0}}{\Omega_{RPM}}\end{bmatrix}\alpha_\omega. \tag{58}$$

This equation can be rearranged to yield:

$$-\rho J\omega^2[1+(1+j)\Delta_{mud,\tau}+j\Delta_{bh,\tau}]\alpha_\omega=\frac{d\tau_\omega}{dl}=GJ\frac{d^2\alpha_\omega}{dl^2}, \tag{59}$$

where $$\Delta_{mud,\tau}=\pi\frac{\rho_{mud}}{\rho}\frac{(ID^3+OD^3)\delta_\omega}{8J}$$

and $$\Delta_{bh,\tau}=\frac{r_c f_{n0}\sin\psi_{C0}}{\rho J}\frac{C_{\mu 0}}{\omega\Omega_{RPM}}.$$

This equation has exactly the same form as the axial equation, with the solution:

$$\alpha_\omega(l)=\alpha_{\omega u}e^{jk_\tau l}+\alpha_{\omega d}e^{-jk_\tau l}, \tag{60}$$

where the associated wave vector, $k_\tau$, at frequency, $\omega$, is given by:

$$k_\tau\equiv\frac{\omega}{\sqrt{G/\rho}}\sqrt{1+(1+j)\Delta_{mud,\tau}\cdot j\Delta_{bh,\tau}}. \tag{61}$$

In the absence of mud and borehole effects, this dispersion relation reduces to the well-known non-dispersive torsional wave along a uniform rod. Once again, borehole and mud damping is typically relatively small, resulting in a weakly damped, nearly non-dispersive wave along the drill tool assembly. These waves typically travel along the entire drill tool assembly rather than just in the bottom hole assembly. One significant difference is that the effective damping associated with the borehole can be negative when the friction law has velocity-weakening characteristics, that is, $C_\mu<0$. This has important implications for stick-slip behavior of the drill tool assembly.

As discussed above, the velocity-dependent damping relationships incorporated into the models of the present systems and methods provide models that are more reliable and more accurate than prior models. More specifically, it has been observed that the mud damping effect increases with increasing velocity whereas the borehole damping effect actually decreases with increasing velocity. Accordingly, in some implementations, models that incorporate both mud effects and borehole effects may be more accurate than models that neglect these effects. While the mud effects and borehole effects may be relatively small, the appropriate modeling of these effects will increase the model accuracy to enable drilling at optimized conditions. Because the costs of drilling operations and the risks and costs associated with problems are so high, misunderstandings of the drilling operations, whether for over-prediction or under-prediction, can result in significant economic impacts on the operations, such as in additional days of drilling or in additional operations to recover from complications.

The torque amplitude is given by:

$$\tau_\omega(l)=GJ\frac{d\alpha_\omega}{dl}=jk_\tau GJ(\alpha_{\omega u}e^{jk_\tau l}-\alpha_{wd}e^{-jk_\tau l}). \tag{62}$$

As in the axial case, the transfer matrix formalism can be used to relate twist and torque amplitudes at the two ends of an element:

$$S_{a,i}(\omega)\equiv\begin{bmatrix}\alpha_\omega(s_i)\\ \tau_\omega(s_i)\end{bmatrix}=\begin{bmatrix}\cos(k_\tau L) & \frac{-\sin(k_\tau L)}{k_\tau GJ}\\ k_\tau GJ\sin(k_\tau L) & \cos(k_\tau L)\end{bmatrix}\begin{bmatrix}\alpha_\omega(s_{i-i})\\ \tau_\omega(s_{i-1})\end{bmatrix}. \tag{63}$$

The rest of the torsional formulation precisely follows the axial case, with the appropriate substitution of variables and parameters. The torsional compliance at the surface is defined similarly, using appropriate torsional spring, damping and inertial parameters.

In addition to the elements of the drill tool assembly, the model can accommodate special elements, in its general framework. In general, these can be accommodated as long as expressions relating the baseline solution across the two ends, as well as its associated dynamic transfer matrix, can be described. For example, a shock sub is typically used to dampen axial vibrations at the bit. The shock sub roughly consists of two pieces that can slide in and out of each other and are connected by a spring. When the pieces move with respect to each other, an internal fluid creates a damping force. The response of the system can be modeled as two drill tool assembly elements (representing the two halves of the shock sub) connected to a spring-dashpot system, with spring constant $k_{ss}$ and damping constant $\gamma_{SS}$. The transfer matrix for a shock sub can be obtained as:

$$\begin{bmatrix}h_{\omega,upper}\\ T_{\omega,upper}\end{bmatrix}=T_{SS}(\omega)\begin{bmatrix}h_{\omega,lower}\\ T_{\omega,lower}\end{bmatrix},\ T_{SS}(\omega)=\begin{bmatrix}1 & \frac{1}{k_{SS}-j\omega\gamma_{SS}}\\ 0 & 1\end{bmatrix}. \tag{64}$$

All that is needed to obtain the state vector in the presence of the shock sub is to insert this transfer matrix to the overall product in Eq. (46) at the appropriate position. As expected, this matrix reduces to the identity matrix when the spring is made infinitely stiff.

Another special element of potential interest is a mud motor located in the BHA. This device alters the baseline solution because all the drill tool assembly elements below it rotate at a different angular velocity $\Omega_{bit}>\Omega_{RPM}$ determined by the mud motor design and the mud flow rate. The baseline torque remains continuous across the mud motor. The dynamic response of the mud motor can be expressed in a transfer matrix formulation similar to Eq. (64).

Tool Joint Effects

Many tubular components of the drill tool assembly, especially the drill pipes, do not have a uniform cross-sectional profile along their length. They tend to be bulkier near the ends (tool joints) where connections are made, and slimmer in the middle. Heavy weight drill pipe and other non-standard drill pipe can also have reinforced sections where the cross-sectional profile is different from the rest of the pipe. Many drill pipes also have tapered cross sections that connect the body of the pipe to the tool joints at the ends, rather than a piecewise constant cross-sectional profile. To construct a drill tool assembly, many nearly identical copies of such tubular components are connected end-to-end to create a structure with many variations in cross-section along its length. Representing each part with a different cross-section as a separate element is tedious and computationally costly. It is desirable to use a simpler effective drill tool assembly description to speed up the computation and reduce the complexity of the model. This can be achieved by taking advantage of the fact that for a section of the drill tool assembly consisting of a series of tubulars of nominally the same design and length, typically around 10 m (30 ft), the variations in cross-section are nearly periodic, with a period (~10 m) that is much smaller than the wavelengths associated with axial and torsional vibrations of interest. Thus, a method of averaging can be employed to simplify the equations to be solved. This method, as it applies for the problem at hand here, is disclosed below.

Consider a section of the drill tool assembly consisting of a number of nominally identical components of length, L, attached end-to-end, for which the cross-sectional area, A, moment of inertia, I, and polar moment of inertia, J, are periodic functions of arc length, l, with a period L that is considered short compared to the characteristic wavelengths of interest. Then, Eqs. (29-30) that describe the axial baseline solution can be approximated by:

$$\frac{dT_0}{dl} \approx (\rho - \rho_{mud})g\langle A\rangle\cos\theta, \tag{65}$$

$$\frac{dh_0}{dl} \approx \frac{1}{E}\left\langle\frac{1}{A}\right\rangle T_0, \tag{66}$$

where the angular brackets denote averaging over one period of the variation:

$$\langle f\rangle \equiv \frac{1}{L}\int_0^L dl f(l). \tag{67}$$

Similarly, the torsional baseline solution can be obtained by replacing the torque outer diameter, $r_c$, and the inverse of the polar moment of inertia 1/J, by their averaged versions in Eqs. (32-33). The numerical implementation described in Eqs. (35-38) can be handled likewise. By replacing the geometrical parameters with their averaged values, it is no longer necessary to break up the drill tool assembly into elements of constant cross-section.

Note that inversion and averaging operations are not interchangeable; for example, <1/A> is not equal to 1/<A> unless A is a constant. For a given drill tool assembly component of specified cross-sectional profile, we can define the following shape factors:

$$s_A \equiv \sqrt{\langle A\rangle\left\langle\frac{1}{A}\right\rangle},\ s_J \equiv \sqrt{\langle J\rangle\left\langle\frac{1}{J}\right\rangle}. \tag{68}$$

For a component with a general cross-sectional profile, these shape factors are always greater than or equal to one, the equality holding only when the cross-section remains constant along the component.

Now turning to the harmonic wave equations, when the geometry parameters are no longer a constant along the arc length, the differential Eq. (40) can be written in matrix form:

$$\frac{d}{dl}\begin{bmatrix} h_\omega \\ T_\omega \end{bmatrix} = \begin{bmatrix} 0 & 1/EA \\ -\rho A\omega^2[1 + (1 + j)\Delta_{mud,a} + j\Delta_{bh,a}] & 0 \end{bmatrix}\begin{bmatrix} h_\omega \\ T_\omega \end{bmatrix}. \tag{69}$$

After applying the method of averaging to the individual elements of the matrix, and further manipulation of equations familiar to someone skilled in the art, the generalized version of the axial transfer matrix Eq. (40) is obtained as:

$$T_a \equiv \begin{bmatrix} \cos(k_a s_A L) & -\frac{s_A \sin(k_a s_A L)}{k_a E\langle A\rangle} \\ \frac{k_a E\langle A\rangle}{s_A}\sin(k_a s_A L) & \cos(k_a s_A L) \end{bmatrix}, \tag{70}$$

where the subscript i has been dropped for simplicity. The averaging process also affects the mud and borehole damping parameters as follows:

$$\Delta_{mud,a} \equiv \frac{\rho_{mud}}{\rho}\frac{\pi\langle ID + OD\rangle\delta_\omega}{2\langle A\rangle}, \tag{71}$$

$$\Delta_{bh,a} \equiv \frac{f_{n0}\sin\psi_{C0}}{\rho\langle A\rangle\omega\Omega_{RPM}}\left\langle\frac{1}{r_c}\right\rangle. \tag{72}$$

The averaged torsional equations can be obtained similarly, with the resulting transfer matrix having the same form as above, with the appropriate substitutions of torsional quantities (Eq. (63)):

$$T_\tau \equiv \begin{bmatrix} \cos(k_\tau s_J L) & -\frac{s_J \sin(k_\tau s_J L)}{k_\tau G\langle J\rangle} \\ \frac{k_\tau G\langle J\rangle}{s_J}\sin(k_\tau s_J L) & \cos(k_\tau s_J L) \end{bmatrix}, \tag{73}$$

where, the torsional damping parameters are also appropriately averaged.

The most significant effect of using drill tool assembly components with a non-uniform cross-section is to change the wave vectors associated with axial and torsional waves at a given frequency by a constant shape factor. In other words, the velocities of axial and torsional waves along this section of the drill tool assembly are reduced by $s_A$ and $s_J$, respectively. This causes an associated shift of resonant frequencies of the drill tool assembly to lower values, which can be important if the model is used to identify RPM "sweet spots". As mentioned at various places herein, the costs of drilling operations makes even minor improvements in predictions and corresponding operations efficiencies valuable.

To illustrate the magnitude of this effect, let us consider a typical 5" OD, 19.50 pound per foot (ppf) high strength drill pipe with an NC50(XH) connection. A section of the drill tool assembly consisting of a number of these drill pipes will have a repeating cross-sectional pattern, consisting of approximately 30 ft of pipe body with an OD=5" and ID=4.276", and a tool joint section with a total (pin+box) length of 21", OD=6.625" and ID=2.75". The corresponding shape factors for this pipe are $s_A$=1.09 and $s_J$=1.11, respectively. Thus, if most of the drill tool assembly length consists of this pipe, the tool joints may cause a downward shift of resonant frequencies of up to about 10%, compared to a drill pipe of uniform cross-section. This can be significant depending on the application, and may be included in a preferred embodiment of the invention. For example, drilling operations are typically planned to avoid operations at the resonant frequencies, which can be more accurately modeled with the present systems and methods. The corresponding changes in the damping parameters have a less significant impact on the dynamic response of the drill tool assembly, but may also be incorporated.

Drill Tool Assembly Performance Assessment

The baseline solution, frequency eigenstates, and linear response functions provided by the base model may be used to evaluate bit bounce and stick-slip tendencies of drill tool assembly designs, which may be by means of "vibration indices" derived from these results. Without restricting the scope of the invention, a few examples of such indices are presented here. Specifically, several indices described here depend on the effective compliance (axial and torsional) of the drill tool assembly at the bit position (Eq. 53):

$$C_{a,bit}(\omega) = \frac{h_\omega(0)}{T_\omega(0)} \tag{74}$$

and $$C_{\tau,bit}(\omega) = \frac{\alpha_\omega(0)}{\tau_\omega(0)} \tag{75}$$

The axial compliance provides the relationship between the axial displacement and tension amplitude at a particular frequency. Similarly, the torsional compliance relates the angular displacement amplitude to the torque amplitude. The compliance is a complex function of w and has information on both the relative magnitude and phase of the oscillations.

Axial (Bit Bounce) Indices: Forced Displacement at Bit

In evaluating the drill tool assembly performance considering forced displacement at the bit, the drill bit is assumed to act as a displacement source at certain harmonics of the RPM. For roller cone (RC) bits with three cones, the 3×RPM mode is generally implicated in bit bounce, thus it is appropriate to treat n=3 as the most important harmonic mode. For PDC bits, the number of blades is likely to be an important harmonic node. Also, in a laminated formation, any mismatch between the borehole trajectory and the toolface, such as during directional drilling, will give rise to an excitation at the fundamental frequency, thus n=1 should always be considered. Considering the harmonics, n=3 for RC bits and n=1 and blade count for PDC bits, should be used; however, considering other frequencies are within the scope of this invention.

It is assumed that the origin of the displacement excitation is the heterogeneity in the rock, such as hard nodules or streaks, or transitions between different formations. While passing over these hard streaks, the drill bit is pushed up by the harder formation. If the additional axial force that is generated by the drill tool assembly response to this motion exceeds the WOB, the resulting oscillations in WOB can cause the bit to lose contact with the bottom hole. The situation is similar to the case when a car with a stiff suspension gets airborne after driving over a speed bump. The effective spring constant of the drill tool assembly that generates the restoring force is given by:

$$k_{DS}(n) = \mathrm{Re}\left[-\frac{1}{C_{a,bit}(n\Omega_{RPM})}\right]. \tag{76}$$

The worst-case scenario occurs when the strength of the hard portions significantly exceed the average strength of the rock, such that the bit nearly disengages from its bottom hole pattern, resulting in an excitation amplitude equal to the penetration per cycle (PPC), or the amount the drill tool assembly advances axially in one oscillation period; thus, it is assumed that:

$$h_{n\Omega_{RPM}}(0) = a \cdot PPC;\ PPC \equiv \frac{2\pi \cdot ROP}{n\Omega_{RPM}}. \tag{77}$$

The proportionality constant, a, between the PPC and the imposed displacement amplitude can be adjusted from 0 to 1 to indicate rock heterogeneity, with 0 corresponding to a completely homogeneous rock and 1 corresponding to the presence of very hard stringers in a soft rock. A bit bounce index can then be defined by the ratio of the dynamic axial force to the average WOB. Setting the proportionality constant, a, to one corresponds to a worst-case scenario:

$$BB_1(n) = k_{DS}(n)\frac{PPC}{WOB} = \frac{ROP}{WOB} \cdot \frac{2\pi \mathrm{Re}\lfloor -C_{a,bit}(n\Omega_{RPM})\rfloor}{n\Omega_{RPM}\|C_{a,bit}(n\Omega_{RPM})\|^2}. \tag{78}$$

The bit would completely disengage from the rock for part of the cycle if this ratio exceeds one, so the design goal would be to minimize this index; keeping it small compared to one. The index is only relevant when the real part of the compliance is negative, that is, when the drill tool assembly actually pushes back.

The first ratio in this expression depends on the bit and formation characteristics, and this can be obtained from drill-off tests at the relevant rotational speeds. Alternatively, the vibrational performance of an already-run drill tool assembly design can be hindcast using ROP and WOB data in the drilling log.

In a pre-drill situation where ROPs are not known, it may be more advantageous to provide a pre-drill ROP "limit state" estimate associated with a bit bounce index of one:

$$MAXROP(n) = WOB \cdot \frac{n\Omega_{RPM}\|C_{a,bit}(n\Omega_{RPM})\|^2}{2\pi\,\mathrm{Re}\lfloor -C_{a,bit}(n\Omega_{RPM})\rfloor}. \tag{79}$$

A contour plot of this quantity will indicate, for a given set of drilling conditions, the ROP beyond which bit bounce may become prevalent and the design goal would be to maximize the ROP within an operating window without inducing excessive or undesirable bit bounce.

For the purposes of drill tool assembly design, a comparative bit bounce index that takes into account only drill tool assembly properties can be useful:

$$BB_2(n) = \frac{\mathrm{Re}\lfloor -C_{a,bit}(n\Omega_{RPM})\rfloor}{nD_b\|C_{a,bit}(n\Omega_{RPM})\|^2}, \tag{80}$$

where $D_b$ is the bit diameter. The design goal would be to minimize this quantity in the operating window. It is a relative indicator, in that the actual magnitude does not provide any quantitative information; however, it has units of stress and should be small when compared to the formation strength. Only positive values of this parameter pose a potential axial vibration problem.

For cases where the uncertainty in the input parameters does not allow accurate determination of the phase of the compliance, a more conservative index can be used by replacing the real part with the magnitude and disregarding the phase. The discussion above illustrates several available indices that can be developed from the relationships within the borehole. Other suitable indices may be developed applying the systems and methods of the present disclosure and are within the scope of the present disclosure.

Bit Bounce: Regenerative Chatter

Another important potential source of axial vibration is regenerative chatter of the drill bit, which has a more solid foundational understanding. As a source of axial vibration, relationships defining regenerative chatter behavior can be used to provide still additional performance indices. Regenerative chatter is a self-excited vibration, where the interaction between the dynamic response of the drill tool assembly and the bit-rock interaction can cause a bottom hole pattern whose amplitude grows with time. This is a well-known and studied phenomenon in machining, metal cutting and milling, and is referred to as "chatter theory". In comparison to the earlier discussion, this type of instability can occur in completely homogeneous rock and is more directly tied to the drill tool assembly design.

Linear theories of regenerative chatter were developed in the 1950's and 1960's by various researchers, including Tobias, Tlusty and Merritt. In the years since the introductory theories of regenerative chatter, significant improvements have been made to the theories including theories that feature predictive capabilities. Chatter can occur at frequencies where the real part of the compliance is positive, thus it covers frequencies complementary to the ones considered previously. The sign convention used in the present systems and methods is different from most conventional descriptions of chatter. For these frequencies, chatter can occur if:

$$\frac{\partial(PPC)}{\partial(WOB)} < 2\,\mathrm{Re}[C_{a,bit}(\omega)]. \tag{81}$$

For unconditional stability, this inequality needs to be satisfied for any candidate chatter frequency. The penetration per cycle (PPC) can be related to ROP:

$$\frac{\partial(PPC)}{\partial(WOB)} = \frac{2\pi}{\omega}\frac{\partial(ROP)}{\partial(WOB)}. \tag{82}$$

Thus, the criterion for unconditional stability can be made into a chatter index:

$$BB_3 \equiv \left[\frac{\partial(ROP)}{\partial(WOB)}\right]^{-1} \max_\omega\left\{\frac{\omega\,\mathrm{Re}[C_{a,bit}(\omega)]}{\pi}\right\}. \tag{83}$$

This quantity needs to be less than one for unconditional stability. If calibration (drill-off) information is not available, it is still possible to construct a relative chatter index:

$$BB_4 \equiv \frac{D_b}{\Omega_{RPM}}\max_\omega\{\omega\,\mathrm{Re}[C_{a,bit}(\omega)]\} \tag{84}$$

In reality, requiring unconditional stability is conservative, since the chatter frequency and RPM are related. It is possible to compute a conditional stability diagram and locate RPM "sweet spots" by fully employing Tlusty's theory. This computation is complicated by the fact that the effective bit compliance itself is a function of RPM, although the dependence is fairly weak. This results in a more computationally intensive analysis, which is not described in detail herein, but which is within the broader scope of the present disclosure.

Torsional (Stick-Slip) Indices: Bit-Induced Stick-Slip

While torsional vibration, also referred to as stick-slip, can be caused or influenced by a number of factors within the borehole, the interaction between the bit and the formation is an important factor. The prevailing explanation of bit-induced stick-slip is that it arises as an instability due to the dependence of bit aggressiveness (Torque/WOB ratio) on RPM. Most bits exhibit reduced aggressiveness at higher RPMs. At constant WOB, the torque generated by the bit actually decreases as the bit speeds up, resulting in RPM fluctuations that grow in time. What prevents this from happening at all times is the dynamic damping of torsional motion along the drill tool assembly. Stick-slip behavior can potentially occur at resonant frequencies of the drill tool assembly, where "inertial" and "elastic" forces exactly cancel each other out. When this occurs, the real part of the compliance vanishes:

$$Re[C_{\tau,bit}(\omega_{res,i})]=0;\ i=1,2,\ldots \tag{85}$$

The magnitude of the effective damping at this frequency is given by:

$$\gamma_{\tau,i} = \mathrm{Im}\left[\frac{1}{\omega_{res,i}C_{\tau,bit}(\omega_{res,i})}\right]. \tag{86}$$

If one assumes that the dynamical response of the bit can be inferred from its steady-state behavior at varying RPMs, then the damping parameter associated with the bit is given by:

$$\gamma_{bit} = \frac{\partial\tau_{bit}}{\partial\Omega_{RPM}}. \tag{87}$$

Stick-slip instability occurs when the negative bit damping is large enough to make the overall damping of the system become negative:

$$\gamma_{bit}+\gamma_{\tau,i}<0. \tag{88}$$

A drill tool assembly has multiple resonant frequencies, but in most cases, the effective drill tool assembly damping is smallest for the lowest-frequency resonance (i=1), unless vibration at this frequency is suppressed by active control such as Soft Torque™. Thus, the presently-described model locates the first resonance and uses it to assess stick-slip performance. Other suitable models used to develop indices may consider other resonances. A suitable stick-slip tendency index can be constructed as:

$$SS_1 = \frac{\tau_{rig}}{\Omega_{RPM}(\gamma_{\tau,1}+\gamma_{bit})}. \tag{89}$$

The factor multiplying the overall damping coefficient is chosen to non-dimensionalize the index by means of a characteristic torque (rig torque) and angular displacement (encountered at full stick-slip conditions). Another reasonable choice for a characteristic torque would be torque at the bit; there are also other characteristic frequencies such as the stick-slip frequency. Accordingly, the index presented here is merely exemplary of the methodology within the scope of the present disclosure. Other index formulations may be utilized based on the teachings herein and are within the scope of the present invention. The design goal of a drill tool assembly configuration design and/or a drilling operation design would be to primarily avoid regions where this index is negative, and then to minimize any positive values within the operating window.

This index requires information about how the bit torque depends on RPM. The preferred embodiment uses a functional form for the bit aggressiveness as follows:

$$\mu_b \equiv \frac{3\tau_{bit}}{D_b \cdot WOB} = \mu_d + \frac{\mu_s - \mu_d}{1 + (\Omega_{RPM}/\Omega_{XO})}, \tag{90}$$

where $D_b$ is the bit diameter. Other implementations may utilize other relationships to describe how the bit torque depends on RPM. According to the present implementation, as the RPM is increased, the bit aggressiveness goes down from its "static" value $\mu_s$ at low RPMs towards its "dynamic" value $\mu_d$ at high RPMs, with a characteristic crossover RPM associated with angular velocity $\Omega_{XO}$. Eq. (90) can then be used to obtain a form of the expression in Eq. (87) as, $$\gamma_{bit} \equiv \frac{D_b \cdot WOB}{3}\left(-\frac{1}{\Omega_{XO}}\right)\left(\frac{\mu_s - \mu_d}{1 + (\Omega_{RPM}/\Omega_{XO})^2}\right). \tag{91}$$

Other suitable functional forms can also be used. It should be noted that if a mud motor is present, the rotation speed at the bit should be used to compute the damping of the bit. Mud motor systems operate at higher RPMs and tend to have significant torsional damping due to their architecture. Use of mud motors can significantly reduce stick-slip risk; this effect can be accounted for if the dynamic transfer matrix of the mud motor is provided to the model. Other suitable adaptations of the present models to account for various other drill tool assembly elements and configurations are within the scope of the present disclosure.

If no bit characteristic information is available, a relative index can be used for the purposes of side-by-side comparison of drill tool assembly designs by assuming suitable default values, such as 0.3 for bit aggressiveness and no velocity weakening. This index will not allow determination of when stick-slip will occur, but will provide a relative comparison between different drill tool assembly designs meant for the same bit, with the better designs having a lower index:

$$SS_2 = \frac{\tau_{rig}(\mu_b = 0.3)}{\Omega_{RPM}\gamma_{\tau,1}}. \tag{92}$$

Torsional Indices: Forced Torsional Vibrations

In order to evaluate drill tool assembly performance under torsional forcing, the linear response to various types of excitations can be considered, all of which are within the scope of the disclosed invention. In one preferred embodiment, the drill bit is assumed to act as a source of torque oscillations with a frequency that matches the rotary speed and its harmonics. When one of these harmonics is close to one of the torsional resonant frequencies of the drill tool assembly, severe torsional oscillations can be induced due to the large effective compliance of the drill tool assembly, i.e., a small torque oscillation can result in a large variation in the rotary speed of the bit. The effective torsional compliance at the bit, taking into consideration drill string and bit damping is given by, $$C_{eff}(\omega) = \left[\frac{1}{C^*_{bit}(\omega)} + \frac{1}{C_{\tau,bit}(\omega)}\right]^{-1} \tag{93}$$

where, $C^*_{bit}(\omega)=1/j\omega\gamma_{bit}$. The * is used to indicate that the term is not a true compliance and only includes the velocity weakening term associated with the bit aggressiveness. A non-dimensionalized forced torsional vibration index for the nth harmonic excitation can then be defined as:

$$TT_1(n)=n\tau_{rig}\|C_{eff}(n\Omega_{RPM})\|. \tag{94}$$

For the desired range of drilling parameters, better drill tool assembly and bit designs result in lower indices. The index is normalized such that it reflects the ratio of a characteristic torque (chosen here as the torque at the surface) to the excitation torque amplitude needed to achieve full stick-slip at the bit. Another reasonable choice for a characteristic torque would be torque at the bit. There are also other characteristic frequencies that can be considered, another example is disclosed below. Accordingly, the index presented here is merely exemplary of the methodology within the scope of the present disclosure. Other index formulations may be utilized based on the teachings herein and are within the scope of the present invention. The design goal would be to minimize the index within the operating window.

If no bit characteristic information is available, suitable default values such as 0.3 for bit aggressiveness and no velocity weakening can be assumed and a relative index similar to the stick slip index can then be defined as:

$$TT_2(n)=n\tau_{rig}(\mu_b=0.3)\|C_{\tau,bit}(n\Omega_{RPM})\|. \tag{95}$$

The index in Eq. (95) can provide a relative comparison between different drill tool assembly designs utilizing the same bit, with the better design having a lower vibration index.

Axial and Torsional Indices: Other Forced Vibrations

Other potential sources of axial and torsional vibration are the pressure fluctuations generated by mud pumps, and other hydraulic elements in the drill tool assembly, such as a mud motor, a turbine, or a mud pulse telemetry valve. Each of these have the potential to modulate the axial and torsional forcing at particular frequencies. For example, mud pumps create pressure ripples at harmonics of the pump strokes per minute (SPM). This creates an axial forcing both along the entire drill tool assembly, and at the drill bit due to changes in the pressure drop across the bit nozzles. The same forcing also generates torque oscillations due to the dynamic change in WOB at the same frequency. A relative vibration performance index due to the excitation at the mud pump SPM and its harmonics can be constructed to quantify its effects on drill tool assembly vibrations. As another example, the mud motor alters the baseline solution by rotating at a different angular velocity determined by the mud motor design, the mud flow rate and the pressure drop across the motor. The torsional and axial forcing also coincides with the mud pump strokes per minute (SPM) and harmonics of the SPM, but occurs at the location of the mud pump. As yet another example, the hydraulic valve used for mud pulse telemetry operates at a carrier frequency related to the data transfer rate of the system, and generates pressure oscillations at distinct characteristic frequencies. If any of these excitations coincide with a resonant frequency of the drill tool assembly, it can result in amplification of vibrations. Those skilled in the art would, with the help of this disclosure, be able to construct and utilize suitable vibration indices based on the excitation of the drill tool assembly at a particular position and particular frequency, and the response function of the drill tool assembly to that excitation.

Other Indices: Elastic Energy in the Drill Tool Assembly

The amount of stored elastic energy in the drill tool assembly resulting from dynamic conditions can be an indicator of excessive motion that can lead to drill tool assembly damage, wear of pipe and casing, and perhaps even borehole breakouts and other poor hole conditions. The amount of stored elastic energy in the drill tool assembly may be written in integral form as:

$$F = \frac{1}{2}\int_0^L \left\{ EA\left(\frac{\partial h}{\partial s}\right)^2 + GJ\left(\frac{\partial \alpha}{\partial s}\right)^2 + EI\|\kappa\|^2 \right\} ds. \tag{96}$$

Since the hole curvature can be considered to be pre-determined and not part of the dynamics problem, the first two terms in the integrand, the dynamic axial strain energy and torsional strain energy respectively, may be used as, or considered in, additional vibration indices. Better performance would generally be associated with lower index values calculated as follows:

$$EE_1 = \frac{1}{2}\int_0^L EA\left(\frac{\partial h}{\partial s}\right)^2 ds. \tag{97}$$

$$EE_2 = \frac{1}{2}\int_0^L GJ\left(\frac{\partial \alpha}{\partial s}\right)^2 ds. \tag{98}$$

The particular solutions used in computing the indices above can be the baseline solution, the dynamic part of the linear response functions at a relevant frequency (a harmonic of the RPM, or a resonant frequency in the case of chatter or stick-slip), or a superposition of the two.

Other Indices: System Losses Due to Friction

The amount of energy dissipated in frictional losses along the drill tool assembly may be estimated with this model for reference conditions. Integrating the product of the friction terms (mud or borehole contact friction) and their respective displacements or shear rates, including both baseline and dynamic terms, will quantify the friction losses and identify the terms that result from loading and the terms that are induced by dynamic effects predicted in the model. The effects of drill tool assembly redesign on frictional losses may then be quantified. Larger average friction typically results in more component wear and thus shorter life, so it is desirable to reduce it. On the other hand, dynamic friction can provide the damping that is needed to suppress vibrational instabilities. When the friction exhibits velocity-weakening characteristics, overall frictional losses can be reduced in the presence of vibrations, which can trigger instabilities. Thus, quantifying dynamic losses in terms of a loss index can help with the task of designing drill tool assemblies with longer life and fewer vibrational issues.

Other Indices: Dynamic Yield Margin

The combined baseline solutions and dynamic linear response functions from this model may uniquely provide information to assist in obtaining an understanding of the operating margin for dynamic loading conditions. For each element of the drill tool assembly, the margin between the material yield stress and the baseline stress state determines the yield margin at that depth. By overlaying the dynamic states and the calculated stresses for reference dynamic conditions, and comparing these values with the dynamic yield margin, one may estimate the proximity to dynamic failure of the drill tool assembly and thus identify those pipe sections that are in danger of failure. Redesign of the drill tool assembly or upgrading the pipe strength in this interval will eliminate the "weak link" in the chain and improve system tolerance to fatigue.

Combined Indices

As previously discussed the predicted behavior for each of the vibration modes can be determined by examining each of the vibration indices separately. However, it is possible that the individual predicted vibration performance for a given set of operating conditions may predict good performance for one of the indices while predicting poor performance for one or more of the other vibration indices. Therefore, in some implementations, two or more of the vibration modes and two or more corresponding indices may be considered in conjunction in efforts to reduce vibration during drilling operations. These implementations will enable designing and identifying the drill tool assembly design that mitigates vibrational dysfunction over a desired range of at least one or more of RPM, WOB, and depth.

The combined analysis for determining performance indices for multiple vibration modes can be accomplished in at least two ways, examples of which include: (1) combined index development and (2) overlay of different indices to identify "normal" operation regions. Other methods of combining two or more indices may be developed and are within the scope of this disclosure. Once the combined performance indices are determined, one or more BHA and drill tool assembly designs and drilling operating parameters can be tested utilizing the combined performance indices to determine preferred design and/or operations to reduce vibrations. Several methods exist for both approaches for developing a combined/overlay vibration index. For instance, combined index development may include calculating or otherwise determining the separate vibration performance indices and providing a numerical value that can best quantify the effect of the vibration modes. The different modes can be weighted equally or skewed depending on the expected likelihood of encountering a specific type of vibration. The separate and weighted indices may then be combined to form a global index, such as by summing, averaging, or other method that is applied commonly for all calculations of the global index.

In a similar fashion, overlaying of different indices can be carried out by combining performance curves on one plot while keeping some of the parametric values, such as WOB, fixed. However, it is understood that the fixed parametric value is not intended to be a limitation of the overlay index. This enables visual identification of sweet spots given all the modes of vibration. To further enhance identification, this process can be carried out in a computer program.

Figure 10:
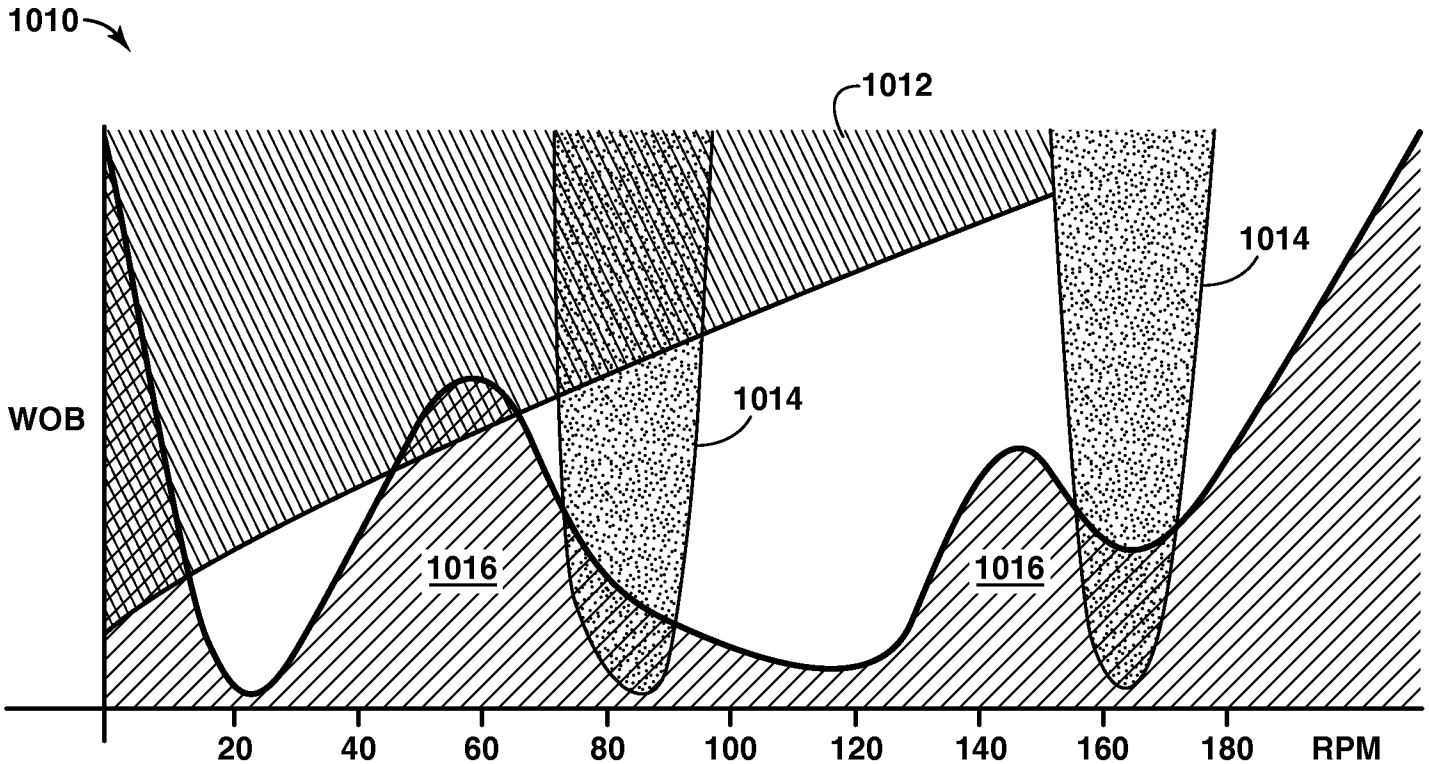
FIG. 10 is a representative plot of combined performance indices.

FIG. 10 provides one schematic two-dimensional embodiment of a representative combined vibration performance index plot. The combined vibration performance index plot may illustrate the indices with common axes to provide an idea of the normal operating parameters (WOB, RPM) that the drill tool assembly can be operated at in order to avoid torsional oscillations (such as stick-slip), lateral bending (such as whirl) and the axial mode of vibration (such as bit bounce). While a two dimensional plot is illustrated, these indices may be plotted as a function of depth using a three-dimensional chart. Other variations on the representative plot are within the scope of the present disclosure and may be developed for specific or general application. In the exemplary combined index plot of FIG. 10, considering that the stick-slip region 1012 is the region associated with the instability moving further away from the instability region provides a parameter space more resistant to stick-slip issues. Additionally, by considering the combined index plot of FIG. 10, the movement away from the stick-slip region can be informed so as to not enter regions prone to axial vibrations 1014 or lateral bending 1016.

While the schematic displayed provides an idea of how the three different modes of vibration can be combined, many times in practice, only two out of the three modes dominate the system response. For example, the lateral bending mode and either the torsional or axial mode may be determined or estimated to dominate the system response. Additionally or alternatively, there could be situations where the torsional and axial modes dominate over the lateral bending mode. The composition of the drill tool assembly, the BHA, and the bit influence which modes dominate the system response. For example, the tricone bits have distinct axial mode dominance while PDC bits have torsional mode dominance. Consequently, alternative embodiments may combine the performance indices of any two of the vibration modes, such as axial and whirl, torsional and whirl, and torsional and axial modes.

EXAMPLES

As described above, the present disclosure provides systems and methods for assisting in the design of drill tool assembly configurations and/or for assisting in the design of drilling operations. Exemplary performance indices are described above and others may be developed according to the methodology(ies) described above. Several of the methods described above provide results that are best presented graphically. The manner of presenting the results graphically may be varied as desired by one of skill in the art. Various exemplary graphical display implementations are described in connection with FIGS. 11-17; other implementations are also within the scope of the present disclosure. The following discussion further describes a system adapted for the implementation of the above methodology, such as a computer system including input equipment, processing equipment, and display equipment. Other suitable systems may be developed to implement the present methods.

The methods of the present disclosure are preferably implemented using one or more computer-based systems, such as described above. An exemplary computer system will include conventional components such as processors, storage medium, software, and input and output systems. Any one or more of these components of the computer system may be provided in any suitable form and/or be combined with the others as appropriate or available by the evolution of technology. For example, the input and output systems may be combined, at least in part, in the form of a touch-screen display. Similarly, these components may communicate with each other in any suitable manner. For example some portion of the storage medium used in the implementation of the present methods may be remote from the input and/or output systems, such as by being connected via a network or other communications system. As another example, two or more processors may be adapted to cooperate in the processing of the mathematics and algorithms provided by the present methods. The methods described herein may be performed by the computer system utilizing a customized software package adapted for the present methods. Similarly, the programming adapted to implement the present methods may be associated with the computer system as firmware or in any other suitable manner. Additionally or alternatively, one or more aspects of the present methods may be implemented utilizing commercially available software packages, including operating systems, mathematics programs, engineering design programs, programming languages, etc.

Turning now to an exemplary system, it is noted that the present systems may be coupled with or integrated with the systems or tools disclosed by Applicant's co-pending International Patent Publication No. WO 2008/097303, the entire disclosure of which is incorporated herein by reference for all purposes. For example, the graphical user interface may be similar to the interface disclosed in that application. The following discussion and illustrations demonstrate a few of the various input and output displays available with systems and methods of the present disclosure. This example analyzes a simple build-and-hold well profile and a reference drill tool assembly design and compares it to various tapered drill tool assembly design alternatives.

Figure 11:
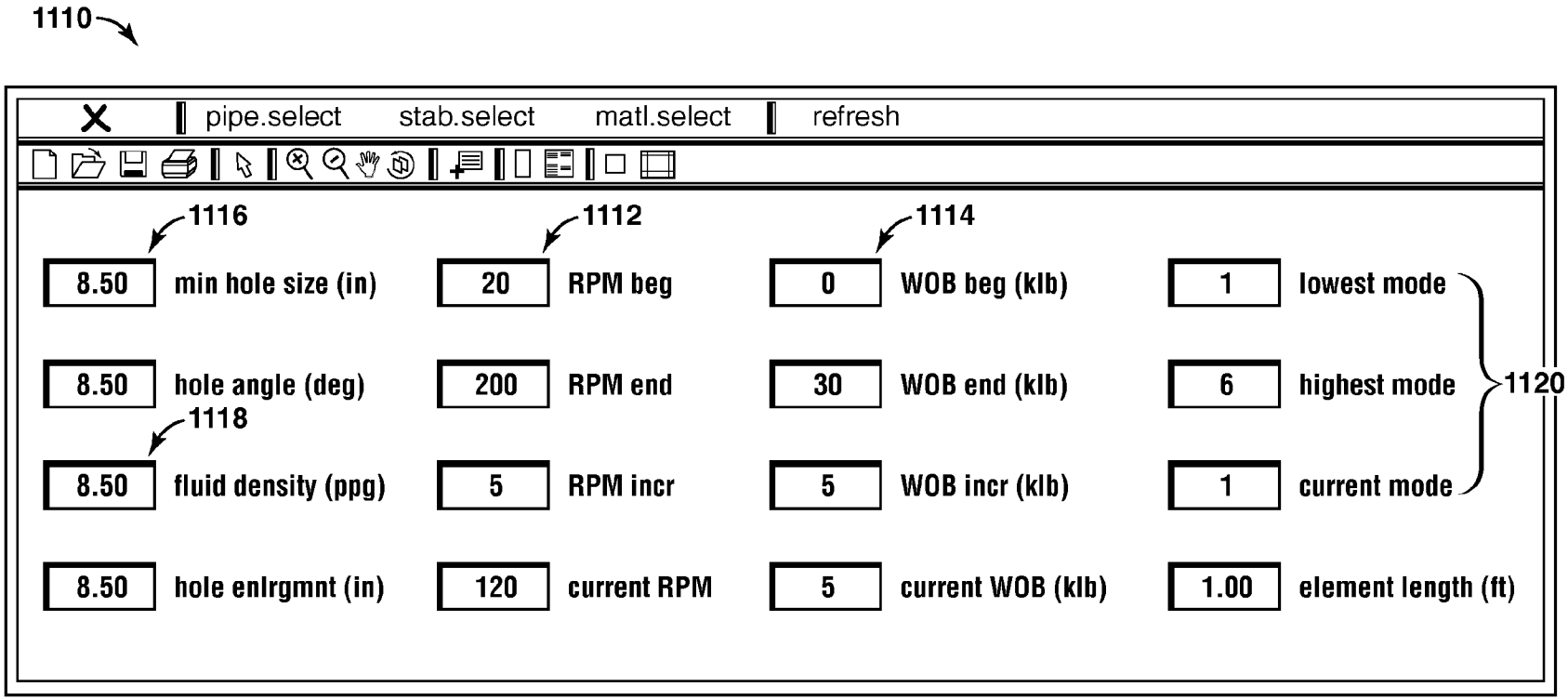
FIG. 11 is a representative data input window into which data regarding a drilling operation may be entered.
Figure 12:
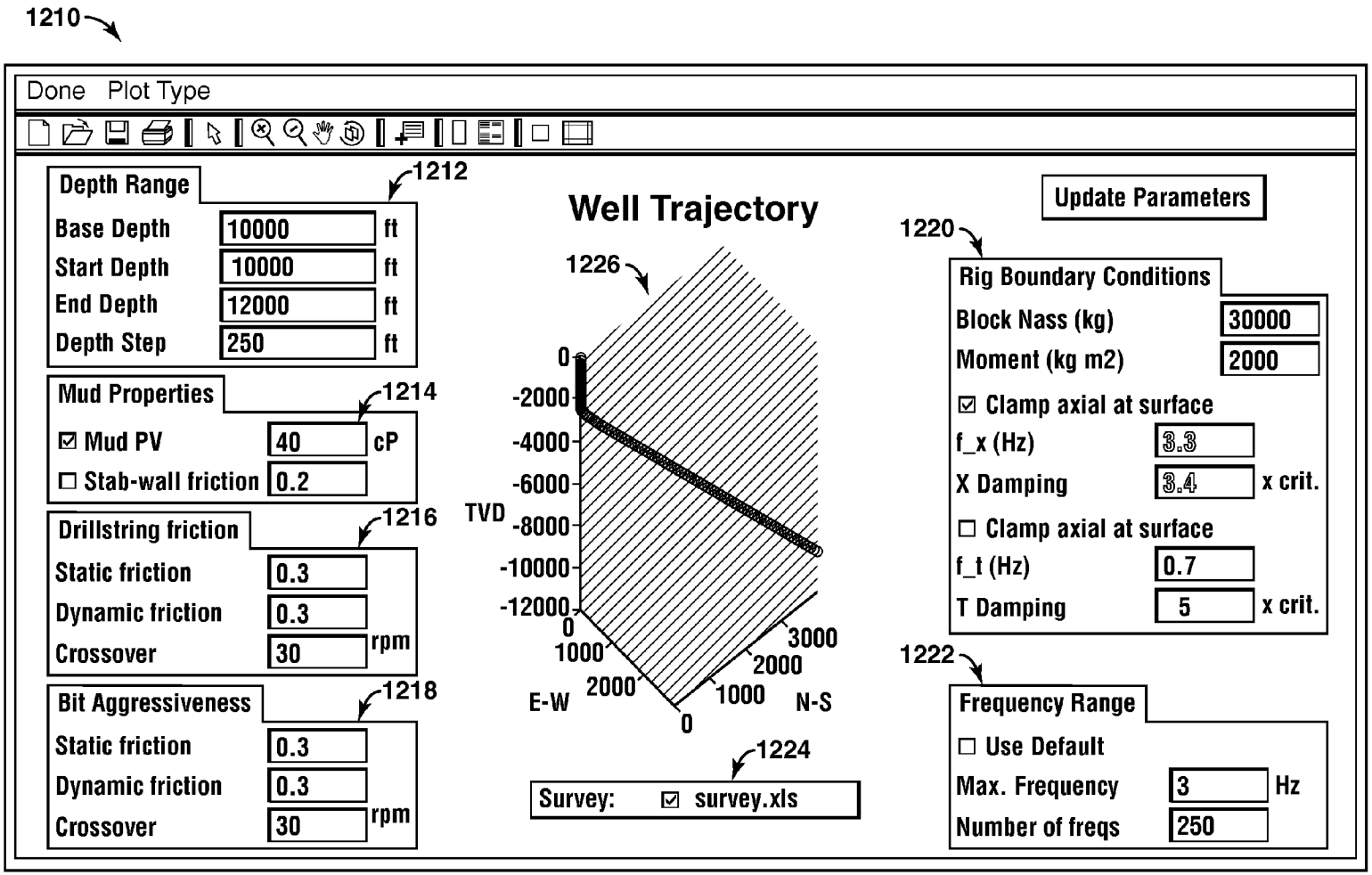
FIG. 12 is a representative data input window into which data regarding a drilling operation and design parameters may be entered.

The main configuration window 1110, shown in FIG. 11, allows input of parameters that are common with the lateral vibration tool of the WO2008/097303 publication. These include RPM ranges 1112 and WOB ranges 1114, hole size 1116, mud weight 1118, and the range of harmonics being considered 1120, among other parameters. A separate window 1210, shown in FIG. 12, allows input of some of the additional parameters needed for the implementation of the torsional-axial vibration methods above into a torsional-axial vibration tool. Exemplary parameters include the bit depth range 1212, mud plastic viscosity 1214 (can be frequency-dependent), drill tool assembly friction factor 1216 (can be velocity-dependent), bit aggressiveness 1218 (can be velocity-dependent), rig boundary conditions 1220 (can be clamped by default), and the frequency range 1222 to be analyzed for linear response functions. The window also allows import of a well plan or survey in excel format at 1224, and displays at 1226 the trajectory associated with the survey in order to ensure the correct borehole profile is being investigated.

Figure 13:
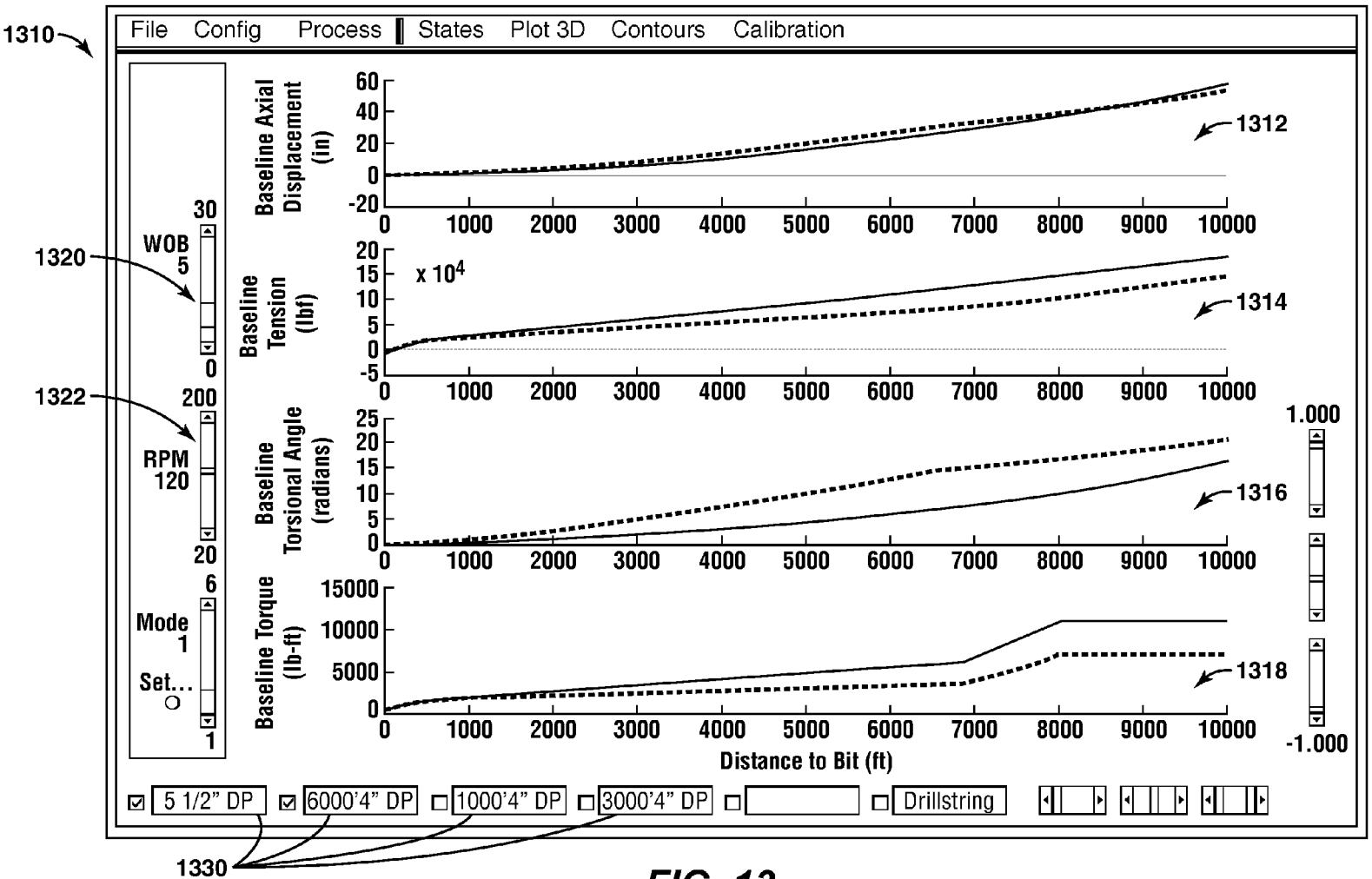
FIG. 13 is a representative illustration of a screenshot providing baseline solutions including axial and torsional results as a function of distance to bit for a specified WOB and RPM combination.

In some implementations, multiple drill tool assembly designs can be considered simultaneously for a given set of drilling conditions. FIG. 13 illustrates a series of graphs in a display window 1310, including plots for two drill tool assembly designs in each of the graphs. Any number of drill tool assembly designs may be considered simultaneously. As illustrated in FIG. 13, some implementations may be provided with a graphical interface in which a user can selectively chose to display or hide one or more of the drill tool assembly designs from the graphs, such as by the check boxes 1330 in the lower left of FIG. 13. While the illustrated plots are for just two designs and utilizing solid and dashed lines to differentiate, actual implementations may be adapted to use color-coding to more clearly visualize the plots for the different designs and to facilitate the use of more than two designs. The baseline solution is akin to a traditional torque-and-drag model, and provides the plot of axial displacement at 1312, tension at 1314, torsion angle at 1316, and torque at 1318, each as a function of distance from the bit while the drill tool assembly is rotating at the specified WOB, at 1320, and RPM, at 1322. FIG. 13 further illustrates that one or more of the parameters may be selected or varied within the graphical user interface, such as by using parameter sliders. Exemplary sliders are illustrated for parameters such as RPM 1322 and WOB 1320.

In the example of FIG. 13, two drill tool assembly designs are compared. They both have identical BHAs but one has only 5.5" drill pipe above the BHA (shown as solid line) while the other is a tapered design with 6000 ft. of 4" drill tool assembly between the BHA and the 5.5" drill pipe (shown in dashed line). The illustrated plots of FIG. 13 show nearly a 5 foot stretch of the drill tool assembly under these conditions. The significant difference in the torque at the surface is due to the larger contact forces with the borehole, since the non-tapered design is much heavier than the tapered one. A rapid increase in torque is seen in the build region (where the well inclination is changing from vertical to a deviated path, between approximately 7000 and 8000 ft. from the bit) due to increased contact forces needed to change the direction of the drill tool assembly.

Figure 14:
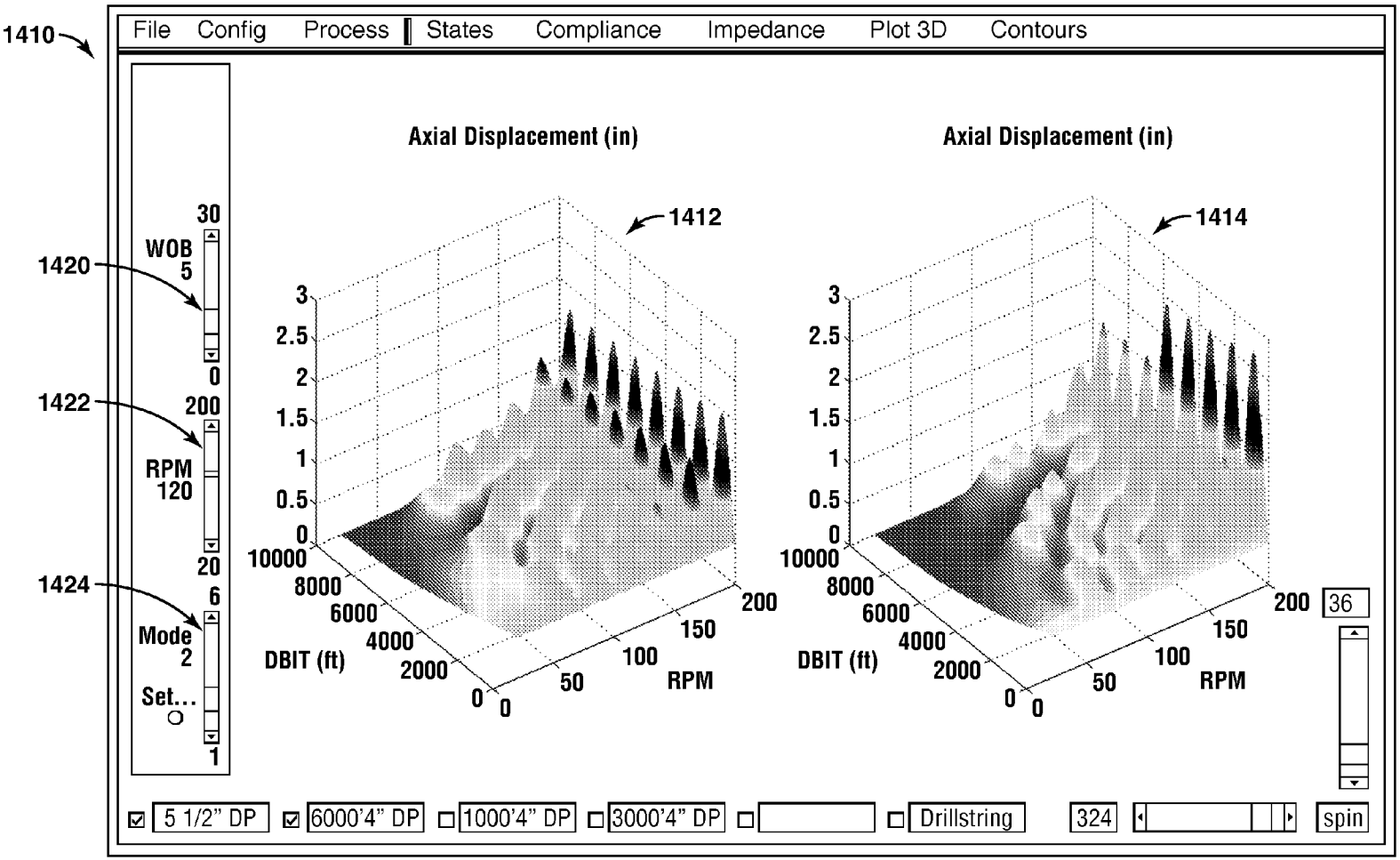
FIG. 14 is a representative illustration of axial eigenmode shapes for the second harmonic as a function of RPM and distance from the bit for two drill tool assembly designs.

FIG. 14 provides an exemplary three-dimensional representation of displacement in window 1410, which includes graphical representations of displacement for two different drill tool assemblies, at 1412 and 1414. The representations 1412 and 1414 show the magnitude of stretch for the second harmonic mode, see mode selector 1424, along the drill tool assembly when the bit is excited by a reference displacement of 0.5 inches. Resonance frequencies can be clearly identified. Borehole forces provide effective damping reducing the displacement at lower frequencies, but damping gets weaker as the RPM is increased. The user can use the provided sliders 1420, 1422, 1424, etc. to adjust the orientation of the plots, or change the harmonic modes to be analyzed. As in FIG. 13, multiple drill tool assembly designs may be compared on the same display. In some implementations, a single set of input windows may allow a user to generate a series of graphs or displays, such as those of FIGS. 13 and 14, characterizing the performance of the one or more designs established in the input windows.

Figure 15:
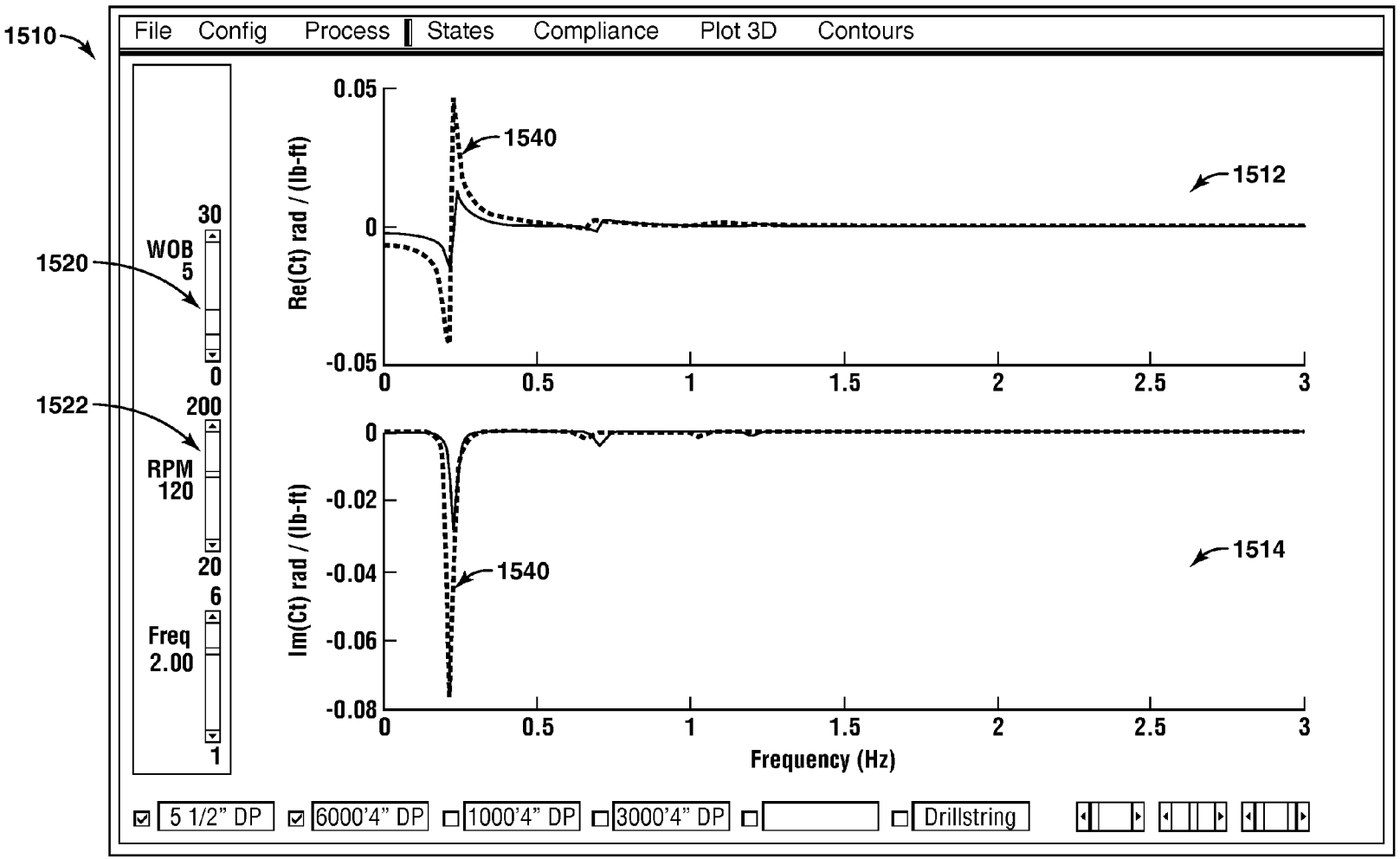
FIG. 15 is a representative illustration of torsional compliance at the bit for two drill tool assembly designs over a range of frequencies.

Whereas the harmonics of RPM are the primary excitations considered for axial vibrations, all frequencies may be considered to identify torsional instability. FIG. 15 shows in display window 1510 the effective torsional drill tool assembly compliance at the specified WOB 1520 (5 kblf) and RPM 1522 (120). FIG. 15 plots compliance for the two drill tool assembly designs of FIG. 13 using the same solid line and dashed line conventions. In this example, the first resonance 1540 around 0.25 Hz is associated with the onset of stick-slip. The resonance is identified by a zero-crossing of the real part 1512 (corresponding to the near cancellation of inertial and elastic forces) and a peak in the imaginary part 1514. The tapered string has a much sharper resonance, which corresponds to poorer stick-slip performance. Examining this plot allows the user to identify the relevant resonant frequency and to make sure that it is included in the stick-slip analysis to follow. In some implementations of the present methods, the software or other programming may provide informational screens, such as those of FIGS. 11-15, regarding the performance of the drill tool assembly. These information screens may present the results of one or more models or other equations, such as described above. In some implementations, the information screens present information that the user inputs into subsequent input windows for determination of one or more vibration performance indices. Additionally or alternatively, some implementations may be configured to present these screens for the user's information and to proceed independently to determination of one or more vibration performance indices.

Figure 16:
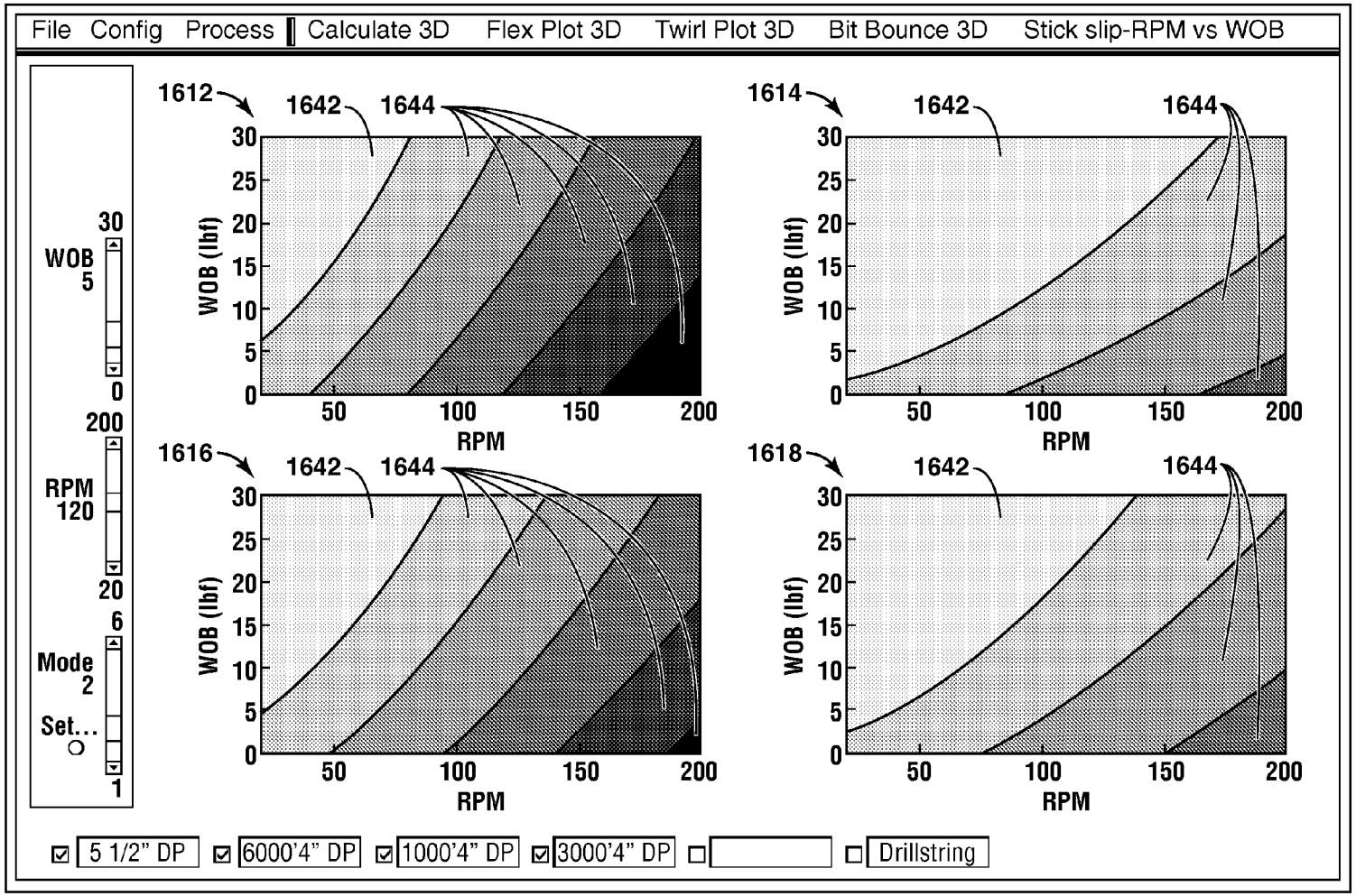
FIG. 16 is a representative illustration of stick-slip diagrams for four drill tool assembly designs.

Stick-slip performance analysis can be conducted to find the region of instability. The example of FIG. 16 displays contour plots of the stick-slip index $SS_1$ (Eq. (89)) as a function of RPM and WOB in window 1610. Contour plots are presented for four exemplary drill tool assemblies as indicated by the button selectors 1630. Specifically, FIG. 16 provides contour plots of the drill tool assemblies described above, the drill string configuration at 1612 and the tapered configuration at 1614. Two additional intermediate cases are considered here, where the length of the 4" drill pipe section was set at 1000 ft, at 1616, and 3000 ft, at 1618, respectively. Negative values for this index correspond to stick-slip instability, and are marked as band 1642 in the contour plot, with stable conditions illustrated by the remaining bands 1644 showing progressively more stable conditions. The result shows that compared to the untapered design 1612, the 6000 ft. tapered design 1614 has a significantly larger region of instability.

Figure 17:
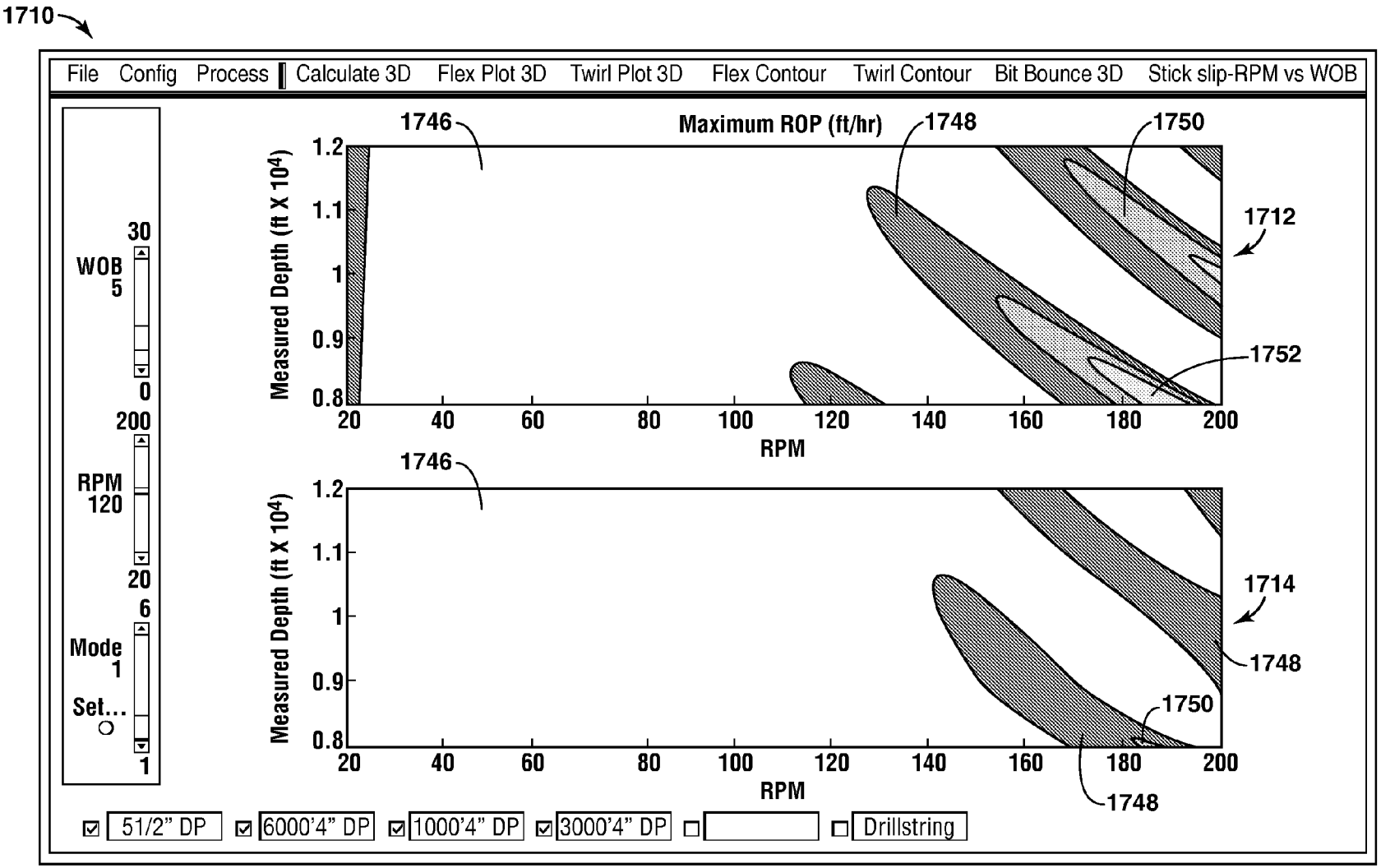
FIG. 17 is a contour plot of an exemplary axial vibration index.

Similarly, a bit bounce analysis can be conducted. FIG. 17 is a contour plot of the modified axial (bit bounce) index MAXROP(1), as a function of measured depth and RPM. The MAXROP(1) index of Eq. (70) is modified by replacing the real part of the compliance with its absolute value for the two drill tool assembly designs, illustrated at plots 1712 and 1714, as above, in the window 1710. The index tracks the ROP at which a forced axial displacement at the bit equal to the penetration per cycle results in a dynamic WOB amplitude that is equal to the average WOB, indicating the onset of bit bounce. For this index, larger values of the index are preferred, with preferred areas indicated by region 1746. Certain RPMs are identified as more prone to bit bounce and are highlighted as regions 1748, 1750, and 1752 in the contour plot of FIG. 17, with each region having a lower available ROP to avoid bit bounce. The available ROP is identified by the numbers on the contour plot boundaries. Note the change in RPM "sweet spots" as the bit depth changes. The base drill tool assembly design is more prone to bit bounce associated with forced displacement of the bit, due to its larger axial dynamic stiffness.

There are a large number of other combinations of performance indices and/or operating conditions that can be displayed with the present systems and methods, including any one or more of the indices and/or calculations described above. A person skilled in the art would be able to determine those most useful for the particular drilling constraints and objectives.

While the present techniques of the invention may be susceptible to various modifications and alternative forms, the exemplary embodiments discussed above have been shown by way of example. However, it should again be understood that the invention is not intended to be limited to the particular embodiments disclosed herein. Illustrative, non-exclusive, examples of descriptions of some systems and methods within the scope of the present disclosure are presented in the following numbered paragraphs. The preceding paragraphs are not intended to be an exhaustive set of descriptions, and are not intended to define minimum or maximum scopes or required elements of the present disclosure. Instead, they are provided as illustrative examples, with other descriptions of broader or narrower scopes still being within the scope of the present disclosure. Indeed, the present techniques of the invention are to cover all modifications, equivalents, and alternatives falling within the spirit and scope of the description provided herein.

What is claimed is:

1. A method of designing a drill tool assembly for use in a drilling operation, the method comprising:

obtaining drilling operations parameters regarding a drilling operation;

obtaining drill tool assembly data regarding at least one drill tool assembly design;

calculating a baseline solution of the at least one drill tool assembly design rotating at a uniform rotation speed in an absence of vibration using the obtained drilling operations parameters and the obtained drill tool assembly data;

constructing one or more linear frequency-domain models as a perturbation to the baseline solution; wherein at least one of the one or more linear frequency-domain models includes a damping coefficient that depends on the baseline solution;

utilizing the at least one of the one or more linear frequency-domain models to calculate one or more vibrational indices characterizing an excitation response of the at least one drill tool assembly design for the obtained drilling operations parameters and the obtained drill tool assembly data;

utilizing the calculated one or more vibrational indices to evaluate a suitability of the at least one drill tool assembly design for the drilling operation; and selecting a preferred drill tool assembly design from the at least one drill tool assembly design based at least in part on the calculated one or more vibrational indices of the at least one drill tool assembly design.

2. The method of claim 1, wherein the damping coefficient that depends on the baseline solution incorporates at least one of: borehole friction effects, mud viscosity effects and mud inertia effects, and wherein each of the effects depends on a frequency of excitation, the obtained drilling operations parameters and the obtained drill tool assembly data.

3. The method of claim 1, wherein the one or more linear frequency-domain models incorporates effects associated with a complex borehole trajectory.

4. The method of claim 1, wherein the calculated one or more vibrational indices comprises at least one of comparative indices and absolute indices.

5. The method of claim 1, wherein the excitation response of the at least one drill tool assembly design is primarily torsional.

6. The method of claim 1, wherein the excitation response of the at least one drill tool assembly design is primarily axial.

7. The method of claim 1, wherein at least one of the obtained drilling operations parameters relates to borehole trajectory, and wherein at least one of the one or more linear frequency-domain models is a function of borehole trajectory, and wherein at least one of the calculated one or more vibrational indices characterizes one or more dynamic vibration responses as affected by the borehole trajectory.

8. The method of claim 1, wherein the calculated one or more vibrational indices are combined into a composite index characterizing at least two responses of a drill tool assembly design during drilling operations.

9. The method of claim 8, wherein two or more vibrational indices of the calculated one or more vibrational indices are mathematically combined.

10. The method of claim 8, wherein two or more vibrational indices of the calculated one or more vibrational indices are graphically combined.

11. The method of claim 1, wherein the obtained drilling operations parameters comprises data regarding a range of suitable drilling operating conditions for at least one operational variable during drilling operations in a well in which the selected preferred drill tool assembly design may be implemented.

12. The method of claim 11, further comprising:

utilizing the calculated one or more vibrational indices to identify drilling operating conditions from the obtained drilling operations parameters that are adapted to mitigate vibrations, and developing a drilling plan based at least in part on the identified drilling operating conditions.

13. The method of claim 1, wherein at least one of the calculated one or more vibrational indices is determined for at least one resonant frequency of a drill tool assembly design.

14. The method of claim 1, wherein at least one of the calculated one or more vibrational indices is functionally dependent on one or more of: rotary speed, mud pump speed, a friction factor, bit depth, and weight on bit.

15. The method of claim 1, wherein the calculated one or more vibrational indices comprises at least one of a forced-displacement bit bounce index, a regenerative chatter bit bounce index, a forced torsional vibration index, a bit-induced stick-slip index, and a stored elastic energy index.

16. The method of claim 1, wherein the at least one of the one or more linear frequency-domain models incorporates tool joint effects.

17. A drill tool assembly design for use in a drilling operation, the drill tool assembly design comprising:

at least one downhole component; wherein the at least one downhole component is selected to provide the drill tool assembly design with a preferred vibrational index, wherein the preferred vibrational index characterizes an excitation response of at least one tubular member based at least in part on drilling operations parameters and drill tool assembly data, wherein the preferred vibrational index is determined using one or more frequency-domain models, wherein at least one of the one or more frequency-domain models is constructed as a perturbation to a baseline solution of the drill tool assembly design rotating at a uniform rotation speed in an absence of vibration, wherein the baseline solution incorporates the drilling operations parameters and the drill tool assembly data, and wherein the at least one of the one or more frequency-domain models includes a damping coefficient that depends on the baseline solution.

18. The drill tool assembly design of claim 17, wherein the damping coefficient that depends on the baseline solution incorporates at least one of: borehole friction effects, mud viscosity effects and mud inertia effects, and wherein each of the effects depends on a frequency of excitation, the drilling operations parameters, and the drill tool assembly data.

19. The drill tool assembly design of claim 17, wherein at least one of the one or more frequency-domain models incorporates effects associated with a complex borehole trajectory.

20. The drill tool assembly design of claim 17, wherein the preferred vibrational index comprises at least one of comparative indices and absolute indices.

21. The drill tool assembly design of claim 17, wherein the excitation response of the at least one tubular member is primarily torsional.

22. The drill tool assembly design of claim 17, wherein the excitation response of the at least one tubular member is primarily axial.

23. The drill tool assembly design of claim 17, wherein the preferred vibrational index comprises a composite index characterizing at least two responses of the drill tool assembly design during drilling operations.

24. The drill tool assembly design of claim 17, wherein the drilling operations parameters comprises data regarding a range of suitable drilling operating conditions for at least one operational variable during drilling operations in a well in which the drill tool assembly design may be implemented.

25. The drill tool assembly design of claim 17, wherein each of the one or more frequency-domain models incorporates tool joint effects.

26. A method of drilling a wellbore, the method comprising:

obtaining drilling operations parameters regarding a drilling operation;

obtaining drill tool assembly data regarding a drill tool assembly design to be used in the drilling operation;

calculating a baseline solution of the drill tool assembly design rotating at a uniform rotation speed in an absence of vibration using the obtained drilling operations parameters and the obtained drill tool assembly data;

constructing one or more linear frequency-domain models as a perturbation to the baseline solution; wherein at least one of the one or more linear frequency-domain models includes a damping coefficient that depends on the baseline solution;

utilizing at least one of the one or more linear frequency-domain models to calculate one or more vibrational indices characterizing an excitation response of the drill tool assembly design under a range of available operating conditions for the obtained drilling operations parameters and the obtained drill tool assembly data;

determining preferred drilling operating conditions to mitigate vibrations based at least in part on the calculated one or more of the vibrational indices;

drilling a wellbore using the drill tool assembly design while monitoring drilling operating conditions; and adjusting drilling operations to maintain drilling operating conditions at least substantially within a range of the determined preferred drilling operating conditions.

27. The method of claim 26, wherein the damping coefficient that depends on the baseline solution incorporates at least one of: borehole friction effects, mud viscosity effects and mud inertia effects, and wherein each of the effects depends on a frequency of excitation, the obtained drilling operations parameters, and the obtained drill tool assembly data.

28. The method of claim 26, wherein the at least one of the one or more linear frequency-domain models incorporates effects associated with a complex borehole trajectory.

29. The method of claim 26, wherein the at least one of the one or more linear frequency-domain models incorporates tool joint effects.

30. The method of claim 26, wherein the calculated one or more vibrational indices comprises at least one of comparative indices and absolute indices.

31. The method of claim 26, wherein the excitation response of the drill tool assembly design is primarily torsional.

32. The method of claim 26, wherein the excitation response of the drill tool assembly design is primarily axial.

33. The method of claim 26, wherein at least one of the obtained drilling operations parameters relates to borehole trajectory, and wherein at least one of the one or more linear frequency-domain models is a function of borehole trajectory, and wherein at least one of the calculated one or more vibrational indices characterizes one or more dynamic vibration responses as affected by the borehole trajectory.

34. The method of claim 26, wherein the calculated one or more vibrational indices are combined into a composite index characterizing at least two responses of a drill tool assembly during drilling operations.

35. The method of claim 26, wherein a range of available drilling operating conditions comprises ranges of available conditions for at least one drilling operations parameters selected from the group consisting of weight on bit, rotary speed, rate of penetration, mud properties, mud flow rate, bit depth, mud pump speed, MSE, and any combination thereof.

36. The method of claim 26, further comprising utilizing the wellbore in hydrocarbon-production related operations.

37. The method of claim 36, further comprising producing hydrocarbons from the wellbore.

38. The method of claim 26, further comprising utilizing the wellbore in one or more applications selected from geothermal-related operations, water injection operations, waste injection operations, and carbon sequestration operations.

39. A method of mitigating drill tool assembly vibrations that occur during drilling operations, the method comprising:

obtaining data regarding drilling parameters related to one or more drilling operations;

calculating a baseline solution for the one or more drilling operations of a drill tool assembly design rotating at a uniform speed in an absence of vibration using the obtained data regarding drilling parameters;

constructing one or more linear frequency-domain models as a perturbation to the baseline solution; wherein at least one of the one or more linear frequency-domain models includes damping coefficients that depend on the baseline solution;

utilizing the at least one of the one or more linear frequency-domain models to calculate one or more vibrational indices characterizing an excitation response of the drill tool assembly design for the obtained data regarding drilling parameters;

utilizing the calculated one or more vibrational indices to identify at least one drilling parameter change to mitigate drill tool assembly vibrations; and adjusting one or more drilling parameters based at least in part on at least one of the calculated one or more vibrational indices and the identified at least one drilling parameter change.

40. The method of claim 39, wherein the excitation response of the drill tool assembly design is primarily torsional.

41. The method of claim 39, wherein the excitation response of the drill tool assembly design is primarily axial.

42. The method of claim 39, wherein at least one of the obtained data regarding drilling parameters relates to borehole trajectory, and wherein at least one of the one or more frequency-domain models is a function of borehole trajectory, and wherein at least one of the calculated one or more vibrational indices characterizes one or more dynamic vibration responses as affected by the borehole trajectory.

43. The method of claim 39, wherein the damping coefficients that depend on the baseline solution incorporate at least one of: borehole friction effects, mud viscosity effects and mud inertia effects, and wherein each of the effects depends on a frequency of excitation and the obtained data regarding drilling parameters.

* * * * *